US012460892B2

(12) United States Patent
Yehle

(10) Patent No.: US 12,460,892 B2
(45) Date of Patent: Nov. 4, 2025

(54) CROSSBOW WITH TRIGGER BOX

(71) Applicant: Ravin Crossbows, LLC, Superior, WI (US)

(72) Inventor: Craig Yehle, Winona, MN (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 18/969,971

(22) Filed: Dec. 5, 2024

(65) Prior Publication Data

US 2025/0189258 A1 Jun. 12, 2025

Related U.S. Application Data

(60) Provisional application No. 63/607,027, filed on Dec. 6, 2023.

(51) Int. Cl.
*F41B 5/12* (2006.01)
*F41B 5/10* (2006.01)
*F41B 5/14* (2006.01)

(52) U.S. Cl.
CPC ..... *F41B 5/123* (2013.01); *F41B 5/10* (2013.01); *F41B 5/12* (2013.01); *F41B 5/143* (2013.01); *F41B 5/1469* (2013.01)

(58) Field of Classification Search
CPC ..... F41B 5/12; F41B 5/123
See application file for complete search history.

(56) References Cited

U.S. PATENT DOCUMENTS 3,993,039 A 11/1976 Groves et al.
4,169,456 A 10/1979 Van House
4,917,071 A 4/1990 Bozek
4,957,093 A 9/1990 Hamlett
5,020,507 A 6/1991 Larson
(Continued)

FOREIGN PATENT DOCUMENTS

WO WO-2011/141771 A1 11/2011
WO WO-2011/158062 A1 12/2011
(Continued)

OTHER PUBLICATIONS

"Axe Crossbows", Accessed Aug. 1, 2023, https://www.feradyne.com/brands/axe-crossbows, 3 pages.
(Continued)

*Primary Examiner* — John A Ricci

(74) *Attorney, Agent, or Firm* — FOLEY & LARDNER LLP

(57) ABSTRACT

A crossbow includes a first plate including a slot, a second plate including a slot, the second plate coupled to the first plate and extending substantially parallel to the first plate, the second plate spaced apart from the first plate, an upper flexible limb coupled with the first plate, a lower flexible limb coupled with the second plate, a draw string operatively engaged with the upper flexible limb and the lower flexible limb, the draw string configured to move from a released position to a drawn position, and a trigger box slidably coupled with the first plate the second plate and engaged with the slot of the first plate and the slot of the second plate, the trigger box configured to selectively engage with the draw string to move the draw string between the released position the drawn position.

20 Claims, 49 Drawing Sheets

(56) References Cited

U.S. PATENT DOCUMENTS 5,024,206 A 6/1991 Lester
5,678,528 A 10/1997 Hadley
6,095,128 A 8/2000 Bednar
6,274,324 B1 8/2001 Davis et al.
6,474,324 B1 11/2002 Despart et al.
6,990,970 B1 1/2006 Darlington
7,047,958 B1 5/2006 Colley
7,204,242 B2 4/2007 Dziekan
7,578,289 B2 8/2009 Norkus
7,708,001 B2 5/2010 Kempf
7,770,567 B1 8/2010 Yehle
7,784,453 B1 8/2010 Yehle
7,832,386 B2 11/2010 Bednar et al.
7,836,871 B2 11/2010 Kempf
7,891,348 B2 2/2011 Colley
8,156,928 B1 4/2012 Blahnik
8,191,541 B2 6/2012 Shaffer et al.
8,240,299 B2 8/2012 Kronengold et al.
8,281,774 B2 10/2012 Grace
8,375,928 B1 2/2013 Bednar et al.
8,439,025 B2 5/2013 Shaffer et al.
8,453,631 B1 6/2013 Kronengold et al.
8,469,012 B2 6/2013 Bednar et al.
8,479,719 B2 7/2013 Bednar et al.
8,522,761 B1 9/2013 Chu
8,522,762 B2 9/2013 Trpkovski
8,567,376 B2 10/2013 Flint
8,578,917 B2 11/2013 Bednar et al.
8,627,811 B1 1/2014 Darlington
8,656,899 B2 2/2014 Bednar et al.
8,671,925 B2 3/2014 Grace
8,701,641 B2 4/2014 Biafore
8,701,642 B2 4/2014 Biafore et al.
8,763,595 B1 7/2014 Bednar et al.
8,794,225 B2 8/2014 Bednar et al.
8,813,735 B2 8/2014 Biafore et al.
8,919,332 B2 12/2014 Trpkovski
8,991,375 B2 3/2015 McPherson
8,997,728 B2 4/2015 Popov et al.
9,022,013 B2 5/2015 Trpkovski
9,068,791 B2 6/2015 McPherson
9,255,756 B1 2/2016 Wu et al.
9,255,757 B2 2/2016 McPherson
9,255,758 B1 2/2016 Bednar et al.
9,273,922 B2 3/2016 Hudkins
9,297,604 B1 3/2016 Sidebottom et al.
9,310,156 B2 4/2016 Whitaker et al.
9,341,430 B2 5/2016 McPherson
9,341,434 B2 5/2016 McPherson et al.
9,354,015 B2 5/2016 Yehle
9,354,018 B2 5/2016 Khoshnood
9,360,268 B2 6/2016 Khoshnood
9,383,159 B2 7/2016 Pulkrabek et al.
9,435,605 B2 9/2016 McPherson et al.
9,453,698 B1 9/2016 Grace
9,476,665 B2 10/2016 McPherson
9,494,379 B2 11/2016 Yehle
9,494,380 B1 11/2016 Yehle
9,500,433 B2 11/2016 McPherson
9,506,716 B2 11/2016 Bednar et al.
9,513,079 B1 * 12/2016 Missel ..... F41B 5/143
9,513,080 B1 12/2016 Kempf et al.
9,528,790 B2 12/2016 Bednar et al.
9,557,134 B1 1/2017 Yehle
RE46,411 E 5/2017 Chu
9,658,025 B2 5/2017 Trpkovski
9,671,189 B2 6/2017 McPherson
9,689,638 B1 6/2017 Yehle
9,726,454 B2 8/2017 Mcpherson et al.
9,733,041 B2 8/2017 Khoshnood
9,759,509 B1 9/2017 Kempf et al.
9,829,268 B1 11/2017 Kempf et al.
9,851,171 B2 12/2017 Bednar et al.
9,851,172 B2 12/2017 Bednar et al.
9,863,735 B2 1/2018 Bednar et al.
9,879,937 B2 1/2018 McPherson
9,879,938 B1 1/2018 Isenhower et al.
9,879,939 B2 1/2018 McPherson
9,909,832 B2 3/2018 Darlington et al.
9,921,026 B1 3/2018 Anderson
9,933,229 B2 4/2018 Coalson et al.
9,945,634 B1 4/2018 Isenhower et al.
9,958,232 B1 * 5/2018 Egerdee ..... F41B 5/1403
9,982,960 B2 5/2018 Trpkovski
10,012,468 B1 7/2018 Kempf et al.
10,018,442 B1 7/2018 Kempf et al.
10,048,036 B1 8/2018 Kempf et al.
10,107,584 B1 10/2018 Anderson
10,126,089 B1 11/2018 Kempf et al.
10,139,189 B1 11/2018 Isenhower et al.
10,139,191 B1 11/2018 Kempf et al.
10,156,416 B2 12/2018 Bednar et al.
10,184,749 B2 1/2019 Trpkovski
10,184,750 B2 1/2019 McPherson
10,190,841 B2 1/2019 Laurence
10,197,354 B2 2/2019 McPherson et al.
10,215,522 B1 2/2019 Kempf et al.
10,240,890 B2 * 3/2019 Trpkovski ..... F41B 5/12
10,247,507 B2 4/2019 McPherson et al.
10,254,074 B2 4/2019 McPherson
10,260,835 B2 4/2019 Pulkrabek et al.
10,274,280 B2 4/2019 Chu et al.
10,274,281 B2 4/2019 Chu et al.
10,281,230 B2 5/2019 Khoshnood
10,295,297 B2 5/2019 Khoshnood
10,295,299 B2 5/2019 Vergara
10,408,558 B2 9/2019 Thalberg
10,408,560 B1 9/2019 Kempf et al.
10,421,637 B1 9/2019 Huang
10,458,742 B1 10/2019 Kempf et al.
10,458,743 B1 10/2019 Kempf et al.
10,473,418 B2 11/2019 Shaffer et al.
10,480,893 B2 11/2019 McPherson
10,495,404 B2 12/2019 Shaffer et al.
10,502,516 B2 12/2019 Bednar et al.
10,502,518 B2 12/2019 McPherson et al.
10,508,884 B1 12/2019 Chen
10,514,226 B2 12/2019 Shaffer et al.
10,514,227 B1 12/2019 Kempf et al.
10,520,273 B2 12/2019 Bednar
10,520,274 B2 12/2019 Bartels
10,527,383 B2 1/2020 Fulton
10,551,141 B2 2/2020 Bednar et al.
10,563,949 B2 2/2020 McPherson et al.
10,605,555 B1 3/2020 Shaffer et al.
10,612,883 B2 4/2020 Hanson
10,627,185 B2 4/2020 Marriott et al.
10,634,447 B2 4/2020 Smith et al.
10,677,558 B2 6/2020 McPherson et al.
10,690,435 B2 6/2020 Trpkovski
10,690,436 B1 * 6/2020 Kempf ..... F41B 5/1469
10,739,104 B1 8/2020 Smith et al.
10,767,956 B2 9/2020 Popov
10,823,525 B1 11/2020 Stevens
10,830,553 B2 11/2020 Egerdee et al.
10,837,733 B2 11/2020 McPherson et al.
10,845,153 B2 11/2020 Trpkovski
10,859,340 B2 12/2020 Khoshnood
10,859,341 B2 12/2020 Khoshnood
10,866,056 B2 12/2020 McPherson
10,900,737 B1 1/2021 Hensel et al.
10,900,738 B1 1/2021 Hensel et al.
10,900,739 B2 1/2021 Shaffer et al.
10,907,925 B2 2/2021 Shaffer et al.
10,921,086 B2 2/2021 Thalberg
10,939,192 B2 3/2021 Michel et al.
10,948,257 B1 3/2021 Huang et al.
10,962,323 B2 3/2021 Langley
10,969,192 B1 4/2021 Gallops et al.
10,989,492 B1 4/2021 Kempf et al.
10,996,019 B2 5/2021 Liu
11,002,505 B1 5/2021 Shaffer et al.
11,009,310 B1 5/2021 Shaffer et al.
11,015,892 B1 5/2021 Jessup et al.

(56) References Cited

U.S. PATENT DOCUMENTS

| | | | |
|---|---|---|---|
| 11,022,398 | B1 | 6/2021 | Kempf et al. |
| 11,029,119 | B2 | 6/2021 | Thalberg |
| 11,041,689 | B2 | 6/2021 | McPherson et al. |
| 11,054,210 | B2 | 7/2021 | Bednar et al. |
| 11,067,357 | B1 | 7/2021 | Chu et al. |
| 11,079,197 | B1 | 8/2021 | Fulton |
| 11,085,721 | B1 | 8/2021 | Liu |
| 11,098,973 | B2 | 8/2021 | Walthert |
| 11,112,205 | B1 | 9/2021 | Kempf et al. |
| 11,131,524 | B1 | 9/2021 | Kempf et al. |
| 11,137,228 | B1 | 10/2021 | Chang |
| 11,143,483 | B2 | 10/2021 | Marriott et al. |
| 11,156,429 | B1 | 10/2021 | Kempf et al. |
| 11,156,430 | B2 | 10/2021 | Smith et al. |
| 11,181,336 | B2 | 11/2021 | Thalberg |
| 11,209,234 | B2 | 12/2021 | Smith et al. |
| 11,221,191 | B2 | 1/2022 | Bednar et al. |
| 11,236,962 | B2 | 2/2022 | McPherson et al. |
| 11,236,963 | B2 | 2/2022 | Bednar et al. |
| 11,236,964 | B2 | 2/2022 | Bednar et al. |
| 11,262,152 | B2 | 3/2022 | Thalberg |
| 11,262,153 | B1 | 3/2022 | Mcneil |
| 11,268,780 | B2 | 3/2022 | Stanziale |
| 11,268,781 | B1 | 3/2022 | Kempf et al. |
| 11,268,782 | B1 | 3/2022 | Chang |
| 11,274,898 | B2 | 3/2022 | Shaffer et al. |
| 11,300,380 | B2 | 4/2022 | Bednar et al. |
| 11,306,994 | B2 | 4/2022 | Shaffer et al. |
| 11,320,230 | B2 | 5/2022 | Thalberg |
| 11,359,882 | B1 | 6/2022 | Chang |
| 11,371,795 | B1 | 6/2022 | Kempf et al. |
| 11,378,350 | B1 | 7/2022 | Kempf et al. |
| 11,402,171 | B2 | 8/2022 | Trpkovski |
| 11,428,496 | B2 | 8/2022 | Marriott et al. |
| 11,428,498 | B2 | 8/2022 | McPherson et al. |
| 11,428,499 | B2 | 8/2022 | Shaffer et al. |
| 11,466,957 | B1 | 10/2022 | Liu |
| 11,499,792 | B1 | 11/2022 | Kempf et al. |
| 11,512,924 | B1 | 11/2022 | Xiao |
| 11,525,650 | B1 | 12/2022 | Nebergall et al. |
| 11,536,533 | B2 | 12/2022 | McPherson et al. |
| RE49,372 | E | 1/2023 | Vergara |
| 11,549,777 | B1 | 1/2023 | Trpkovski |
| 11,549,778 | B1 | 1/2023 | Liu |
| 11,573,062 | B2 | 2/2023 | Haas et al. |
| 11,592,258 | B2 | 2/2023 | Shaffer et al. |
| 11,609,061 | B2 | 3/2023 | Walthert |
| 11,635,274 | B2 | 4/2023 | Trpkovski |
| 11,680,767 | B2 | 6/2023 | Barnett |
| 11,686,549 | B1 | 6/2023 | Chu et al. |
| 11,698,240 | B2 | 7/2023 | Thalberg |
| 11,703,299 | B1 | 7/2023 | Chang |
| 11,725,899 | B2 | 8/2023 | Trpkovski et al. |
| 11,774,210 | B1 | 10/2023 | Chang |
| 11,781,829 | B2 | 10/2023 | Bednar et al. |
| 11,796,277 | B2 | 10/2023 | Mcpherson |
| 11,802,748 | B1 | 10/2023 | Wei et al. |
| 11,808,544 | B1 | 11/2023 | Chu et al. |
| 11,808,545 | B1 | 11/2023 | Chu et al. |
| 11,846,487 | B2 | 12/2023 | Thalberg |
| 11,874,085 | B2 | 1/2024 | Barnett |
| 11,885,587 | B2 | 1/2024 | Shaffer et al. |
| 11,892,265 | B1 | 2/2024 | Chu et al. |
| 11,913,752 | B2 | 2/2024 | Bednar et al. |
| 11,920,892 | B2 | 3/2024 | Mcpherson et al. |
| 11,927,424 | B2 | 3/2024 | Nebergall et al. |
| 11,946,718 | B2 | 4/2024 | Obteshka et al. |
| 11,946,720 | B1 | 4/2024 | Chang |
| 12,018,909 | B1 | 6/2024 | Barnett |
| 12,025,402 | B1 | 7/2024 | Barnett et al. |
| 12,085,355 | B2 | 9/2024 | Crist et al. |
| 12,111,131 | B2 | 10/2024 | Trpkovski |
| 12,111,132 | B2 | 10/2024 | Bednar et al. |
| 12,188,740 | B2 | 1/2025 | Yehle |
| 12,188,741 | B2 | 1/2025 | Bednar et al. |
| 12,215,953 | B2 | 2/2025 | Trpkovski |
| 12,215,954 | B1 | 2/2025 | Kempf |
| 12,222,182 | B2 | 2/2025 | Mcpherson |
| 12,247,803 | B1 | 3/2025 | Kempf |
| 2002/0129803 | A1 | 9/2002 | Larson |
| 2005/0279338 | A1 | 12/2005 | Dziekan |
| 2010/0170486 | A1 | 7/2010 | Shepley et al. |
| 2010/0170488 | A1 | 7/2010 | Rasor et al. |
| 2011/0030666 | A1 | 2/2011 | Darlington |
| 2011/0158062 | A1 | 6/2011 | Watanabe et al. |
| 2011/0308508 | A1 | 12/2011 | Islas |
| 2012/0125302 | A1 | 5/2012 | Stanziale |
| 2012/0312287 | A1 | 12/2012 | Park |
| 2014/0158105 | A1 | 6/2014 | Islas |
| 2014/0261358 | A1 | 9/2014 | Pulkrabek et al. |
| 2014/0261360 | A1 | 9/2014 | Pulkrabek et al. |
| 2015/0168093 | A1 | 6/2015 | Yehle |
| 2016/0040952 | A1 | 2/2016 | Carroll |
| 2016/0223285 | A1 | 8/2016 | Yehle |
| 2016/0273870 | A1 | 9/2016 | Pulkrabek et al. |
| 2016/0290757 | A1 | 10/2016 | Khoshnood |
| 2016/0362892 | A1 | 12/2016 | Murphey et al. |
| 2017/0038173 | A1 | 2/2017 | Yehle |
| 2017/0108307 | A1 | 4/2017 | Yehle |
| 2017/0115090 | A1 | 4/2017 | Bofill |
| 2017/0122691 | A1 | 5/2017 | Yehle |
| 2017/0122695 | A1 | 5/2017 | Yehle |
| 2017/0160042 | A1 | 6/2017 | Yehle |
| 2017/0191788 | A1 | 7/2017 | Eacker |
| 2018/0051954 | A1 | 2/2018 | Yehle |
| 2018/0051955 | A1 | 2/2018 | Yehle |
| 2018/0051956 | A1 | 2/2018 | Yehle |
| 2018/0094895 | A1 | 4/2018 | Yehle |
| 2018/0187996 | A1 | 7/2018 | Yehle |
| 2018/0321010 | A1 | 11/2018 | Yehle |
| 2018/0321011 | A1 | 11/2018 | Yehle |
| 2019/0011212 | A1 | 1/2019 | Shaffer et al. |
| 2019/0120587 | A1 | 4/2019 | Hanson |
| 2019/0137212 | A1 | 5/2019 | Yehle |
| 2019/0154392 | A1 | 5/2019 | Yehle |
| 2019/0186863 | A1 | 6/2019 | Yehle |
| 2019/0186865 | A1 | 6/2019 | Pulkrabek et al. |
| 2019/0212093 | A1 | 7/2019 | Walthert |
| 2019/0250068 | A1 | 8/2019 | Powell et al. |
| 2019/0257614 | A1 | 8/2019 | Bofill |
| 2020/0191517 | A1 | 6/2020 | Trpkovski |
| 2020/0300574 | A1 | 9/2020 | Walthert |
| 2020/0370856 | A1 | 11/2020 | Trpkovski |
| 2020/0378713 | A1 | 12/2020 | Mcpherson |
| 2020/0408482 | A1 | 12/2020 | Yehle |
| 2021/0018293 | A9 | 1/2021 | Yehle |
| 2021/0048268 | A1 | 2/2021 | Trpkovski |
| 2021/0080218 | A1 | 3/2021 | Trpkovski |
| 2021/0088305 | A1 | 3/2021 | Yehle |
| 2021/0222987 | A1 | 7/2021 | Yehle |
| 2021/0270560 | A1 | 9/2021 | Yehle |
| 2022/0026170 | A1 | 1/2022 | Walthert |
| 2022/0026172 | A1 | 1/2022 | Trpkovski |
| 2022/0113106 | A1 | 4/2022 | Blackstock |
| 2022/0136797 | A1 | 5/2022 | Haas et al. |
| 2022/0138018 | A1 | 5/2022 | Bednar et al. |
| 2022/0155036 | A1 | 5/2022 | McPherson et al. |
| 2022/0155039 | A1 | 5/2022 | Walthert |
| 2022/0163279 | A1 | 5/2022 | Liu |
| 2022/0178646 | A1 | 6/2022 | Yehle |
| 2022/0205755 | A1 | 6/2022 | Yehle |
| 2022/0214132 | A1 | 7/2022 | Trpkovski et al. |
| 2022/0307791 | A1 | 9/2022 | Trpkovski |
| 2022/0364819 | A1 | 11/2022 | Trpkovski |
| 2022/0373290 | A1 | 11/2022 | Yehle |
| 2022/0381532 | A1 | 12/2022 | Barnett |
| 2022/0397369 | A1 | 12/2022 | Smith |
| 2023/0071626 | A1 | 3/2023 | Nebergall et al. |
| 2023/0127133 | A1 | 4/2023 | Obteshka et al. |
| 2023/0168062 | A1 | 6/2023 | Yehle |
| 2023/0204319 | A1 | 6/2023 | Yehle |
| 2023/0204320 | A1 | 6/2023 | Yehle |
| 2023/0204322 | A1 | 6/2023 | Shaffer et al. |
| 2023/0221089 | A1 | 7/2023 | Barnett |

(56) References Cited

U.S. PATENT DOCUMENTS

| | | | |
|---|---|---|---|
| 2023/0235988 | A1 | 7/2023 | Liu |
| 2023/0266096 | A1 | 8/2023 | Bednar |
| 2023/0288168 | A1 | 9/2023 | Bednar et al. |
| 2023/0332859 | A1 | 10/2023 | Liu |
| 2023/0349662 | A1 | 11/2023 | Trpkovski |
| 2023/0358502 | A1 | 11/2023 | Crist et al. |
| 2023/0408219 | A1 | 12/2023 | Obteshka et al. |
| 2024/0167783 | A1 | 5/2024 | Nebergall et al. |
| 2024/0191965 | A1 | 6/2024 | Bednar et al. |
| 2024/0240908 | A1 | 7/2024 | Mcpherson et al. |
| 2024/0418472 | A1 | 12/2024 | Wasilewski et al. |
| 2025/0027741 | A1 | 1/2025 | Bednar et al. |
| 2025/0109922 | A1 | 4/2025 | Lipowski et al. |

FOREIGN PATENT DOCUMENTS

| | | | |
|---|---|---|---|
| WO | WO-2022/093516 | A1 | 5/2022 |
| WO | WO-2024/077394 | A1 | 4/2024 |

OTHER PUBLICATIONS

"Gearhead Archery X16 Series", Accessed Aug. 1, 2023, https://www.gearheadarchery.com/x16- series/r, 6 pages.

[Archery Supplies]. (Feb. 7, 2015). Martin HawkVE Compound Bow [Video]. YouTube. https://www.youtube.com/watch?v=t6UE0hwo0ml&t=38s.

AAE Lightning, [online], [site visited Apr. 22, 2025]. Available from Internet, URL: https://www.worthpoint.com/worthopedia/aae-whale-tail-magnetic-drop-away-173576436.

Archery Club Short Axis Dual-use Compound Hunting Bow - Archery Club Short Axis Dual-use Compound Hunting Bow, [Available Online], [Site visited Apr. 22, 2025]. Available from Internet, URL: https://www.chnarchery.com/products/compound-hunting-bows.

Axe 440, [facebook post], [site visited Apr. 22, 2025]. Available from Internet, URL: https://www.facebook.com/axecrossbows/posts/pfbid02NhKbQ9JFJKbZZZzxVfZXiLoufVRifqCLJ4pCQ2NS2xBe7gm8NXsf3Gk2153PnfbMI?rdid=IEJbclcAUyK4a4kP#.

Bear Lightening Strike, posting date Jul. 2017, [online], [site visited Apr. 22, 2025]. Available from Internet, URL: https://www.nextechclassifieds.com/listings/1314737/.

Bow Review: Prime Centergy, [Online Article], [site visited Apr. 22, 2025]. Posting Date Jul. 20, 2017. Available from the Internet, URL: https://www.bowhunter.com/editorial/prime-centergy/309456.

BowTech Announces Limited Edition Destroyer 350, [Online Article], [site visited Apr. 22, 2025]. Posting Date Oct. 2, 2012. Available from the Internet, URL: https://www.archerywire.com/releases/270448/.

Introducing Axe Crossbows, [Online Article], [site visited Apr. 22, 2025]. available from internet, URL: https://www.bowhunting.com/news/2020/07/30/introducing-axe-crossbows/.

Jennings Devastator Bow, Obtained from https://www.arkansashunting.net/, First Posted Aug. 7, 2014, [site visited Apr. 22, 2025], Available from Internet, URL: https://www.arkansashunting.net/attachments/bow-2-jpg.56690/.

Martin Razor X Compound Bow, posting date by 2007, [online], [site visited Apr. 22, 2025]. Available from Internet, URL: https://www.abbeyarchery.com.au/p/M79EP/Martin Razor X Elite Nitrous Target.html.

Photograph of Browning X-Cellerator, 1982, Obtained from ArcheryHistory.com, available from Internet, URL: https://archeryhistory.com/compounds/80picsnew/browning82.jpg.

Photograph of Darton "trans Groove", 1986, Obtained from ArcheryHistory.com, available from Internet, URL: https://archeryhistory.com/compounds/80picsnew/darton86.jpg.

Photograph of Darton Stringer IT Compound Bow, sold by Dec./Jan. 1989, Obtained from ArcheryHistory.com, available at https://www.archeryhistory.com/compounds/80picsnew/132ah.jpg.

PSE TAC Dropaway, Lose the Biscuit and Improve Your TAC15/151 Shooting Performance, Installation Guide, Date Unavailable, Available for Download from https://www.crossbownation.com/attachments/tac-15i-qad-hdx-rest-installation-steps-doc.26820/.

PSE TAC Series Crossbow, posting date by 2014, [online], [site visited Apr. 22, 2025]. Available from Internet, URL: https://www.midwayusa.com/product/1007481413?pid=417316.

QAD arrow rest kit, Lose the Biscuit and Improve Your TAC15/151 Shooting Performance, Installation Guide, Date Unavailable, Available for Download from https://www.crossbownation.com/attachments/tac-15i-qad-hdx-rest-installation-steps-doc.26820/.

Swiss Crossbow Makers Twinbow II Sixpack Riser, [Online Article], [site visited Apr. 22, 2025]. Available from Internet, URL: https://www.arrowinapple.com/crossbow/swiss-crossbow-makers/twinbowii/.

* cited by examiner

CROSSBOW WITH TRIGGER BOX

CROSS REFERENCE TO RELATED PATENT APPLICATION

This application claims the benefit of and priority to U.S. Provisional Patent Application No. 63/607,027, filed Dec. 6, 2023, which is incorporated herein by reference in its entirety.

BACKGROUND

This application relates generally to archery equipment, such as a projectile launchers including crossbows or other bows. Projectile launchers have been used for many years as a weapon for hunting and target shooting. Many projectile launchers are designed to maximize the speed or force of a projectile (e.g., an arrow, a bolt, or some other projectile) fired from the projectile launcher. Projectile launchers include a draw string that is drawn (e.g., cocked) to cause limbs to flex so that energy is stored in the limbs until the draw string is released to launch the projectile. Speed of a launched projectile or the force at which the projectile is launched can nr increased by increasing the amount of potential energy stored in the limbs when the draw string is drawn, for example. To increase potential energy stored in the limbs when drawn, many projectile launchers are structured to maximize the degree to which cams (e.g., draw string guides) of the projectile launcher are permitted to rotate, which in turn can allow for limbs to flex to a greater degree so that a more potential energy is stored in the limbs.

However, as the degree of rotation of the cam is increased, so too is the magnitude of dynamic forces experienced by various components of the projectile launcher during operation. These heightened dynamic forces impose design constraints on the projectile launcher that can limit the maximum force with which the projectile is launched or speed of the launched projectile that is achievable for a projectile launcher while maintaining particular dimensions of the projectile launcher or accuracy characteristics of the projectile launcher, among other requirements. Accordingly, there exists a need for a projectile launcher that experiences reduced dynamic forces during operation such that the projectile launcher can achieve increased projectile speed and force without adversely affecting other performance characteristics such the accuracy or dimensions of the projectile launcher.

SUMMARY

One embodiment relates to a crossbow. The crossbow includes a first plate including a slot, a second plate including a slot, the second plate coupled to the first plate and extending substantially parallel to the first plate, the second plate spaced apart from the first plate, an upper flexible limb coupled with the first plate, a lower flexible limb coupled with the second plate, a draw string operatively engaged with the upper flexible limb and the lower flexible limb, the draw string configured to move from a released position to a drawn position, and a trigger box slidably coupled with the first plate the second plate and engaged with the slot of the first plate and the slot of the second plate, the trigger box configured to selectively engage with the draw string to move the draw string between the released position the drawn position.

Another embodiment relates to a crossbow. The crossbow includes a first plate including a slot, a second plate including a slot, the second plate coupled to the first plate and extending substantially parallel to the first plate, the second plate spaced apart from the first plate to define an opening, an upper flexible limb coupled with the first plate, a lower flexible limb coupled with the second plate, a draw string operatively engaged with the upper flexible limb and the lower flexible limb, the draw string configured to move from a released position to a drawn position within the opening, and a trigger box slidably coupled with the first plate and the second plate and including a first protrusion configured to be received within the slot of the first plate and a second protrusion configured to be received within the slot of the second plate, the trigger box configured to selectively engage with the draw string to move the draw string between the released position the drawn position.

Still another embodiment relates to a crossbow. The crossbow includes a frame, a first plate including a slot, a second plate including a slot, the second plate coupled to the frame and the first plate and extending substantially parallel to the first plate, the second plate spaced apart from the first plate to define an opening an upper flexible limb coupled with the first plate, a lower flexible limb coupled with the second plate, a draw string operatively engaged with the upper flexible limb and the lower flexible limb, the draw string located within the opening and configured to move from a released position to a drawn position, a trigger box slidably coupled with the first plate the second plate within the slot of the first plate and the slot of the second plate, the trigger box configured to selectively engage with the draw string to move the draw string between the released position the drawn position, and a cocking mechanism coupled with the trigger box and configured to cause the trigger box to move the draw string between the released position and the drawn position, the cocking mechanism coupled with the first plate.

DETAILED DESCRIPTION

Figure 1A:
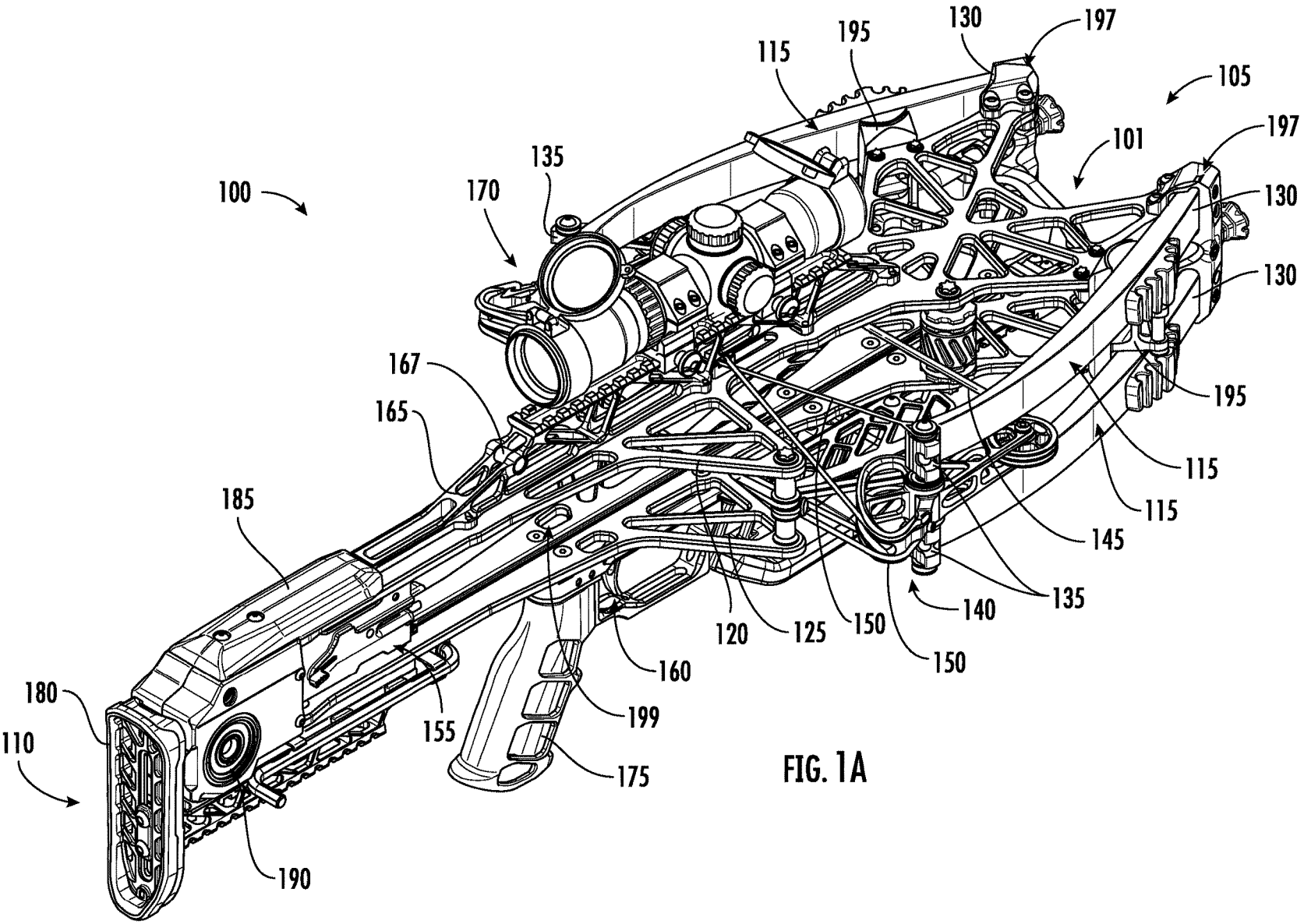
FIG. 1A is a top, right, rear perspective view of a projectile launcher in a released position, according to some embodiments.
Figure 1B:
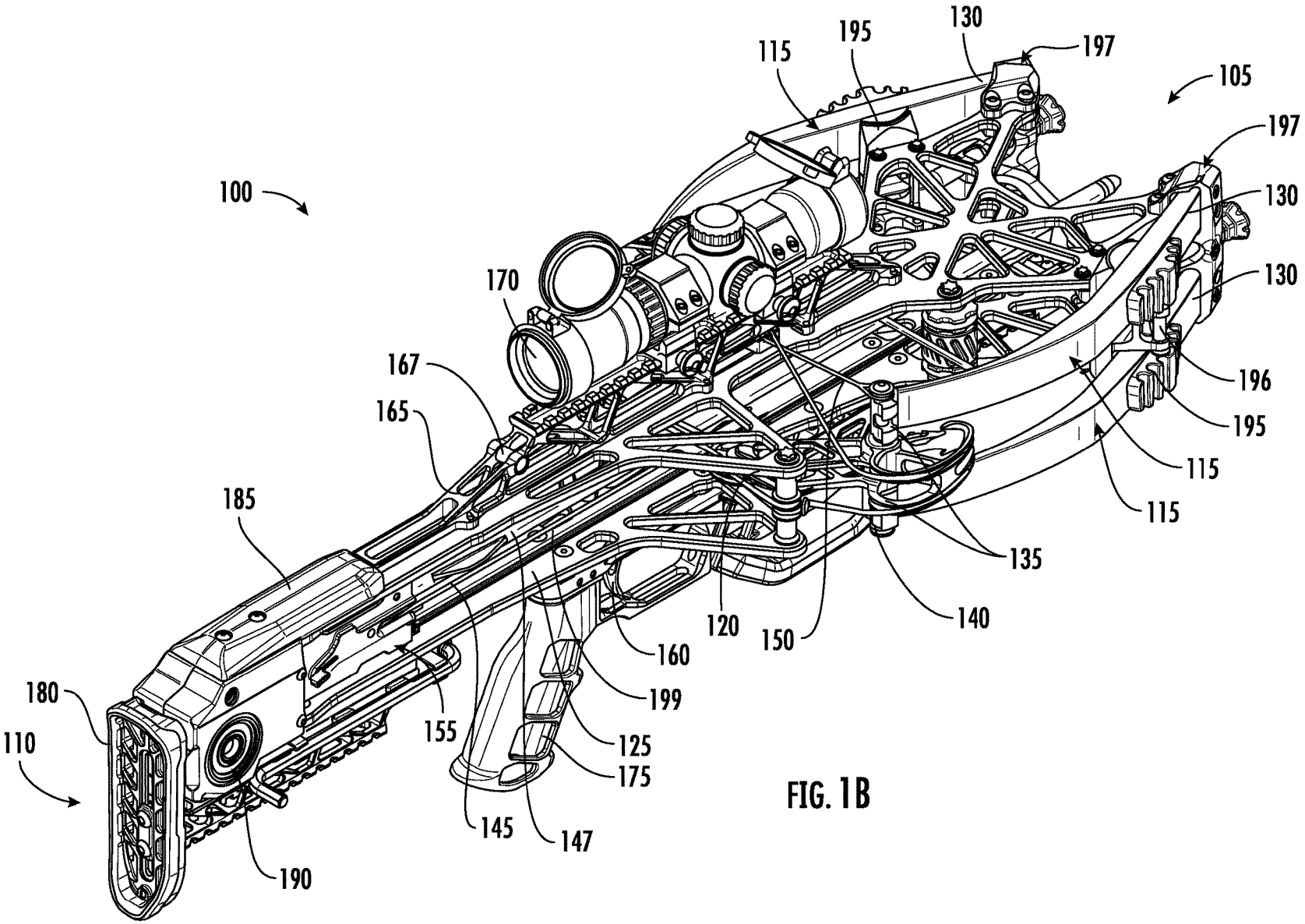
FIG. 1B is a top, right, rear perspective view of the projectile launcher of FIG. 1A in a drawn position.
Figure 2:
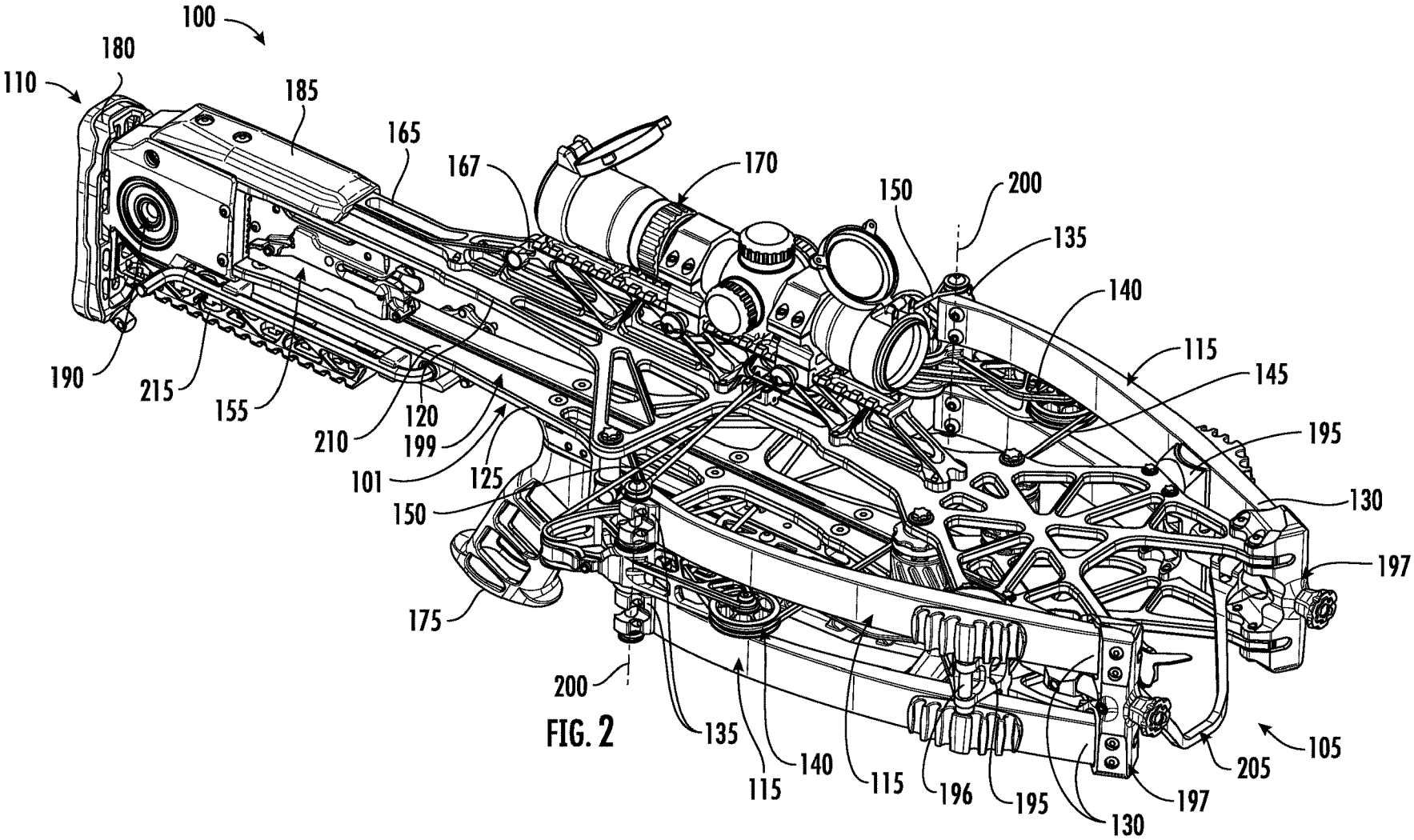
FIG. 2 is a top, right, front perspective view of the projectile launcher of FIG. 1A.

Following below are more detailed descriptions of various concepts related to, and implementations of, methods, apparatuses, and systems for a projectile launcher. Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring to the figures generally, the various embodiments disclosed herein relate to systems, apparatuses, and methods for a projectile launcher. The projectile launcher can be crossbow, a bow, or some other type of stringed projectile launcher. The projectile launcher includes a draw string engaged with a first pulley assembly (e.g., a right pulley assembly, a first cam assembly, a first lever assembly) and a second pulley assembly (e.g., a left pulley assembly, a second cam assembly, a second lever assembly). The projectile launcher further includes at least one power cable engaged with at least one of the pulley assemblies. In some embodiments, the projectile launcher can include one power cable engaged with the first pulley assembly and one power cable engaged with the second pulley assembly. In other embodiments, the projectile launcher can include two power cables engaged with the first pulley assembly and two power cables engaged with the second pulley assembly, for example. The first pulley assembly and second pulley assembly are coupled to flexible limbs of the projectile launcher. In particular, the first pulley assembly is rotatably mounted (e.g., rotatably coupled, rotatably secured) to a distal end portion (e.g., a free end portion) of a first upper and a first lower flexible limb and can be configured to rotate about a first pulley assembly axis relative to the first upper and first lower flexible limbs. The second pulley assembly is rotatably mounted (e.g., rotatably coupled, rotatably secured) to a distal end portion (e.g., a free end portion) of a second upper and a second lower flexible limb and can be configured to rotate about a second pulley assembly axis relative to the second upper and second lower flexible limbs. In other embodiments, the first pulley assembly or the second pulley assembly can be mounted to some other portion of the crossbow, such as a stationary location (e.g., a top plate or bottom plate of the crossbow as discussed below). The first and second pulley assemblies each include a pulley. The pulley is coupled to a lever arm. The lever arm is coupled to a power cable journal. The pulley of each pulley assembly is configured to rotate about a pulley axis that is parallel with and spaced apart from the respective lever arm axis. The lever arm of the pulley assembly is configured to rotate about the lever arm axis. Because each pulley is rotatably coupled to a respective lever arm, each pulley moves rotates about the respective lever arm axis as the lever rotates about the lever arm axis, which occurs during operation of the projectile launcher as the draw string moves between a released position to a drawn position. As the lever arm rotates about the lever arm axis, the pulley also rotates about the pulley axis.

The limbs are coupled to a plate. In particular, an upper limb is coupled to a top plate and a lower limb is coupled to a bottom plate of the projectile launcher. The top plate defines a first plane and the bottom plate defines a substantially parallel second plane. The draw string is configured to move from the released position to the drawn position (and vice versa) within an opening between the top plate and the bottom plate to fire a projectile from the projectile launcher. The top plate and the bottom plate are coupled together via multiple columns (e.g., rods, blocks, linkages, or other generally slender members). For example, the top plate and the bottom plate can have corresponding mounting locations to which a column can be coupled to couple the top plate and the bottom plate together. At least one of the columns (e.g., two columns, two fasteners) is surrounded by a cushion (e.g., a rubberized cushion) that contacts the draw string when the draw string is in the released position. The top plate and the bottom plate are further coupled together via a first limb bezel and a second limb bezel. The first limb bezel includes pockets to receive a proximal end (e.g., a fixed end) of the first upper and lower limbs to couple the first upper and lower limbs to the top plate and bottom plate. The first upper and lower limbs are positioned within the bezel and relative to the top plate and bottom plate such that as the limbs are flexed (e.g., as the draw string moves from the released position to the drawn position), the first upper and lower limbs respectively act on (e.g., apply a force to) the top plate and the bottom plate within a first plane and the second plane.

The draw string includes two looped ends that are each coupled to one of the posts that couple the top plate with the bottom plate. The draw string can be routed from a first post, through an opening in the lever arm of the first pulley assembly, to a draw string groove (e.g., draw string journal) of the pulley of the first pulley assembly, to the draw string groove of the pulley of the second pulley assembly, through the lever arm of the second pulley assembly, and to a second post. Each pulley can include two draw string grooves (e.g., stacked or substantially parallel journals). The two looped ends of the draw string include a looped end length that is sufficiently large such that each of the two draw string grooves receives (e.g., engages with) a portion of the looped end of the draw string such that two portions of the draw string (e.g., two strands) are engaged with each of the two draw string grooves of each pulley.

The projectile launcher includes a projectile rest assembly. The projectile rest assembly includes a rest that supports a projectile (e.g., an arrow, a bolt, or some other projectile) that, drops away from the projectile when the projectile launcher is fired. The drop-away projectile rest assembly allows for frictionless exit of the projectile from the projectile launcher. The drop-away projectile rest is biased in an upright position (e.g., a position in which the projectile rests upon the projectile rest via magnets, a spring, or some other biasing mechanism). The projectile rest is coupled with a power cable guide of the projectile launcher such that when the projectile launcher is fired, the projectile rest drops away from the projectile (e.g., pivots downwards away from the projectile) to allow the projectile to be launched substantially without contacting the projectile rest. In some embodiments, the projectile rest can be operatively coupled to the trigger via a cord that is routed through a channel (e.g., a passageway, a groove) of a rail of the projectile launcher.

The projectile launcher includes a trigger box (e.g., a string carrier) that selectively engages with and releases the draw string. In particular, the trigger box can engage the draw string to move (e.g., pull, draw) the draw string from the released position to the drawn position. The trigger box can disengage (e.g., release) the draw string to allow the draw string to move from the drawn position to the released position. The trigger box is slidably engaged with the top plate and the bottom plate. Specifically, the trigger box includes a projection or a slot and is positioned in the opening between the top plate and the bottom plate. The projection or slot of the trigger box is engaged with a corresponding slot or projection of both the top plate and the bottom plate, and the engagement between the trigger box and the top and bottom plate guides the trigger box between a forward position and a rearward position. The trigger box is engaged with a cocking mechanism. The cocking mechanism includes a spool configured to rotate in a first direction to wind a tether and rotate in a second direction to unwind the tether. The tether is connected to a rear end of the trigger box such that, during operation of the projectile launcher as the spool winds in the first direction, the tether pulls the trigger box rearward (e.g., toward the rearward position). The cocking mechanism includes a tensioner and a cord. The spool is configured to rotate in the first direction to unwind the cord from the spool and to rotate in the second direction to wind the cord onto the spool. The cord is routed through a channel in the rail of the projectile launcher and coupled with a front end of the trigger box such that, during operation of the projectile launcher as the spool winds in the second direction, the cord pulls the trigger box forward (e.g., toward the forward position).

The projectile launcher includes a cocking mechanism that is configured to move the trigger box—and the draw string that is engaged by the trigger box—from a forward position (e.g., a position of the trigger box in which the draw string is in the released position) to a rearward position (e.g., a position of the trigger box in which the draw string is in the drawn position). The cocking mechanism is coupled to the trigger box via tether. A rotation of a spool of the cocking mechanism in a first direction winds the tether about the spool to move the trigger box to the rearward position. The cocking mechanism is configured to move the trigger box from the rearward position to the forward position to decock the crossbow. The cocking mechanism includes a drum brake that is configured to expand from an initial position to an expanded position in response to user input. The drum brake is coupled to a one-way bearing. When the drum brake is in the initial position, an outer surface of the one-way bearing is engaged with (e.g., in contact with or radially compressed by) an inner surface of the drum brake. When the drum brake is in the expanded position, the one-way bearing is permitted to rotate relative to the drum brake (e.g., the outer surface of the one-way bearing can move relative to the inner surface of the drum brake) t, thereby allowing the trigger box to travel from the rearward position to the drawn position. The cocking mechanism can include a cord coupled the trigger box and the spool, where a rotation of the spool in a second direction causes the cord to pull the trigger box from the drawn position to the released position. The cocking mechanism can be coupled with the top plate and bottom plate of the crossbow such that the cocking mechanism and the limbs of the crossbow are coupled with the same integral members (e.g., the top plate and the bottom plate).

Referring now to FIGS. 1A-4B, a projectile launcher 100 is shown. The projectile launcher 100 is shown as a crossbow 100, but can be another projectile launcher (e.g., a compound bow or some other projectile launcher configured to launch an arrow, a bolt, a BB, a pellet, or some other projectile). Although the below description refers to the crossbow 100 specifically, it is understood that the concepts disclosed herein may be equally applicable or partially applicable to another projectile launcher. Accordingly, application of the concepts disclosed herein to other projectile launchers is contemplated by the following discussion.

Figure 3:
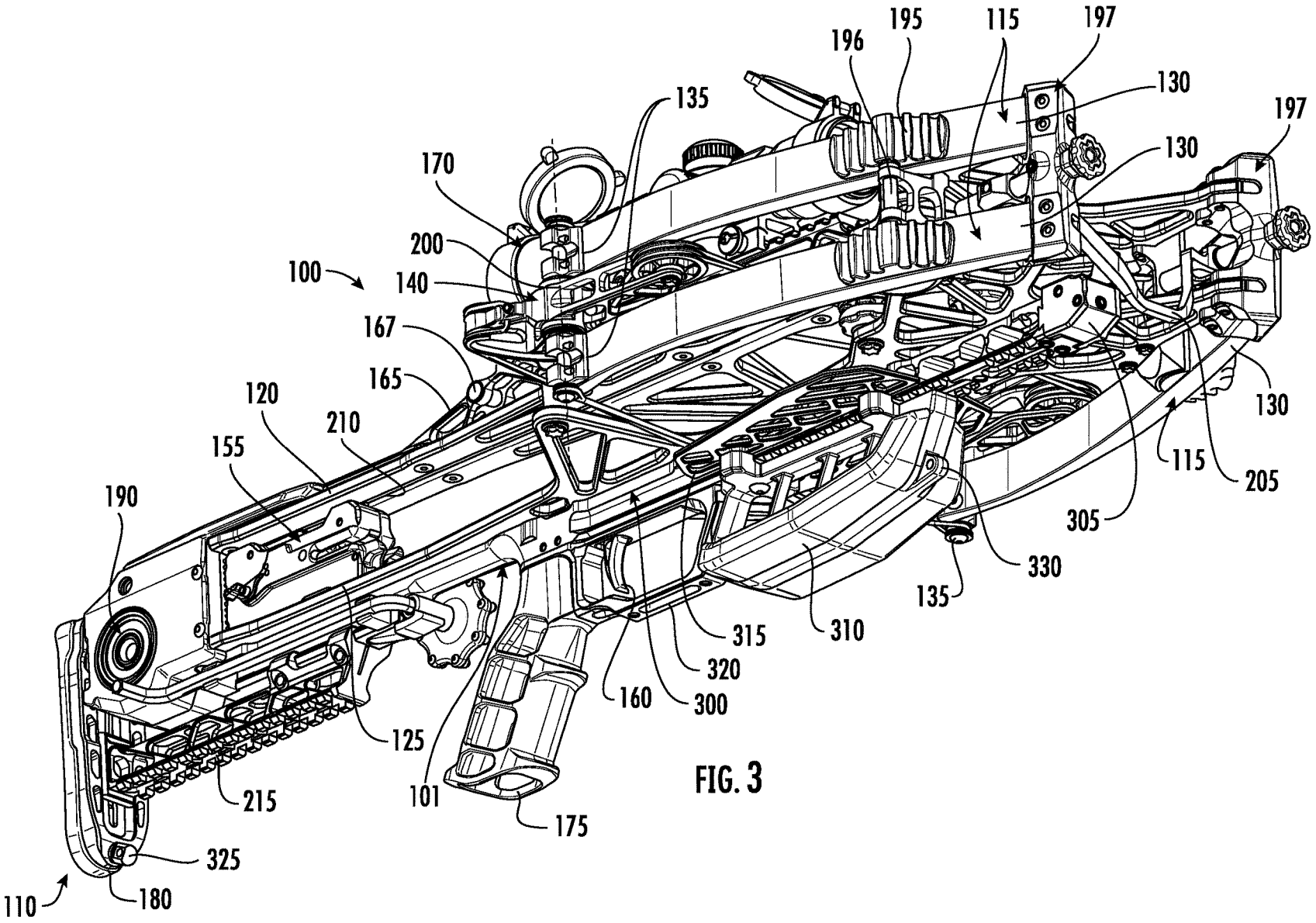
FIG. 3 is a bottom, right, front perspective view of the projectile launcher of FIG. 1A.
Figure 4A:
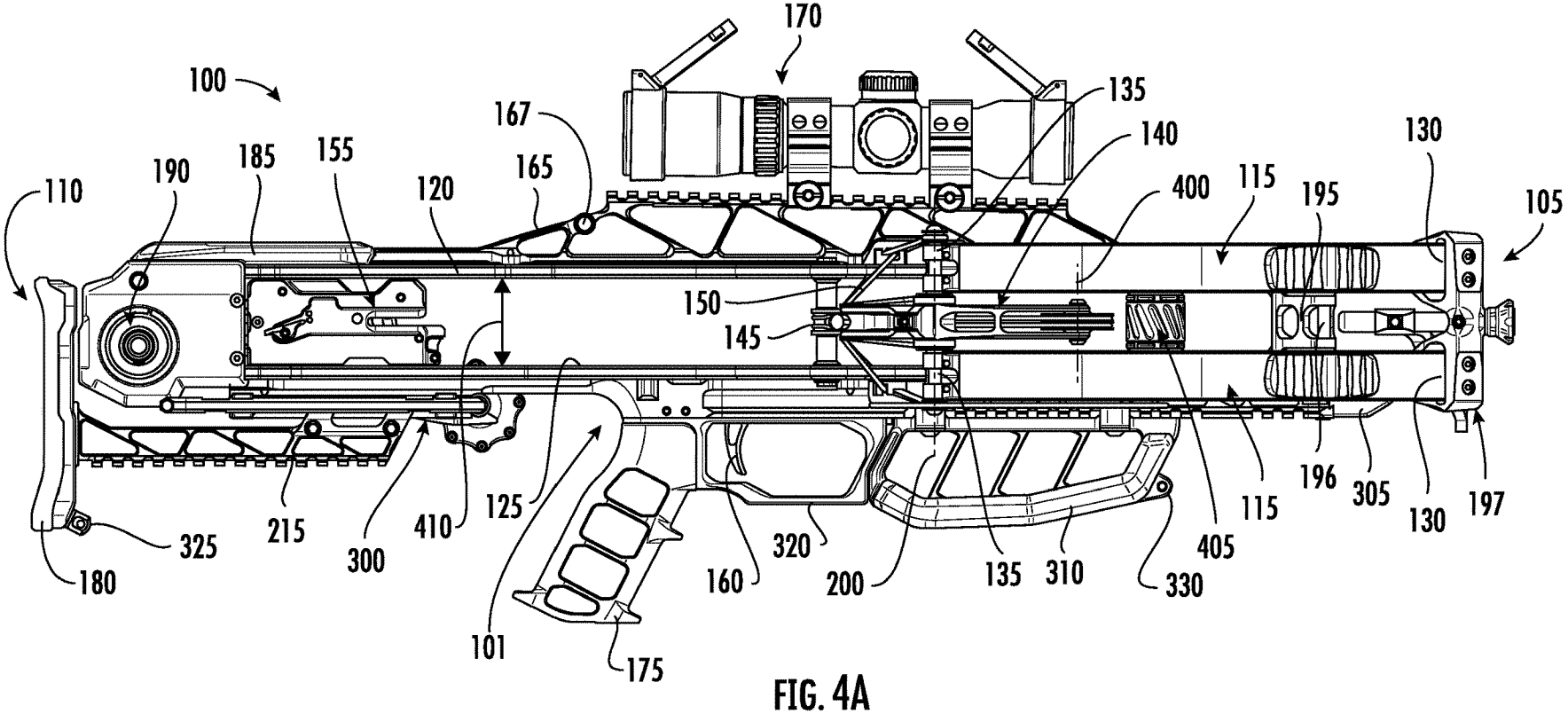
FIG. 4A is a right side view of the projectile launcher of FIG. 1A in the released position.
Figure 4B:
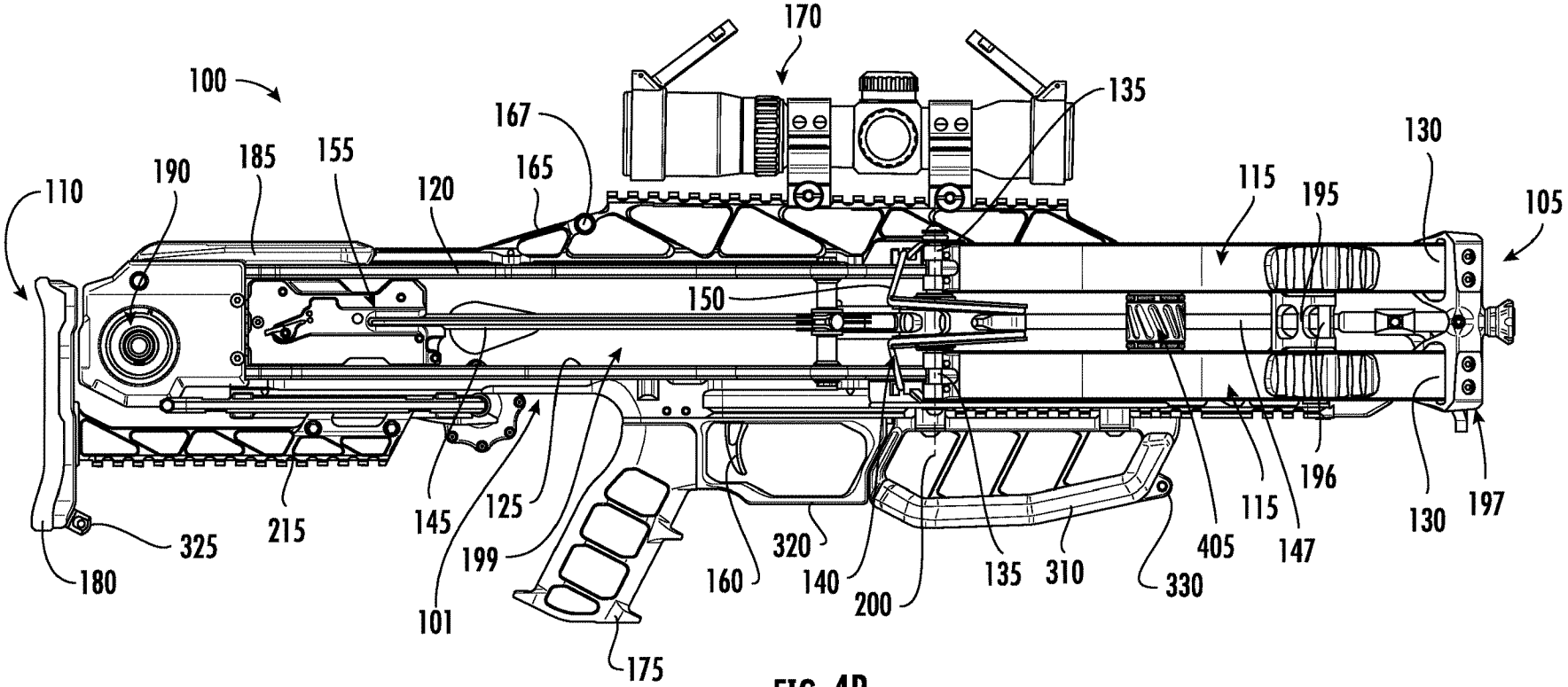
FIG. 4B is a right side view of the projectile launcher of FIG. 1A in the drawn position.
Figure 5A:
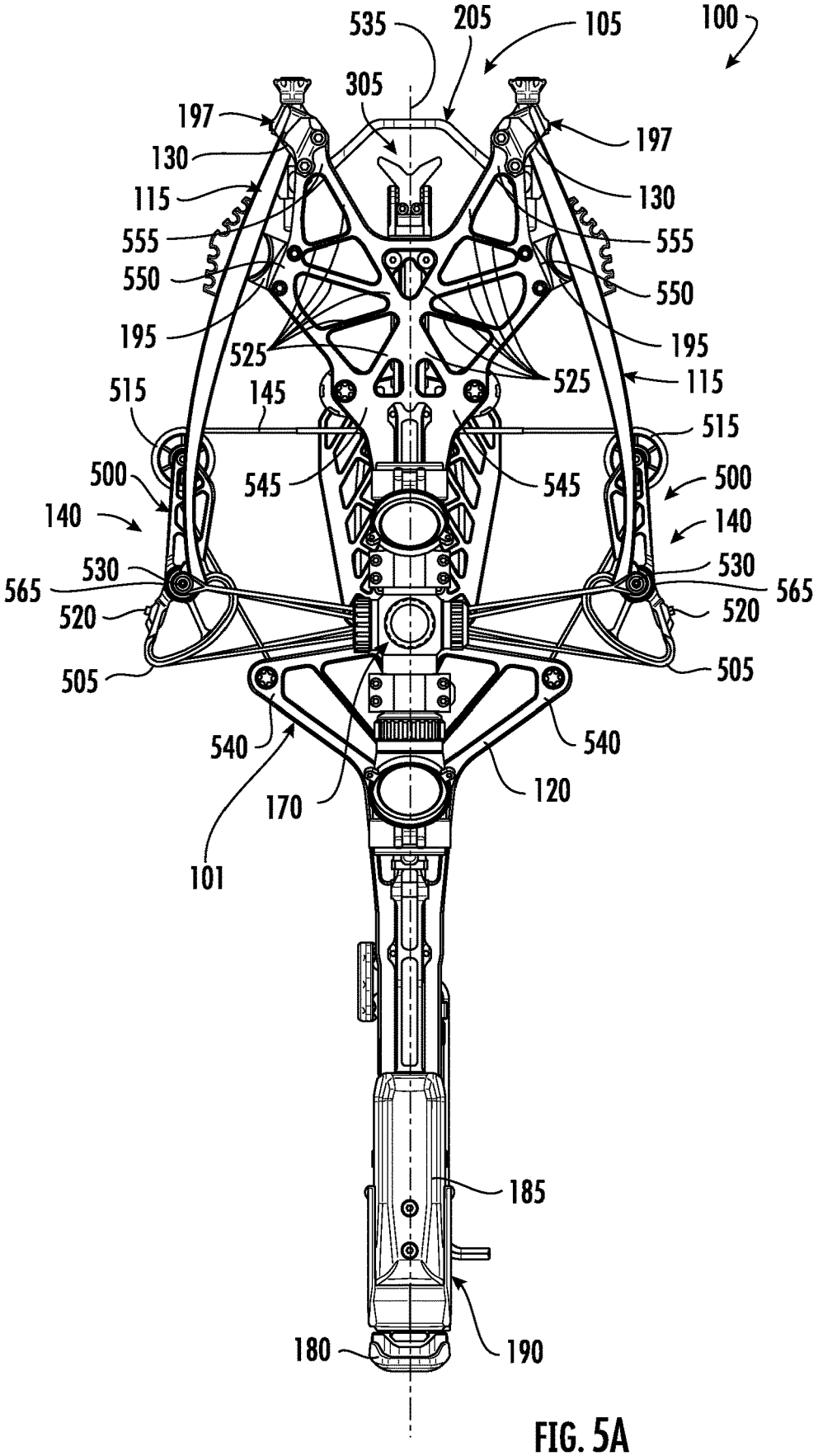
FIG. 5A is a top view of the projectile launcher of FIG. 1A in the released position.
Figure 5B:
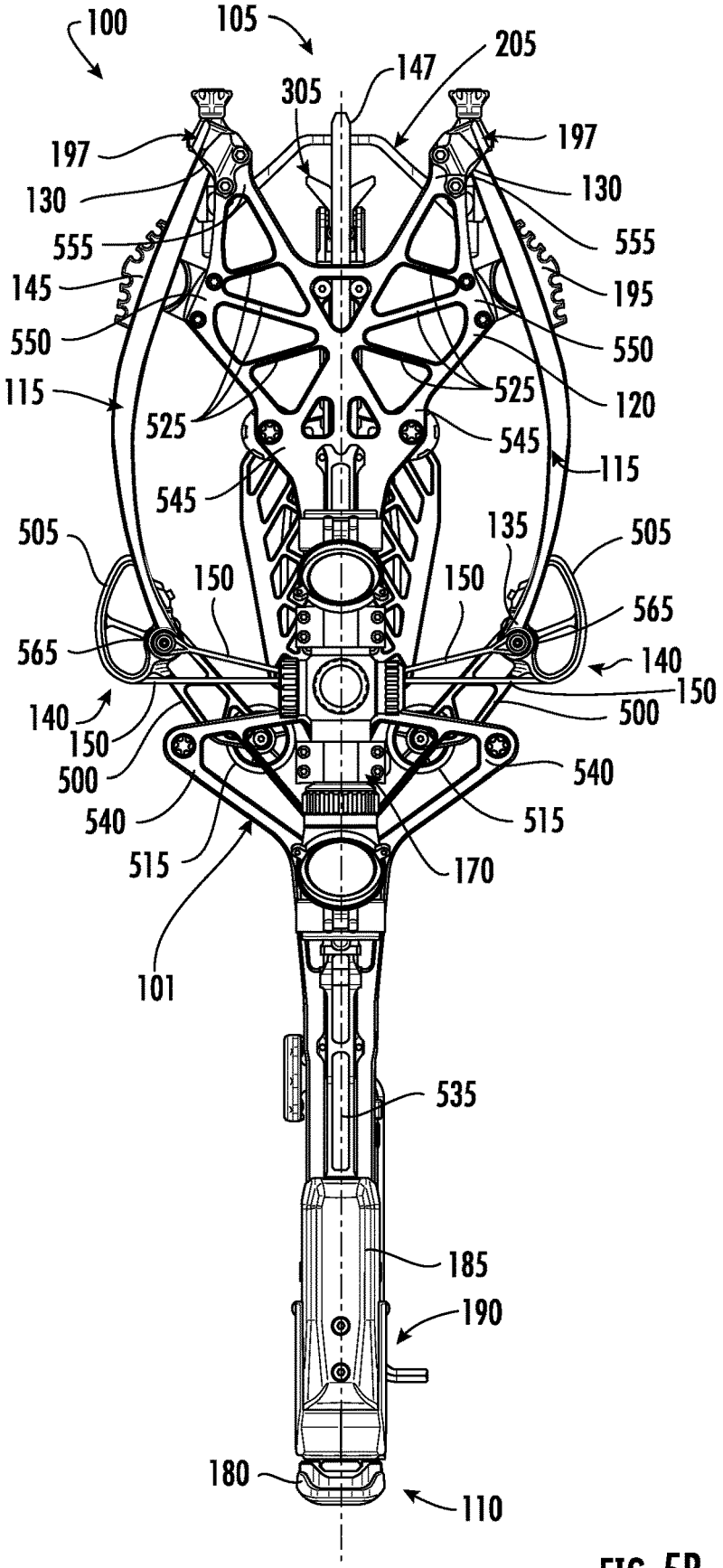
FIG. 5B is a top view of the projectile launcher of FIG. 1A in the drawn position.
Figure 6A:
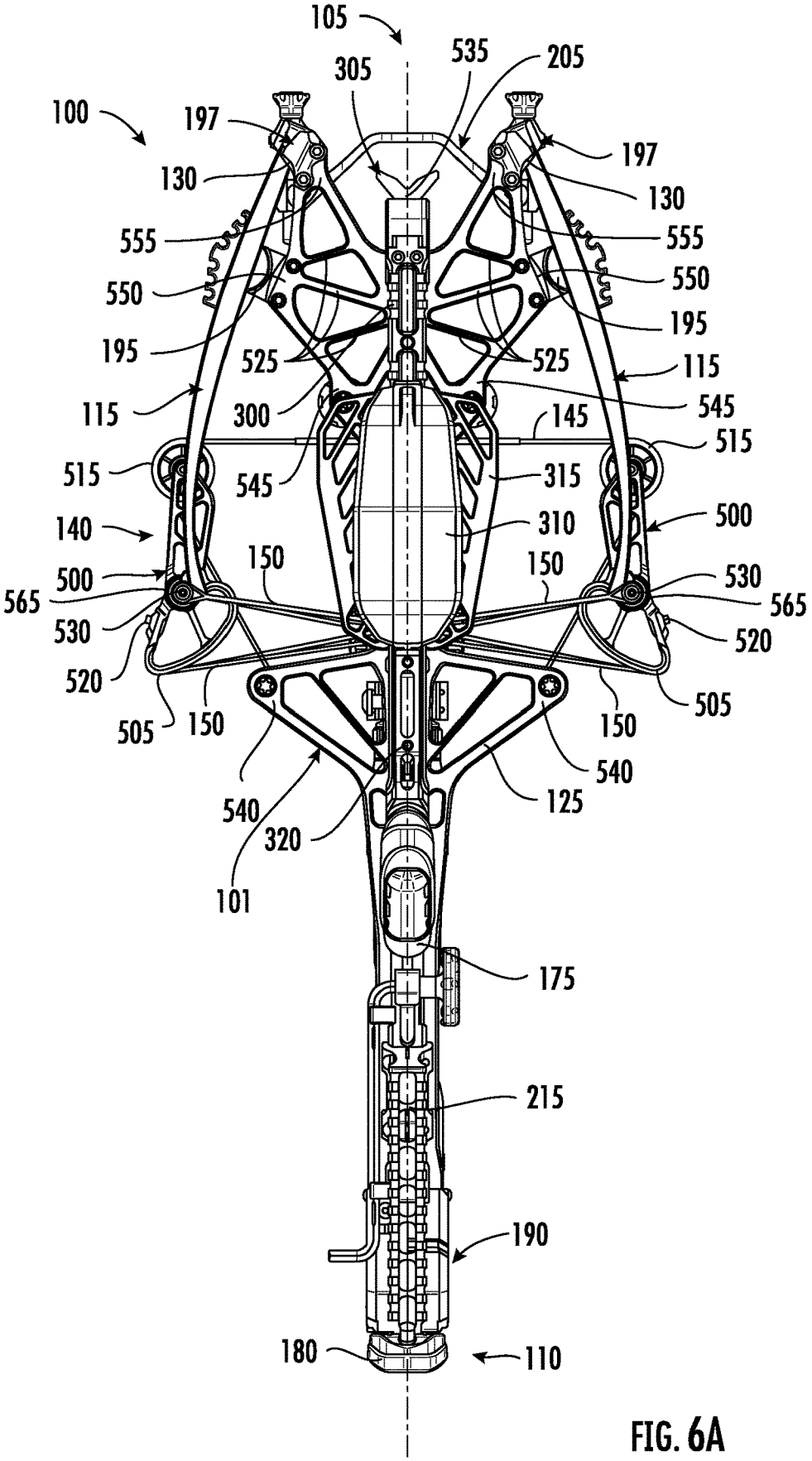
FIG. 6A is a bottom view of the projectile launcher of FIG. 1A in the released position.
Figure 6B:
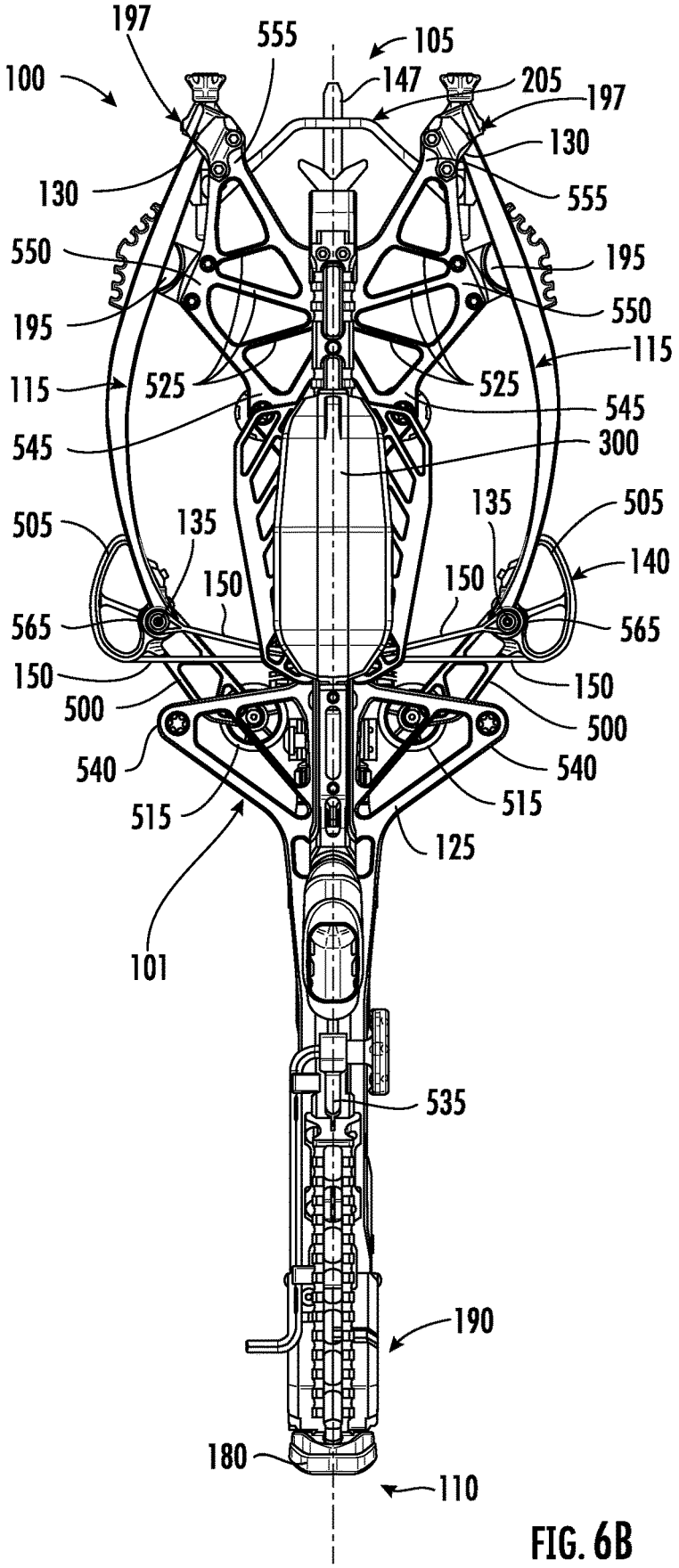
FIG. 6B is a bottom view of the projectile launcher of FIG. 1A in the drawn position.
Figure 42:
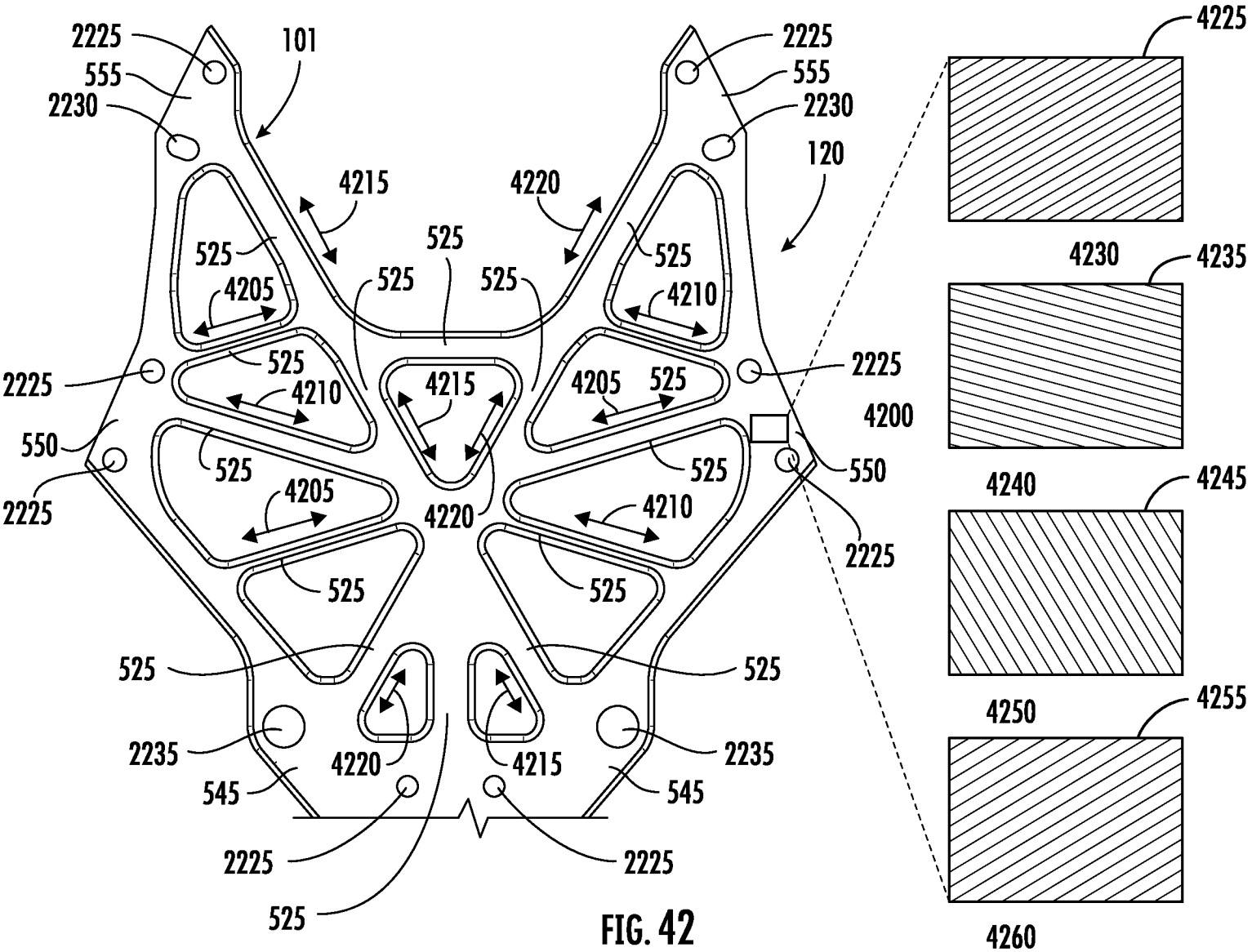
FIG. 42 is a detail view of the top plate of the projectile launcher of FIG. 1A.

The crossbow 100 includes a front end 105 (e.g., a down-range end) and a rear end (e.g., an up-range end). The crossbow 100 includes multiple limbs 115, atop plate 120 (e.g., atop frame 120), and a bottom plate 125 (e.g., a bottom frame 125). The top plate 120 extends within a top plane, and the bottom plate 125 extends in a bottom plate that is substantially parallel (e.g., ±15° from parallel) with the top plane of the top plate 120. In some embodiments, the top plate 120 and bottom plate 125 are substantially mirror images of each other. The top plate 120 is spaced apart from the bottom plate 125 such that an opening 199 (e.g., a space, area) exists between the top plate 120 and the bottom plate 125. The top plate 120 and the bottom plate 125 are vertically spaced apart from each other by a distance 410. The bottom plate 125 is coupled to a rail 300, as depicted in FIGS. 3-4B, among others. The bottom plate 125 is coupled to the rail 300 via fasteners, an adhesive, or some other joining means. The rail 300 extends from the front end 105 to the rear end 110 of the crossbow 100. The top plate 120 and the bottom plate 125 each include a slot 210 extending between the front end 105 and the rear end 110 of the crossbow 100. The top plate 120 and the bottom plate 125 can be made from or include a composite material, such as fiber glass, carbon fiber, or some other material. For example, as depicted in FIG. 42 and discussed in detail below, the top plate 120 and/or the bottom plate 125 can be made from a composite material (e.g., carbon fiber) having elongated fibers. The top plate 120 and the bottom plate 125 can include structural members (e.g., trusses 525 as discussed below with reference to FIGS. 5A-6B and 42, among others) that are substantially aligned (e.g., substantially parallel) with the fibers of the composite material. A substantial alignment (e.g., ±30°) of the trusses 525 with the fibers of the composite material of the top plate 120 or the bottom plate 125 can bolster the structural rigidity of the top plate 120 or the bottom plate 125. In other examples, the top plate 120 and the bottom plate 125 include a metallic material (e.g., aluminum or steel), an organic material (e.g., wood) or some other material.

The crossbow 100 includes a trigger box 155 (e.g., a string carrier 155, a draw string catch assembly 155) operatively coupled to a trigger 160. The trigger box 155 is configured to engage with a draw string 145 to move the draw string 145 from a released position to a drawn position. For example, the trigger box 155 includes a catch to selectively secure the draw string 145. The trigger 160, when actuated by a user, causes the trigger box 155 to release the draw string 145 to allow the draw string 145 to move from the drawn position to the released position to launch a projectile 147 from the crossbow 100. The trigger box 155 pulls the draw string 145 from the released position to the drawn position via a cocking mechanism 190 positioned at or proximate to the rear end 110 of the crossbow 100. The crossbow 100 further includes a scope rail mount 165 and scope assembly 170 coupled to the scope rail mount 165. The scope rail mount 165 is coupled to the top plate 120 of the crossbow 100 via one or more fasteners, for example. The scope rail mount 165 includes a picatinny rail or some other rail or scope mounting feature to which the scope 170 is removably coupled. The scope rail mount 165 includes a level device 167. The level device 167 can be a cylindrical bubble level that is coupled with the scope rail mount 165. The level device 167 provides a visual indication to a user of the crossbow 100 as to a current position of the crossbow 100 relative to a horizontal direction, for example. The crossbow 100 includes a cheek rest 185 coupled to the top plate 120 and/or the scope rail mount 165.

Referring now to FIGS. 1A-3, among others, the crossbow includes a grip 175, a trigger guard 320, a foregrip 310, a finger guard 315, and a lower picatinny rail 215, each of which are coupled to the rail 300 of the crossbow. The grip 175 is positioned proximate the trigger 160 and is configured to be grasped by a first hand (e.g., a trigger hand) of a user. The foregrip 310 is positioned forward of the trigger 160 and is configured to be grasped by a second hand (e.g., a non-trigger hand) of a user. The foregrip 310 can include an accessory attachment feature 330. For example, the accessory attachment feature 330 can be a swivel stud (e.g., like the swivel stud 325), a hook, or some other feature to which an accessory (e.g., a shoulder strap, a carrying handle, or some other accessory) can be coupled to the crossbow 100. The finger guard 315 is positioned above the foregrip and extends horizontally (e.g., within a substantially horizontal plane) outward from the rail 300 to substantially prevent a user's fingers from contacting any moving components (e.g., the draw string 145) of the crossbow 100 during operation thereof. In some examples, the bottom plate 125 of the crossbow 100 also extends horizontally (e.g., within a substantially horizontal plane) outward from the rail 300 to further prevent a user's fingers from contacting any other component of the crossbow 100 during operation. The lower picatinny rail 215 is coupled to the rail 300 and extends outward toward the rear end 110 of the crossbow 100. The lower picatinny rail 215 is configured to couple to one or more accessories (e.g., a quiver). According to an exemplary embodiment, a butt stock 180 is couples to the lower picatinny rail 215. The butt stock 180 defines the rear end 110 of the crossbow 100 and is configured to support the crossbow 100 when grasped by a user during operation. The lower picatinny rail 215 is slidably coupled to the rail 300 such that the lower picatinny rail 215 and the butt stock 180 extending therefrom can extend rearward at a variable length to accommodate users of various sizes, for example. The lower picatinny rail 215 can support the butt stock 180 and one or more accessories coupled to the lower picatinny rail (e.g., a flashlight, a range finder, a quiver, or some other accessory). The butt stock 180 includes a swivel stud 325. The swivel stud 325 can extend from the butt stock 180 at an angle and can be configured to receive an accessory, such as a shoulder strap, carrying handle, or some other accessory. For example, the swivel stud 325 can include an opening, a hook, or some other feature to detachably receive a hasp, a clip, a hook, or some other feature of an accessory to detachably couple the accessory to the butt stock 180.

The top plate 120 and the bottom plate 125 are coupled together to form a frame 101 (e.g., cage 101, chassis 101) of the crossbow 100. As depicted in FIGS. 1A-10, 22A, and 22B, among others, the frame 101 includes the top plate 120 residing in a first plane and the bottom plate 125 residing in a parallel second plane. The bottom plate 125 is coupled with the rail 300. The top plate 120 and the bottom plate 125 are generally flat or horizontal members. In other examples some—but not all—of the top plate 120 or the bottom plate 125 can be flat or horizontal, while another portion or portions can be curved, angled or otherwise formed. The top plate 120 is spaced apart from the bottom plate 125 such that an opening 199 (e.g., an intervening space, region, or area) exists between the top plate 120 and the bottom plate 125. The top plate 120 and the bottom plate 125 can be substantially identical in shape and dimension, according to some embodiments. The top plate 120 and the bottom plate 125 can be substantially symmetrical about a centerline (e.g., a projectile axis, such as the projectile axis 535 shown in FIGS. 5A and 5B, among others) such that a first side (e.g., a right side) and a second side (e.g., a left side) of each of the top plate 120 and the bottom plate 125 are substantially identical.

The top plate 120 and the bottom plate 125 include multiple mounting locations, as is depicted in FIGS. 5A-6B, 8-10, 22A, and 22B, among others. The multiple mounting locations of the top plate 120 and the bottom plate 125 are integrally formed with the respective top plate 120 and the bottom plate 125. For example, the top plate 120 and the bottom plate 125 can each include the multiple mounting locations formed as a parts of an integral structure rather than being parts of an assembled structure (e.g., a structure made by joining together different plate sections). According to an exemplary embodiment, the top plate 120 and the bottom plate 125 can each be integral structures manufactured from carbon fiber, aluminum (e.g., machined, cast, extruded, etc.), or some other material that can provide for the integral formation of a substantial entirety of the top plate 120 or the bottom plate 125. In other embodiments, the top plate 120 or the bottom plate 125 can be created by joining multiple plate sections together by some integral joining method (e.g., welding, laminating, molding, or some other method) such that after joining the multiple plate sections together, the resultant structure is substantially an integral structure that cannot be disassembled without destroying or damaging the plate. In yet other embodiments, the top plate 120 or the bottom plate 125 are formed by removably coupling multiple plate sections together, where the resultant plate can be disassembled without destroying or damaging the plate.

The top plate 120 and the bottom plate 125 include a first mounting location 540 (e.g., first mounting region 540) positioned each side (e.g., on both a right side and a left side). In some embodiments, the first mounting location 540 is a wing or projection extending outwardly (e.g., horizontally) relative to the projectile axis 535. As depicted in FIGS. 5A-6B and 8-10, among others, the first mounting location 540 of the top plate 120 and the first mounting location 540 of the bottom plate 125 are coupled together via a column 800. The first mounting location 540 can include an opening 2240 (e.g., an aperture, a through-hole, a passageway). The column 800 extends vertically from the top plate 120 to the bottom plate 125. In some embodiments the column 800 extends through the opening 2240 in the first mounting location 540. In other embodiments, the column 800 engages with a fastener that extends through the opening 2240 in the first mounting location 540. The opening 2240 can be a circular opening, a star-shaped opening, or an opening with some other shape or profile that is configured to substantially match a shape or profile of the column 800. For example, according to the exemplary embodiment shown in FIGS. 22A and 22B, the opening 2240 can be a star-shaped opening 2240 that is configured to receive a column 800 having a star-shaped cross-sectional shape. The engagement between the star-shaped opening 2240 and the star-shaped column 800 can be configured to prevent the column 800 from rotating within the opening 2240 during operation of the crossbow 100, for example. The crossbow 100 includes two columns 800, one on either side of the crossbow 100, as is discussed in detail below.

As depicted in FIGS. 5A-6B, 22A, 22B, and 42, the top plate 120 and the bottom plate 125 include multiple trusses 525 (e.g., spokes 525) that define corresponding openings through the top plate 120 and the bottom plate 125, respectively. For example, the top plate 120 and the bottom plate 125 can each include trusses 525 that are disposed between various regions, locations, areas, or points of the top plate 120 and the bottom plate 125 to provide structural rigidity of the top plate 120 and the bottom plate 125 as compressive forces, tensile forces, or other forces are imposed on the top plate 120 and the bottom plate 125 during operation of the crossbow or otherwise. As is discussed in further detail below, the top plate 120 and the bottom plate 125 both experience loading forces during operation of the crossbow 100 that are in-plane with the top plate 120 and the bottom plate 125. Further, as discussed in detail below with reference to FIG. 42, the top plate 120 and the bottom plate 125 can include the trusses extending in a direction that is substantially parallel (e.g., ±30° from parallel) with fibers of a fibrous layer (e.g., sheet, ply, fabric) of the top plate 120 and bottom plate 125 in embodiments where the top plate 120 and bottom plate 125 are made at least partially of a composite material. The trusses 525 are positioned to optimize the structural rigidity of the top plate 120 and the bottom plate 125 based on loading forces ordinarily imposed on the top plate 120 and the bottom plate 125 during operation of the crossbow 100. For example, in some embodiments the trusses 525 are specifically positioned to support various components that direct or otherwise influence the forces caused by operation of the crossbow 100, including the limbs 115 and the attachment locations of the limbs 115, a location of the lever assembly 500, the draw string 145 and a particular attachment location of the draw string 145, or some other component. In addition, the top plate 120 and the bottom plate 125 can include a trussed structure such that openings are formed through the top plate 120 and the bottom plate 125 (as opposed to the top plate 120 and bottom plate 125 being continuous plate), which can reduce the weight of the top plate 120 and the bottom plate 125 to minimize the weight of the crossbow 100.

Figure 10:
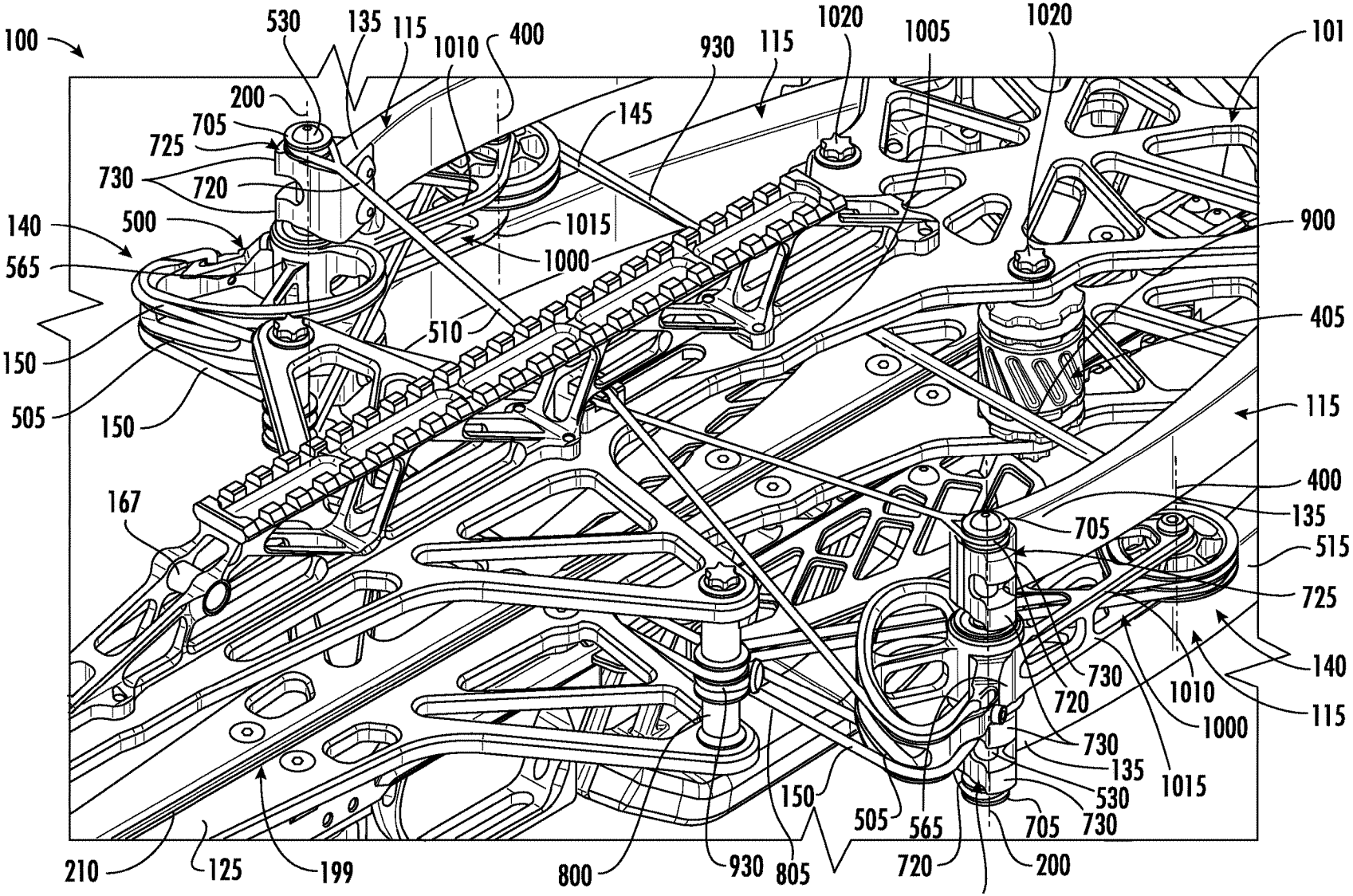
FIG. 10 is a partial top, right, rear perspective view of the projectile launcher of FIG. 1A in the released position.
Figure 22A:
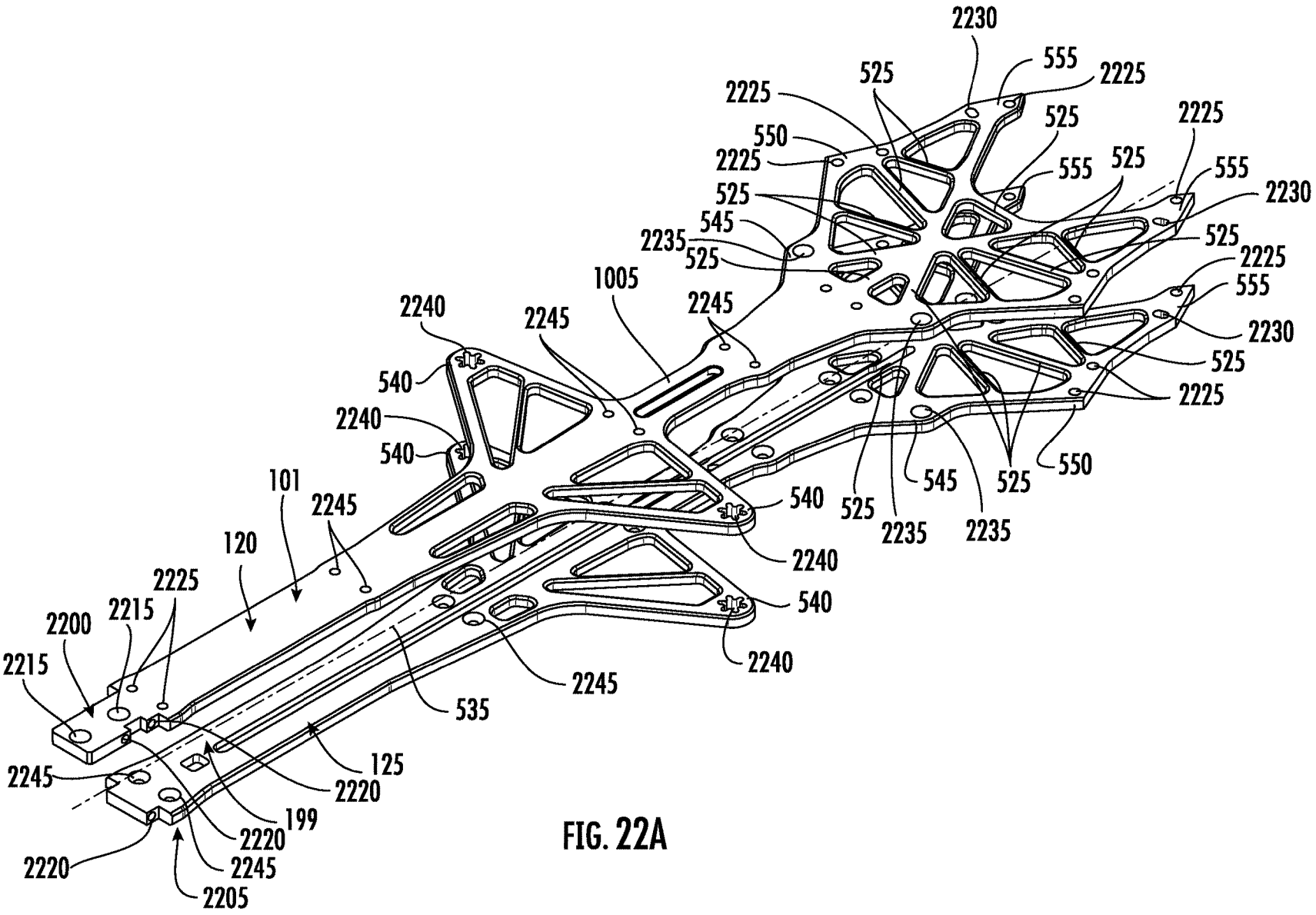
FIG. 22A is a top, right, rear perspective view of a top plate and a bottom plate of the projectile launcher of FIG. 1A.
Figure 22B:
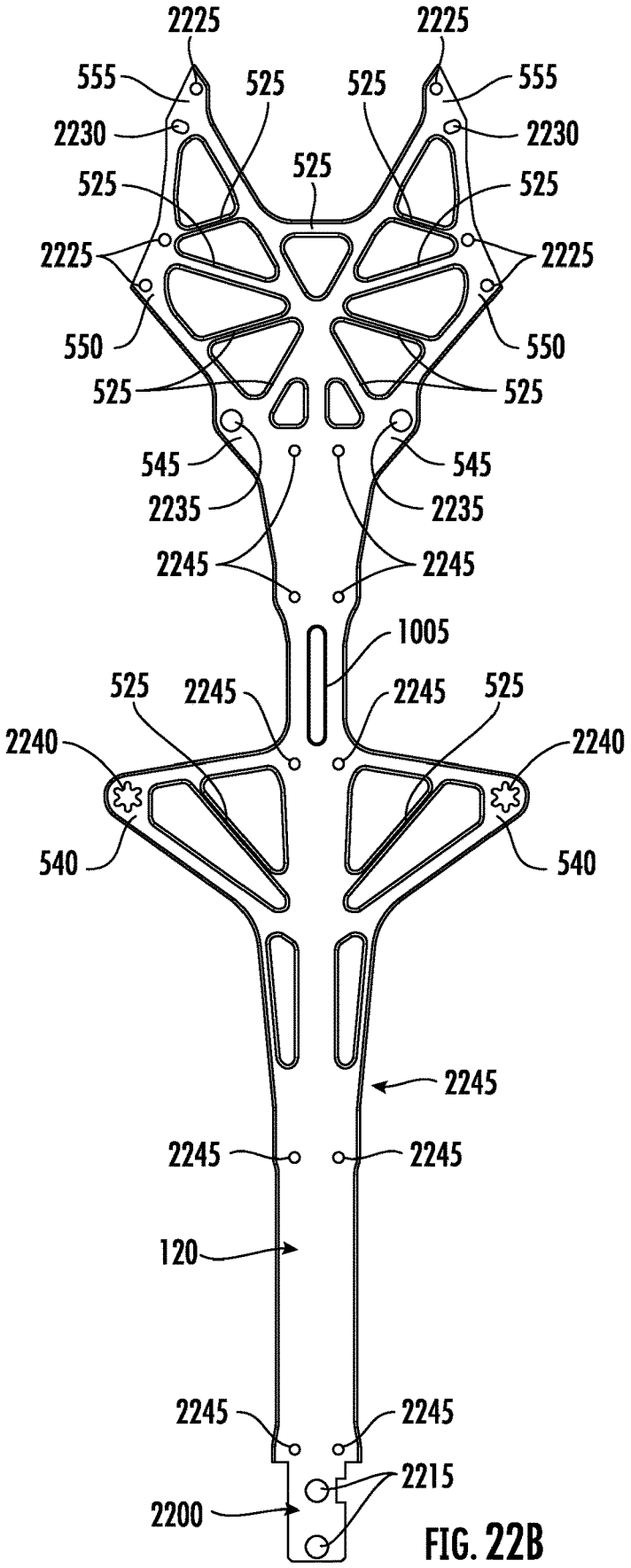
FIG. 22B is a top view of a top plate of the projectile launcher of FIG. 1A.

The top plate 120 and the bottom plate 125 include a second mounting location 545 (e.g., a second mounting region 545). The second mounting location 545 is positioned between the first mounting location 540 and the front end 105 of the crossbow 100, according to some embodiments. As depicted in FIG. 10, among others, the top plate 120 is coupled to the bottom plate 125 at the second mounting location 545 via a column 1020. The second mounting location 545 can include an opening 2235 (e.g., an aperture, a through-hole, a passageway), as depicted in FIGS. 22A and 22B, among others. The column 1020 extends vertically from the top plate 120 to the bottom plate 125. For example, the column 1020 can be an elongate member, such as a rod, a shaft, a post, or some other column-like member that can have a circular cross-section or some other cross-sectional shape or shapes. In some embodiments, the column 1020 is substantially linear, but in other embodiments the column 1020 is curved or otherwise non-linear. In some embodiments the column 1020 extends through the opening 2235 in the second mounting location 545. In other embodiments, the column 1020 engages with a fastener that extends through the opening 2235 in the second mounting location 545. The crossbow 100 includes two columns 1020, one on either side of the crossbow 100, and around which a string stop 405 can be positioned, as is discussed in detail below with reference to FIGS. 4A, 4B, and 31.

The top plate 120 and the bottom plate 125 each include a third mounting location 550 (e.g., a third mounting region 550). The third mounting location 550 is positioned between the second mounting location 545 and the front end 105 of the crossbow 100, according to some embodiments. As depicted in FIGS. 1A-3, 5A-6B, 22A, and 22B, the top plate 120 and the bottom plate 125 are coupled together via a mid-limb support 195. The mid-limb support 195 is a bracket that is coupled with the top plate 120, the bottom plate 125, and the limbs 115, as is discussed in further detail below. The third mounting location 550 of the top plate 120 and the bottom plate 125 are coupled with the mid-limb support 195. For example, the mid-limb support 195 defines a slot or opening within which a portion of the third mounting location 550 of the top plate 120 and the bottom plate 125 are received. In other examples, the mid-limb support 195 can include a ledge, arm, or other projection upon which the top plate 120 or the bottom plate 125 can rest. The top plate 120 and the bottom plate 125 are coupled with the mid-limb support 195 via a fastener 2305 that can extend from the mid-limb support 195 and through an opening 2225 of the top plate 120 and the bottom plate 125. In other examples, the mid-limb support 195 is alternatively or additionally coupled with the top plate 120 and the bottom plate 125 via an adhesive or some other coupling means.

The top plate 120 and the bottom plate 125 each include a fourth mounting location 555 (e.g., a fourth mounting region 555). The fourth mounting location 555 is positioned at or proximate to (e.g., within six inches of, within three inches of) the front end 105 of the crossbow 100. In some embodiments, the fourth mounting location 555 is positioned between the third mounting location 550 and the front end 105 of the crossbow 100. The top plate 120 and the bottom plate 125 are coupled together at the fourth mounting location 555. In some embodiments, the top plate 120 and the bottom plate 125 are coupled together at the fourth mounting location 555 via a limb bezel 197. The limb bezel 197 is coupled with the top plate 120, the bottom plate 125, and the limbs 115, as is discussed below. For example, the limb bezel 197 couples the top plate 120 to the bottom plate 125 such that the opening 199 and the distance 410 are maintained between the top plate 120 and the bottom plate 125 at the fourth mounting location 555. The fourth mounting location 555 defines an opening 2225 and a slot 2230. Each of the opening 2225 and the slot 2230 can receive a fastener of the limb bezel 197 to couple the limb bezel 197 with the respective top plate 120 or bottom plate 125. The slot 2230 can extend for some length along the top plate 120 or the bottom plate 125 to allow the limb bezel 197 to pivot about the opening 2225 during assembly of the crossbow 100, for example.

The top plate 120 includes a rear mounting location (e.g., a rear mounting region 2200) and the bottom plate 125 includes a rear mounting location 2205 (e.g., a rear mounting region 2205). The rear mounting location 2200 of the top plate 120 can be the same or different than the rear mounting location 2205 of the bottom plate 125. According to some embodiments, the rear mounting location 2200 of the top plate 120 extends further in a rearward direction (e.g., towards the rear end 110) than the rear mounting location 2205 of the bottom plate 125. The cocking mechanism 190 of the crossbow 100 is coupled to the rear mounting location 2200 of the top plate 120. The rear mounting location 2200 of the top plate 120 defines an opening 2215 that is configured to receive a fastener to couple the top plate 120 with the cocking mechanism 190. In some examples, a fastener couples the cheek rest 185 with the top plate 120 and the cocking mechanism 190 via the opening 2215 defined in the rear mounting location 2200 of the top plate 120. The rear mounting location 2200 of the top plate 120 further includes an opening 2220. The opening 2220 can be formed in a respective side of the top plate 120 and the bottom plate 125. Accordingly, the opening 2220 can be oriented perpendicular to the opening 2215 in some embodiments. For example, the opening 2215 can be a substantially vertical (e.g., ±30%) opening that can receive a fastener from above, while the opening 2220 can be a substantially horizontal (e.g., ±30%) opening that can receive a fastener from a left or right side. The crossbow 100 can include a fastener received in the opening 2220 of the top plate 120 to couple the top plate 120 with the cocking mechanism 190. The rear mounting location 2205 of the bottom plate 125 can be coupled with the cocking mechanism 190. Like the top plate 120, the bottom plate 125 includes an opening 2220 formed in a side of the bottom plate 125. The crossbow 100 can include a fastener received in the opening 2220 of the bottom plate 125 to couple the bottom plate 125 with the cocking mechanism 190. In addition, the rear mounting location 2205 of the bottom plate 125 can be coupled with the rail 300, which can be further coupled with the cocking mechanism 190.

Because the top plate 120 includes the rear mounting location 2200 that is coupled with the cocking mechanism 190 and the fourth mounting location 555 that is coupled with the limb bezel 197, the top plate 120 spans a substantial majority (e.g., 80% or more) of the length of the crossbow 100 (e.g., a length from the front end 105 to the rear end 110). As noted above, the top plate 120 includes the various mounting locations in a substantially integral structure. Accordingly, the cocking mechanism 190 of the crossbow 100 is coupled with the same structure (i.e., the top plate 120) as the limbs 115. Because the bottom plate 125 includes the rear mounting location 2205 that is coupled with the cocking mechanism 190 and the fourth mounting location 555 that is coupled with the limb bezel 197, the bottom plate 125 also spans a substantial majority (e.g., 80% or more) of the length of the crossbow 100. As noted above, the bottom plate 125 includes the various mounting locations in a substantially integral structure. Accordingly, the cocking mechanism 190 of the crossbow 100 is coupled with the same structure (i.e., the bottom plate 125) as the limbs 115. In this way, the top plate 120 and the bottom plate 125 cooperatively form the frame 101 (e.g., a cage 101 or chassis 101) for the crossbow 100 that spans a substantial majority (e.g., 80% or more) of the length of the crossbow 100.

The top plate 120 and the bottom plate 125 can further include additional openings 2245. The scope rail mount 165, the rail 300, or some other component of the crossbow 100 can couple with the top plate 120 or the bottom plate 125 via the openings 2245. For example, the scope rail mount 165 can be coupled with the top plate 120 via fasteners that are inserted at least partially into the openings 2245. The rail 300 can be coupled with the bottom plate 125 via fasteners that are inserted at least partially into the openings 2245. The openings 2245 can be generally cylindrical openings, conical openings, counter-bored openings, for example.

The top plate 120 and the bottom plate 125 are coupled together at each of the mounting locations such that the top plate 120 and the bottom plate 125 reside in or extend along substantially parallel planes. For example, the crossbow 100 includes the top plate 120 and the bottom plate 125 coupled together at multiple of the first mounting location 540, the second mounting location 545, the third mounting location 550, and the fourth mounting location 555. According to an exemplary embodiment, the top plate 120 is coupled with the bottom plate 125 at each of the first mounting location 540, the second mounting location 545, the third mounting location 550, and the fourth mounting location 555. Furthermore, the top plate 120 is coupled with the bottom plate 125 at two of the first mounting locations 540, two second mounting locations 545, two third mounting locations 550, and two fourth mounting locations 555, including one of the aforementioned mounting locations positioned to one side (e.g., the right side) of the projectile axis 535 and the other of the aforementioned mounting locations positioned to the other side (e.g., the left side) of the projectile axis 535. At each of the mounting locations, the top plate 120 and the bottom plate 125 are coupled together such that the opening 199 and the distance 410 are maintained along substantially an entire length of the top plate 120 and the bottom plate 125.

Figure 23:
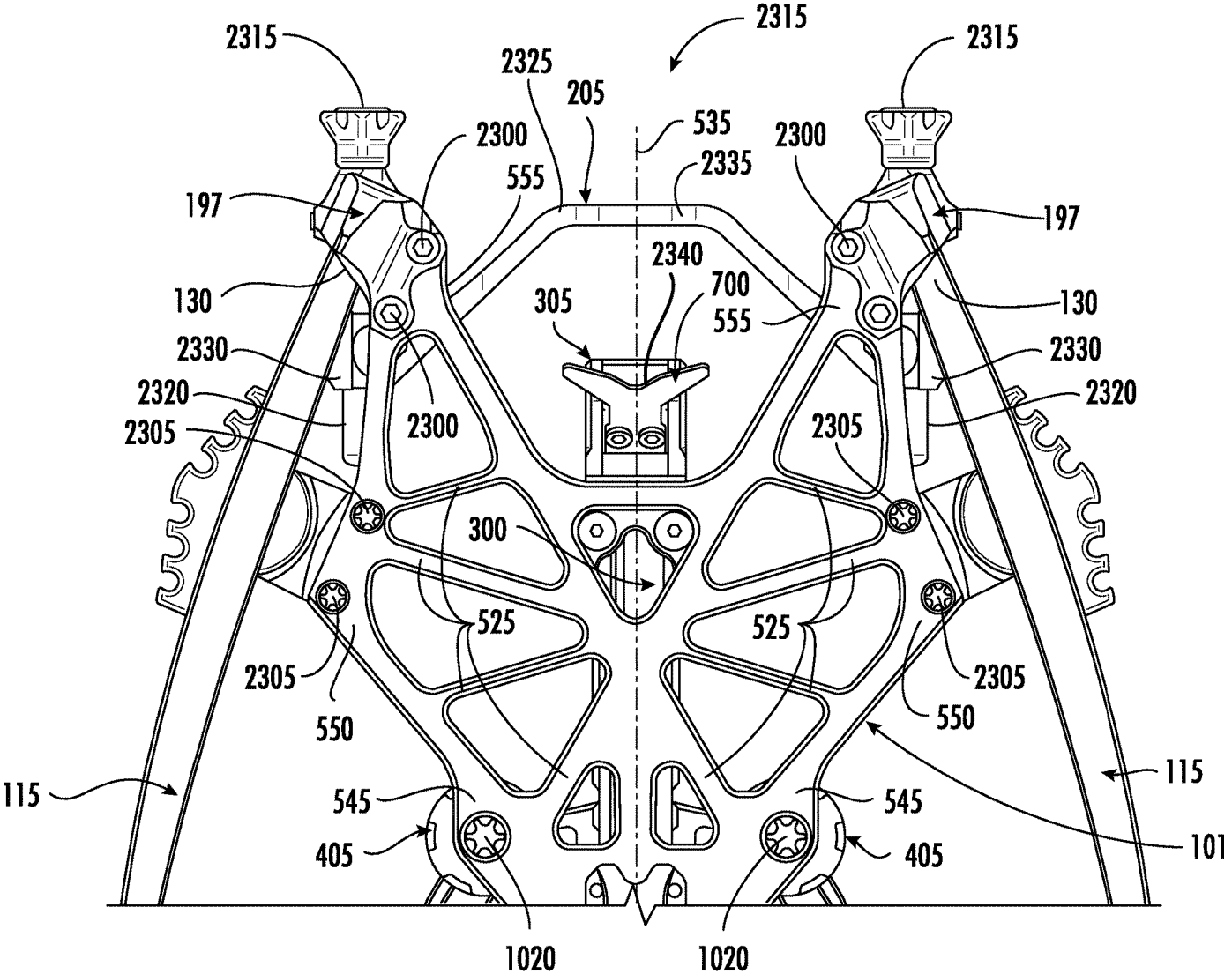
FIG. 23 is a partial top view of the projectile launcher of FIG. 1A.
Figure 24:
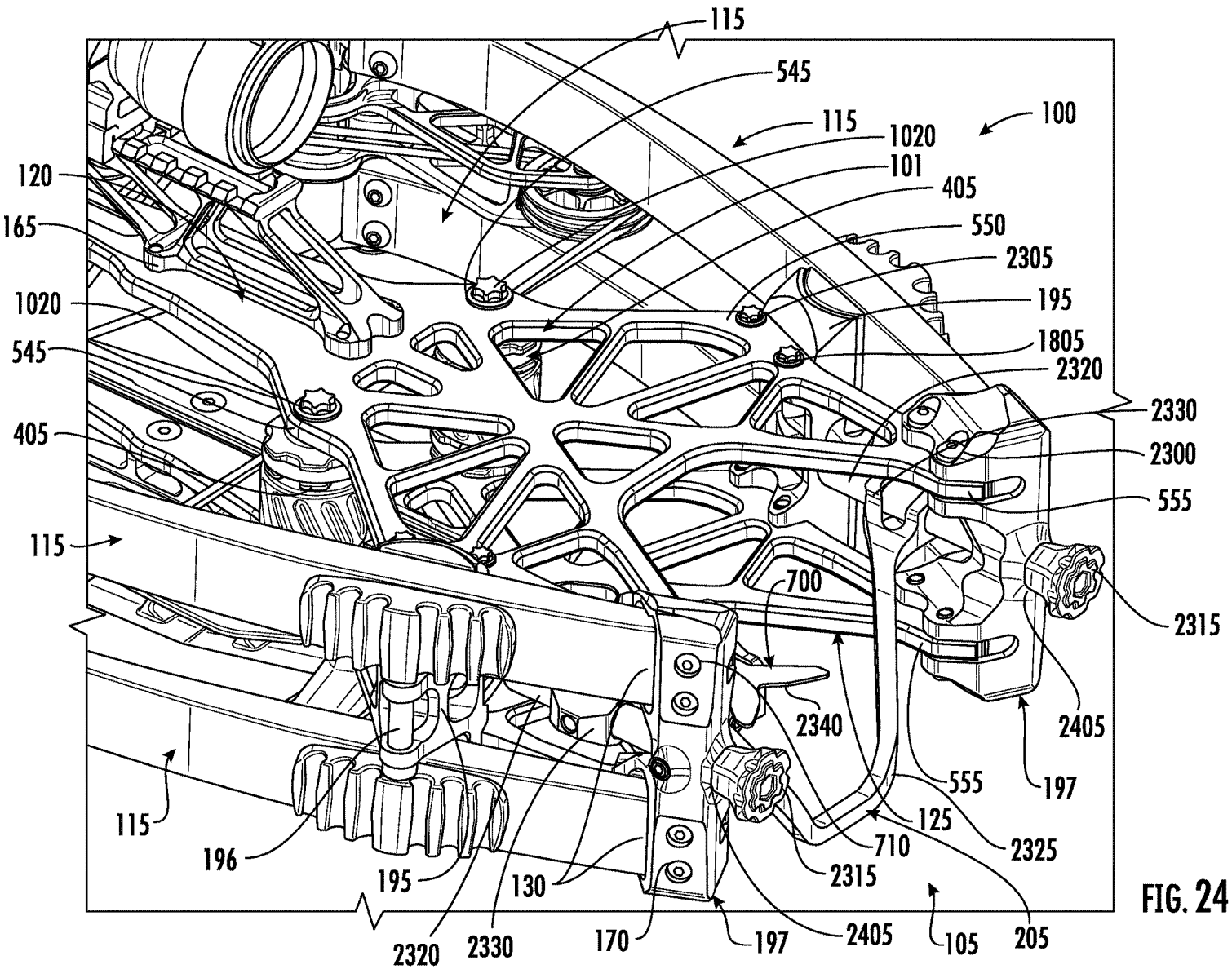
FIG. 24 is a partial top, right, front perspective view of the projectile launcher of FIG. 1A.
Figure 25:
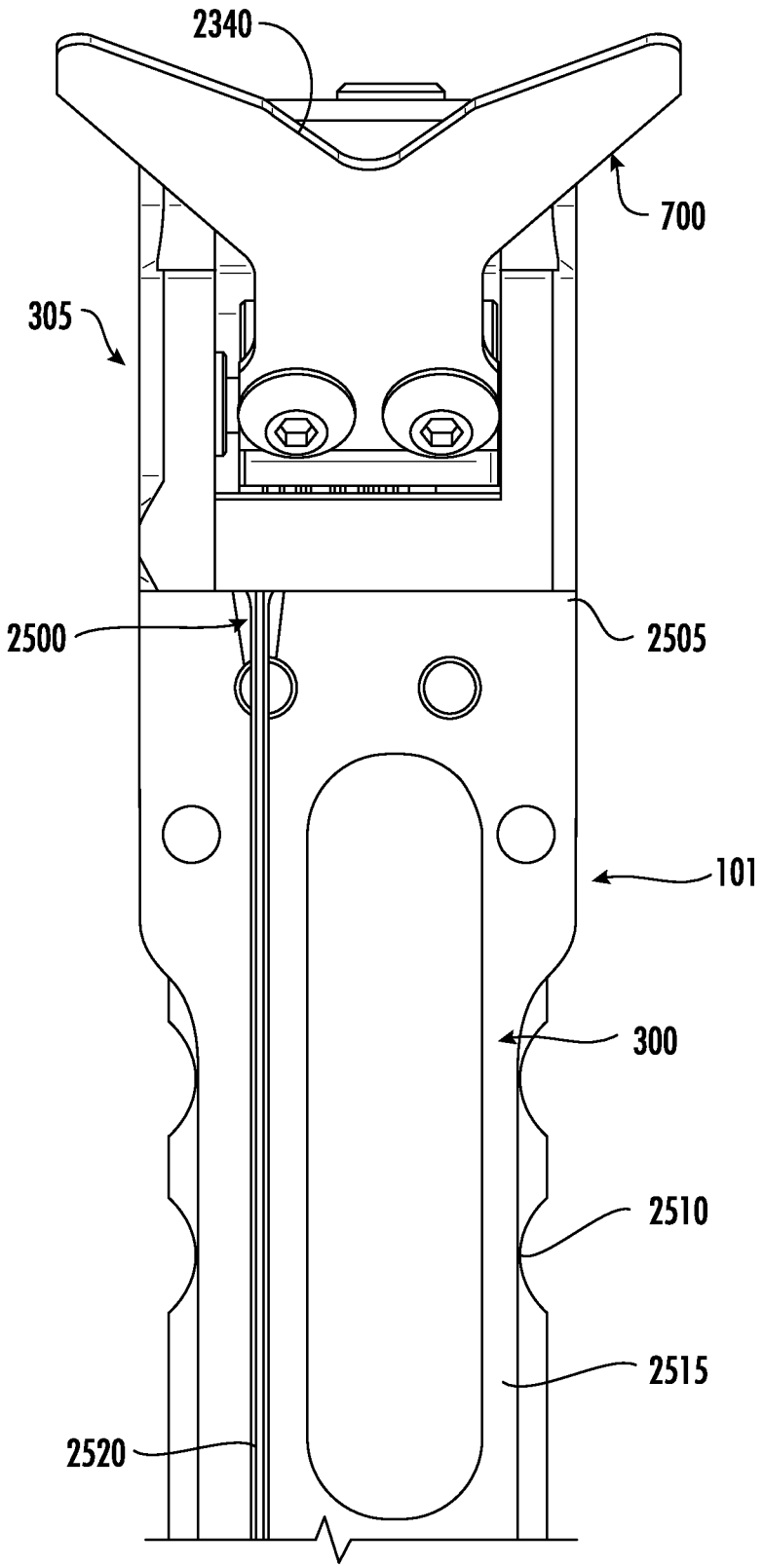
FIG. 25 is a top view of a rail and projectile rest assembly of the projectile launcher of FIG. 1A.
Figure 26:
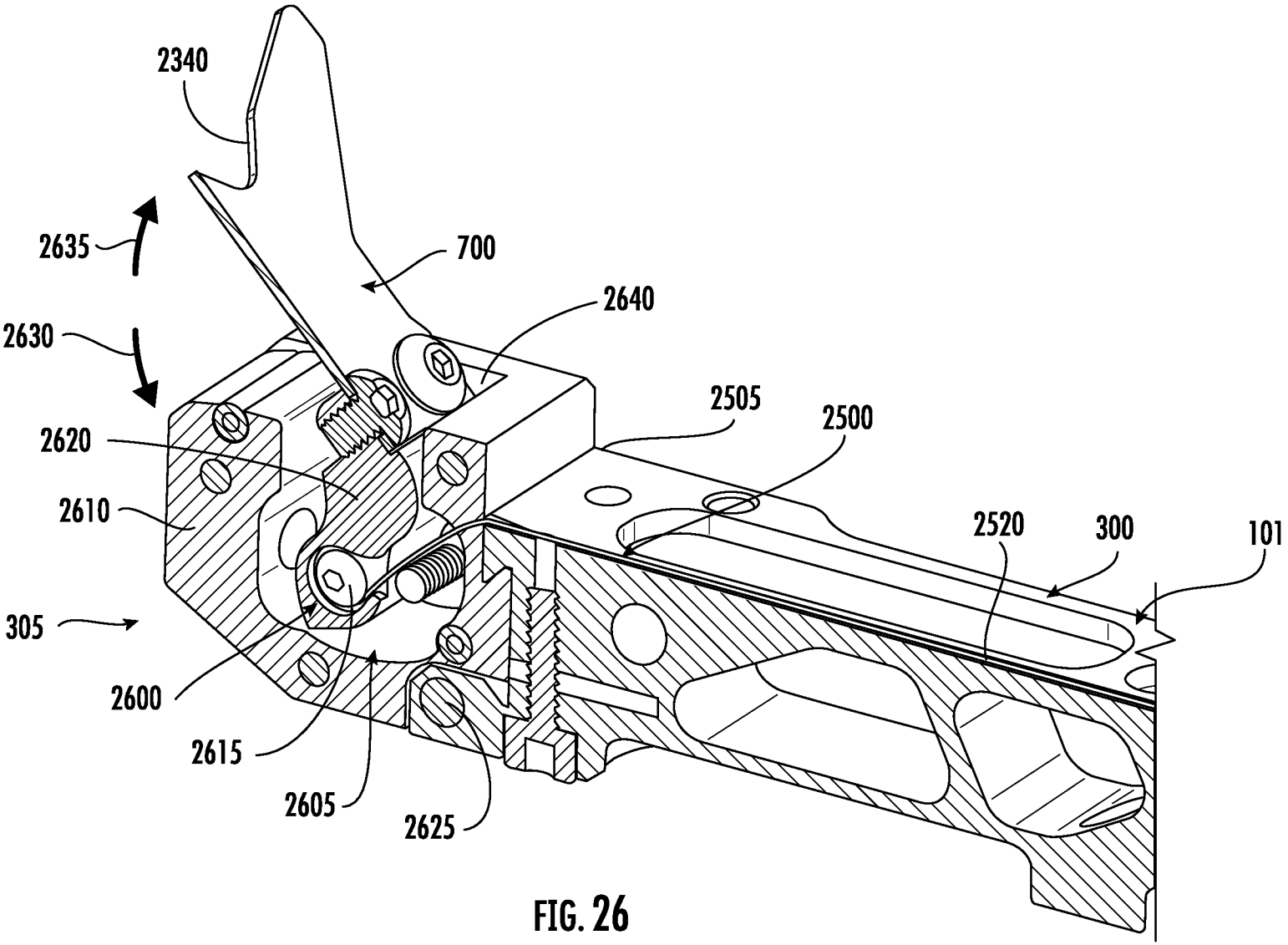
FIG. 26 is cross-section view of the rail and projectile rest assembly of FIG. 25.

As depicted in FIGS. 1A-7, 22A-24, 30 and 44, the crossbow 100 includes a limb bezel 197. The limb bezel 197 is coupled to the top plate 120 or the bottom plate 125 such that when the first end portion 130 of the limb 115 coupled to the limb bezel 197, as is discussed below, the first end portion 130 of the limb 115 is also coupled with the top plate 120 or the bottom plate 125, as the case may be. The limb bezel 197 includes a slot 715. A portion of the top plate 120 (e.g., a fourth mounting location 555, as shown in FIGS. 23 and 24, among others) or a portion of the bottom plate (e.g., the fourth mounting location 555, as shown in FIGS. 23 and 24, among others) is positioned within the slot 715 of the bezel 197. The fourth mounting location 555 of the top plate 120 or the fourth mounting location 555 of the bottom plate 125 are coupled with the limb bezel 197 via a fastener 2300 that is inserted through an opening (e.g., aperture, through-hole, passageway) through limb bezel 197 and through a corresponding opening (e.g., aperture, through-hole, passageway) formed in the fourth mounting location 555 of the top plate 120 or the bottom plate 125. In other embodiments, the fourth mounting location 555 is positioned within the slot 715 and coupled with the limb bezel 197 via an adhesive. According to some embodiments, the crossbow 100 includes two limb bezels 197 with each limb bezel 197 including two pockets 3000, as discussed below.

In some embodiments, the limb bezel 197 includes two slots 715, including a first slot 715 configured to receive the fourth mounting location 555 of the top plate 120 and a second slot 715 configured to receive the fourth mounting location 555 of the bottom plate 125. Both the fourth mounting location 555 of the top plate 120 and the fourth mounting location 555 of the bottom plate 125 are coupled to the limb bezel 197 via a fastener 2300, as discussed above. The first slot 715 can be spaced apart from the second slot 715 by the distance 410. The top plate 120 is coupled with the bottom plate 125 and spaced apart from the bottom plate 125 by the distance 410 via the limb bezel 197. The crossbow 100 includes two limb bezels 197, one coupled with a first side (e.g., a right side) of the top plate 120 and the bottom plate 125, and another coupled with a second side (e.g., a left side) of the top plate 120 and the bottom plate 125.

Figure 30:
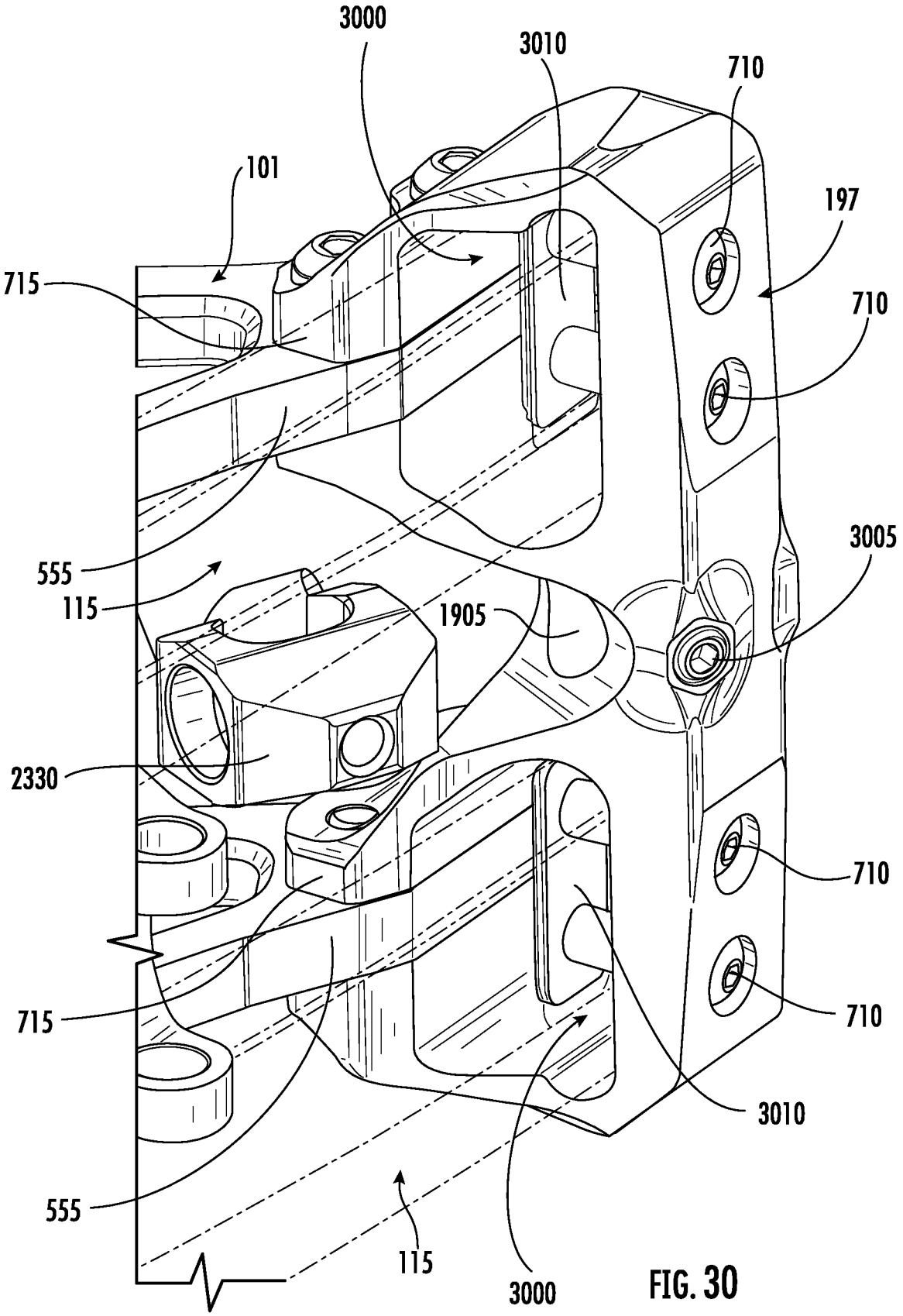
FIG. 30 is a top, right, rear perspective view of a limb bezel and limb of the projectile launcher of FIG. 1A.
Figure 44:
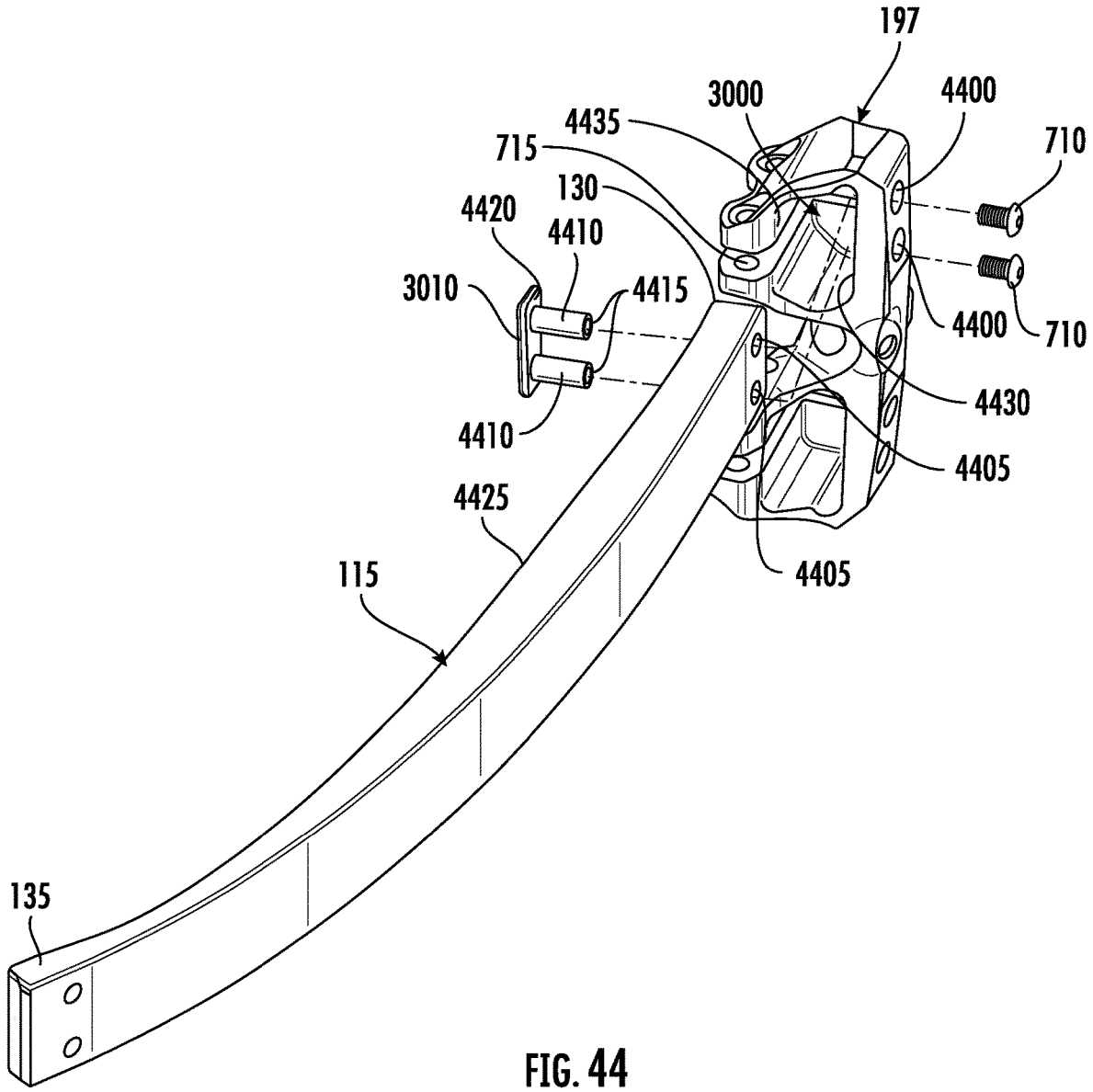
FIG. 44 is partial exploded view of the limb bezel, limb nut, and limb of the projectile launcher of FIG. 1A.

The limb bezel 197 further includes a pocket 3000, as depicted in FIGS. 30 and 44. The pocket 3000 is an opening, a recess, a cavity, an impression, or some other feature formed within the limb bezel 197 and having a form factor (e.g., shape and dimension) suited to receive a portion of a limb 115, as is discussed in detail below. In some embodiments, the pocket 3000 and the slot 715 are aligned. Specifically, the slot 715 and the pocket 3000 can have an elongated shape (e.g., generally rectangular or ovular) extending in a vertical direction, while the slot 715 can be oriented in a generally horizontal direction such that the pocket 3000 and the slot 715 are substantially perpendicular (e.g., ±15° from perpendicular). The slot 715 can intersect the pocket 3000 approximately at a midpoint (e.g., a position equidistant from a top and a bottom) of the pocket 3000.

As depicted in FIGS. 1A-8, among others, the crossbow 100 includes a limb 115 coupled with one of the top plate 120 or the bottom plate 125. In some embodiments, the crossbow 100 includes four limbs, two of which are coupled with the top plate 120 proximate (e.g., within one foot of) the front end 105 of the crossbow 100 and two of which are coupled with the bottom plate 125 proximate (e.g., within one foot of) the front end 105 of the crossbow. The crossbow 100 includes a first upper limb 115 coupled with the top plate 120 and a first lower limb 115 coupled with the bottom plate 125 on a first side of the crossbow 100 (e.g., a right side). The crossbow 100 includes a second upper limb 115 coupled with the top plate 120 and a second lower limb 115 coupled with the bottom plate 125 on a second side of the crossbow 100 (e.g., a left side). The first upper limb 115 and the first lower limb 115 extending generally parallel to and spaced apart from each other, and the second upper limb 115 and the second lower limb 115 extending generally parallel to and spaced apart from each other. In some embodiments, the limbs 115 have a uniform cross-sectional thickness or shape. In other embodiments, the limbs 115 have a variable cross-sectional thickness or shape. The limbs 115 are flexible such that the limbs 115 can flex inward (e.g., towards the projectile axis 535) during operation of the crossbow 100. For example, as the limbs 115 flex inward, strain energy is stored in the limbs as potential energy that is used to launch a projectile from the crossbow 100. In some embodiments, the limbs 115 are made from a composite material (e.g., fiber glass, carbon fiber, or some other material). In other embodiments, the limbs 115 are made from some other material (e.g., a metallic material). While the disclosure herein references "first" and "second" to refer to a right or left side of the crossbow 100 or components thereof, it is understood that the crossbow 100 is generally symmetrical in nature such that "first" could be understood as referring to right or left just as "second" could be understood as referring to left or right, respectively.

The limbs 115 include a first end portion 130 (e.g., first end 130) and a second end portion 135 (e.g., second end 135). The first end portion 130 and the second end portion 135 of the limbs 115 include both the terminal end (e.g., tip) of the limb 115 and some length of the limb 115 extending from the terminal end of the limb 115. The first end portion 130 of the limb 115 is proximal to either the top plate 120 or the bottom plate 125, as the case may be, and is coupled to the respective top plate 120 or bottom plate 125 via the limb bezel 197. The first end portion 130 of the limb 115 is coupled to the limb bezel 197, and the limb bezel 197 is coupled to the top plate 120 and the bottom plate 125. For example, the limb bezel 197 includes the pockets 3000, as shown in FIGS. 30 and 44, among others and as discussed above. The pocket 3000 is an opening, a recess, a cavity, an impression, or some other feature formed within the limb bezel 197 and having a form factor (e.g., shape and dimension) suited to receive the first end portion 130 of the limb 115. In some embodiments, the first end portion 130 of the limb is inserted into the secured to the limb bezel 197 via a fastener 710. For example, the fastener 710 be inserted through an opening 4400 of the limb bezel 197 (as shown in FIG. 44) and is received by a limb nut 3010. As depicted in FIGS. 30 and 44, the crossbow 100 includes a limb nut 3010 engaged with the first end portion 130 of the limb 115. The limb nut 3010 includes a post 4410 defining a threaded opening 4415. The post 4410 of the limb nut 3010 is received by an opening 4405 of the first end portion 130 of the limb 115 such that an inner surface 4420 of the limb nut 3010 is positioned against an inner surface 4425 of the limb 115. With the post 4410 positioned inside the opening 4405 of the first end portion 130 of the limb 115, the first end portion 130 of the limb 115 and the limb nut 3010 is inserted into the pocket 3000 of the limb bezel 197. With the first end portion 130 of the limb 115 and the limb nut 3010 positioned within the pocket 3000 of the limb bezel 197 (as depicted in FIG. 30, for example), the fastener 710 is inserted into the opening 4400 of the limb bezel 197 and further engages with the threaded opening 4415 of the limb nut 3010. The fastener 710 is fastened to the limb nut 3010 via engagement between the fastener 710 and the threaded opening 4415 of the limb nut 3010. Engagement between the fastener 710 and the threaded opening 4415 of the limb nut 3010 pulls the limb nut 3010 toward a wall 4430 within the pocket 3000 of the limb bezel 197. With the limb nut 3010 engaged with the fastener 710, the first end portion 130 of the limb 115 is clamped between the inner surface 4420 of the limb nut 3010 and the wall 4430 of the pocket 3000 to couple the limb 115 with the limb bezel 197.

In other embodiments, the fastener 710 threads into the limb bezel 197 and extends at least partially into the pocket 3000 and contacts (e.g., presses against, applies a force to) the first end portion 130 of the limb 115 within the pocket 3000 of the limb bezel 197. In such embodiments, the limb nut 3010 is not used, and the inner surface 4425 of the limb 115 contacts the inner wall 4435 of the limb bezel 197. In other embodiments, the first end portion 130 of the limb 115 is coupled within the pocket 3000 of the limb bezel 197 via some adhesive in addition to or in place of the fastener 710. In some embodiments, the fastener 710 at least partially extends into the pocket 3000 at a position that is at least partially aligned with the slot 715 of the limb bezel 197. For example, the fastener 710 protrudes into the pocket 3000 approximately at a vertical midpoint (e.g., a position equidistant from a top and a bottom) of the pocket 3000. According to some embodiments, the limb bezel 197 includes two pockets 3000, including a first pocket 3000 to receive the first end portion 130 of a first limb 115 (e.g., the first upper limb 115 on a first side of the crossbow 100 or a second upper limb 115 on a second side of the crossbow 100) and a second pocket 3000 to receive the first end portion 130 of a second limb (e.g., a first lower limb 115 on a first side of the crossbow 100 and a second lower limb 115 on a second side of the crossbow 100).

The first end portion 130 of each limb 115 is coupled with the limb bezel 197 via a pocket 3000 such that the limbs 115 are vertically aligned with the slot 715 of the limb bezel 197. For example, just as the slot 715 is substantially aligned (e.g., ±15%) with a vertical midpoint of the pocket 3000, the slot 715 is substantially aligned (e.g., ±15%) with a vertical midpoint of the first end portion 130 of the limb 115. By substantially aligning the slot 715 with a vertical midpoint of the first end portion 130 of the limb 115, the top plate 120 or bottom plate 125 is substantially vertically aligned the vertical midpoint of the first end portion 130 of the limb 115. Put another way, a centerline of the limb 115 extends in a direction that is substantially parallel (e.g., ±150 from parallel) with the top plate 120 or the bottom plate 125. Accordingly, during operation of the crossbow 100 as the limb 115 flexes, the loading forces on the top plate 120 and the bottom plate 125 (e.g., tensile forces) are respectively imposed by the flexing of the limb 115 on the top plate 120 or the bottom plate 125 in-plane (e.g., in a direction substantially parallel with) with the top plate 120 or the bottom plate 125. The in-plane loading of the limbs 115 improves the structural rigidity of the crossbow 100 relative to crossbows having a limb that is not positioned in-plane with a structural member of the crossbow. Similarly, the crossbow 100 includes the mid-limb support 195 to couple the limbs 115 with the top plate 120 or the bottom plate 125 in an orientation where the centerline of the limbs 115 is substantially in-plane (e.g., ±15% from parallel) with the top plate 120 or the bottom plate 125.

As depicted in FIGS. 1A-4B, 7, and 24, each pair of limbs 115 is further coupled with the mid-limb support 195. As noted above, the mid-limb support 195 is coupled to the top plate 120, the bottom plate 125, and a pair of limbs 115 (e.g., a pair of limbs 115 positioned to one side of the projectile axis 535). In particular, the mid-limb support 195 is positioned between the limbs 115 and the top and bottom plates such that the top plate 120 and the bottom plate 125 are coupled with an inner side of the mid-limb support 195 and the limbs 115 are coupled with an outer side of the mid-limb support 195. For example, the limbs 115 can be positioned against (e.g., coupled with, retained against) an intermediate outward-facing surface of the mid-limb support 195. The mid-limb support 195 acts as a fulcrum as the limb 115 flexes during operation of the crossbow 100. For example, as the draw string 145 is moved from the released position to the drawn position, the second end portions 135 of the limbs 115 flex inward toward the projectile axis 535 with the mid-limb support 195 acting as a fulcrum during the flexion of the limb 115. For each limb, the mid-limb support 195 acts as a fulcrum between the first end portion 130 and the second end portion 135 of the limb 115 as the second end portion 135 of the limb 115 flexes towards the projectile axis 535 and as the limb bezel 197 retains (e.g., fixes, captures, holds) the first end portion 130 of the limb 115. Each limb 115 of the crossbow 100 is coupled with the mid-limb support 195 via a fastener, an adhesive, or a retaining member. In some embodiments, the mid-limb support 195 includes a retaining member 196, shown as a post 196. The post 196 extends along an outer surface of the limbs 115, while the inner surfaces of the limbs 115 are positioned against an intermediate outer-facing surface of the mid-limb support 195. Put another way, the limbs 115 are captured between the intermediate outer-facing surface of the mid-limb support 195 and the post 196. In this way, the limbs 115 are coupled to the mid-limb support 195 without the need for any hole or corresponding fastener to be installed through the limb 115. In other embodiments, the retaining member 196 can be a fastener (e.g., a bolt and washer) that extends vertically along the outer surface of the limb 115 to retain the limbs 115 between the intermediate outer-facing surface of the mid-limb support 195 and the retaining member 196 of the mid-limb support 195.

The mid-limb support 195 is coupled with each of the limbs 115 such that the top plate 120 and/or the bottom plate 125 to which the mid-limb support 195 is coupled are substantially aligned (e.g., ±15%) with a respective vertical midpoint of the limb 115. Accordingly, during operation of the crossbow 100 as the limbs 115 flexes, the loading forces on the top plate 120 and the bottom plate 125 (e.g., compressive forces) are respectively imposed by the flexing of the limb 115 on the top plate 120 or the bottom plate 125 in-plane (e.g., in a direction substantially parallel with) with the top plate 120 or the bottom plate 125. As noted above, the in-plane loading of the limbs 115 improves the structural rigidity of the crossbow 100 relative to crossbows having a limb that is not positioned in-plane with a structural member of the crossbow. Similarly, the crossbow 100 includes the mid-limb support 195 to couple the limbs 115 with the top plate 120 or the bottom plate 125 in an orientation where the centerline of the limbs 115 is substantially in-plane (e.g., 15% from parallel) with the top plate 120 or the bottom plate 125.

As depicted in FIGS. 1A-21, the crossbow 100 includes a pulley assembly 140 that is operatively engaged with the draw string 145. A pulley assembly 140 is coupled to the second end portions 135 of a pair of limbs 115 (e.g., a pair of limbs 115 positioned to one side of the projectile axis 535). Accordingly, the crossbow 100 includes two pulley assemblies 140, with one coupled to the second end portions 135 of a pair of limbs 115 positioned to a first side of the projectile axis 535 and another pulley assembly 140 coupled to the second ends 135 of a second pair of limbs 115 positioned to a second side of the projectile axis 535. The draw string 145 engages with a pulley 515 of each pulley assembly 140, as is discussed in detail below, and is configured to move between a released position and a drawn position. The released position (e.g., an uncocked or undrawn position) of the draw string 145 is depicted at least in FIGS. 5A, 6A, and 9-15 and is the position of the draw string 145 before the crossbow 100 is drawn or armed. Put another way, the released position is an initial, resting position of the draw string. The drawn position (e.g., a cocked configuration) of the draw string 145 is depicted in at least FIGS. 5B, 6B, and 17-21 and is the position of the draw string 145 after the crossbow 100 is drawn and armed with a projectile 147. Put another way, the drawn position is a final position of the draw string 145 before the crossbow 100 is fired (e.g., before the projectile 147 is launched from the crossbow 100). During operation of the crossbow 100 as the draw string 145 is moved (e.g., by a user via a cocking mechanism, such as a cocking mechanism 190) in a direction 925 from the released position to the drawn position, energy is stored in the crossbow 100 (e.g., via the flexion of the limbs 115 inwards toward the projectile axis 535) with the draw string 145 that is released to launch the projectile 147 upon firing the crossbow 100 (e.g., by actuating the trigger 160).

Figure 9:
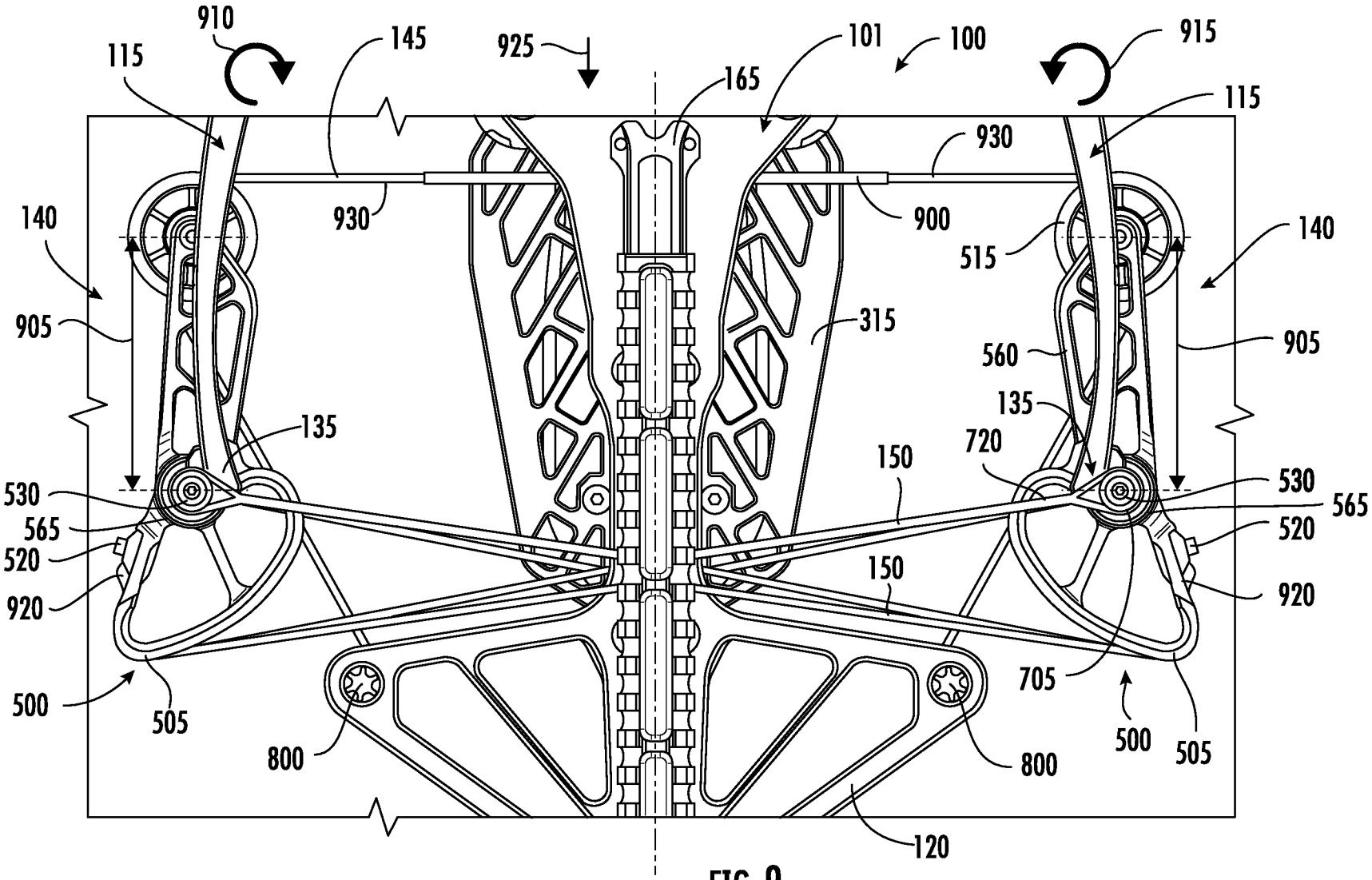
FIG. 9 is a partial top view of the projectile launcher of FIG. 1A depicting pulley assemblies of the projectile launcher of FIG. 1A in a released position.
Figure 11:
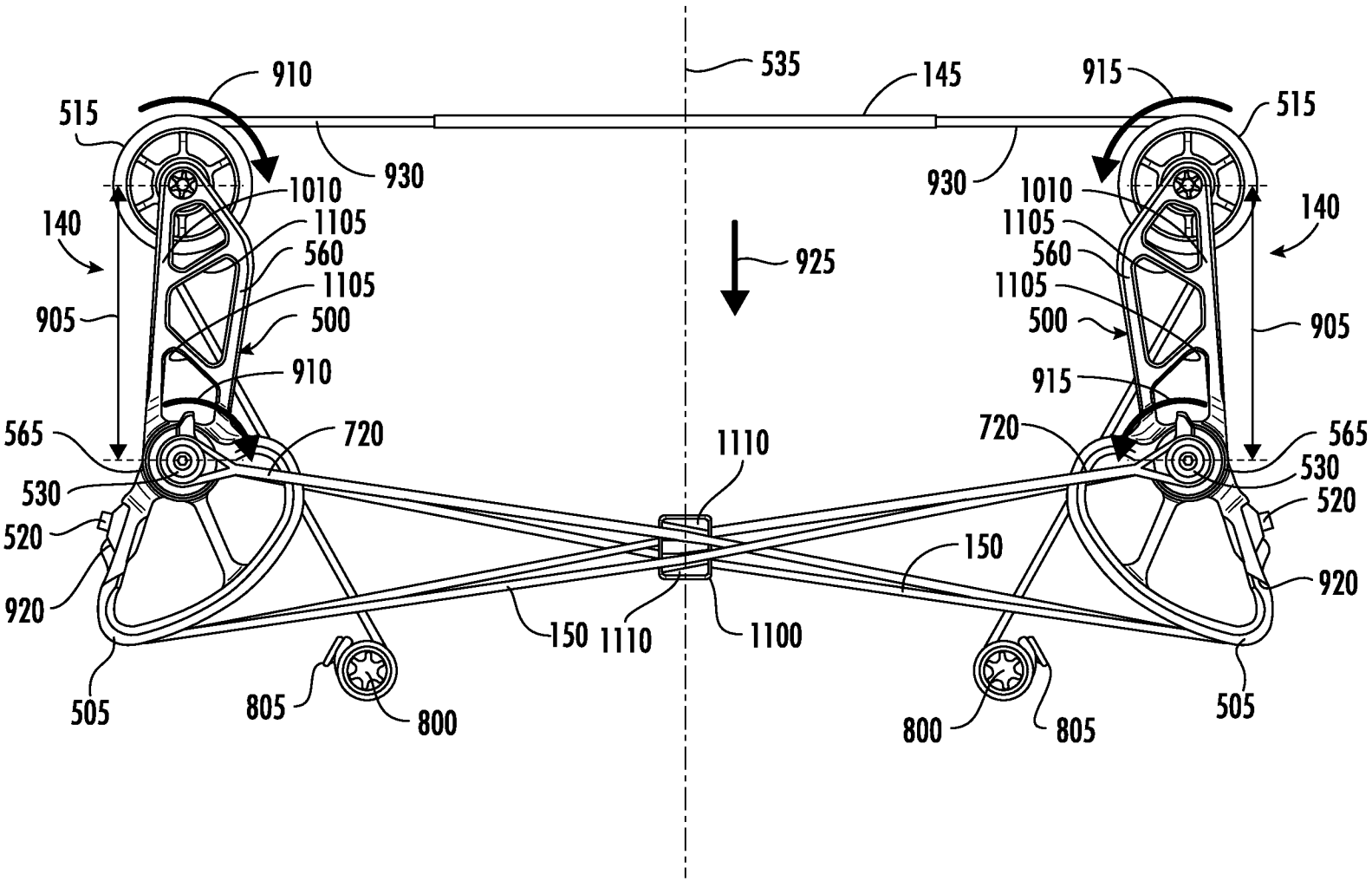
FIG. 11 is a top view of the pulley assemblies of FIG. 9.
Figure 12:
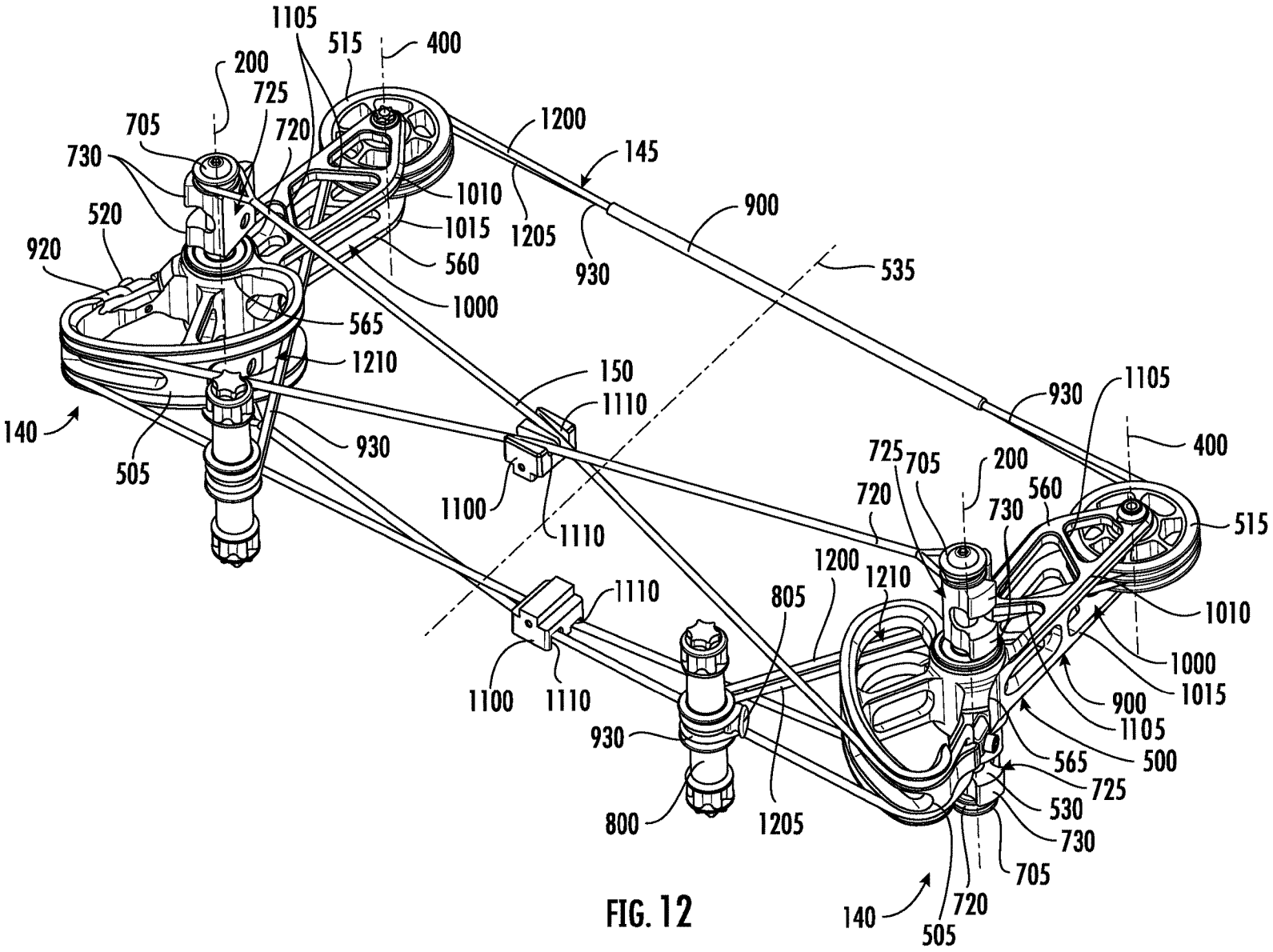
FIG. 12 a top, right, rear perspective view of the pulley assemblies of FIG. 9.
Figure 13:
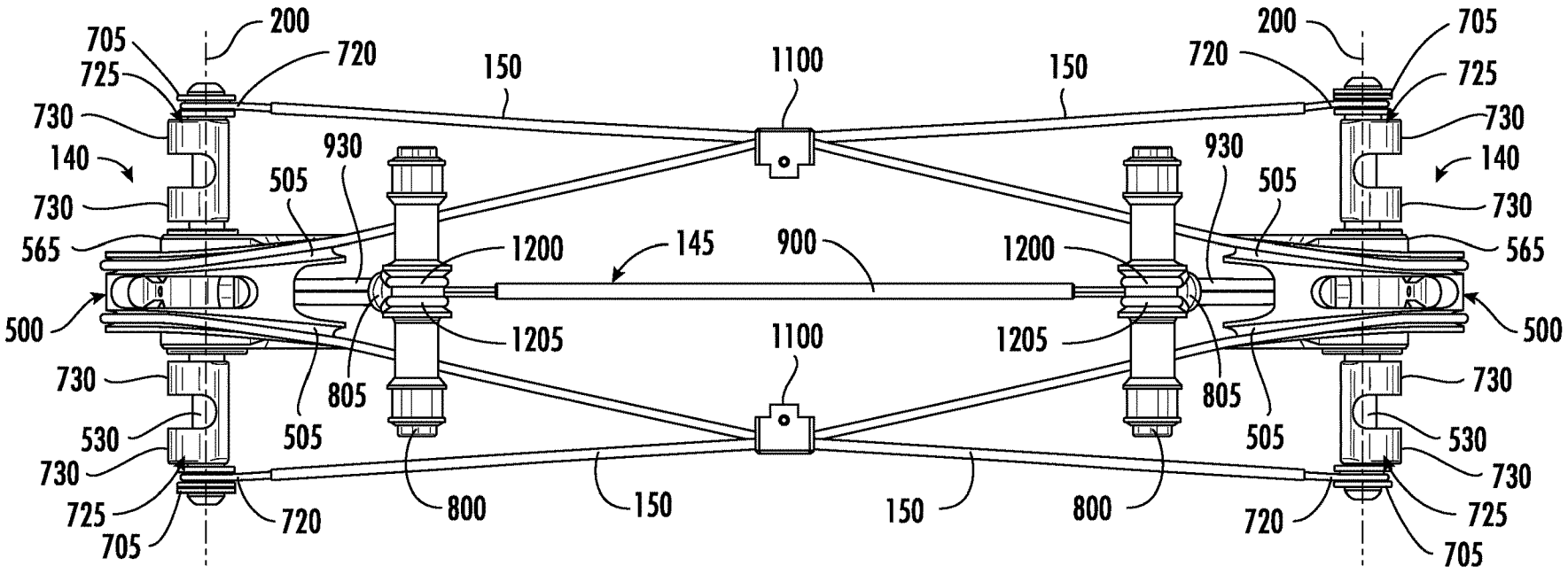
FIG. 13 is a rear view of the pulley assemblies of FIG. 9.
Figure 14:
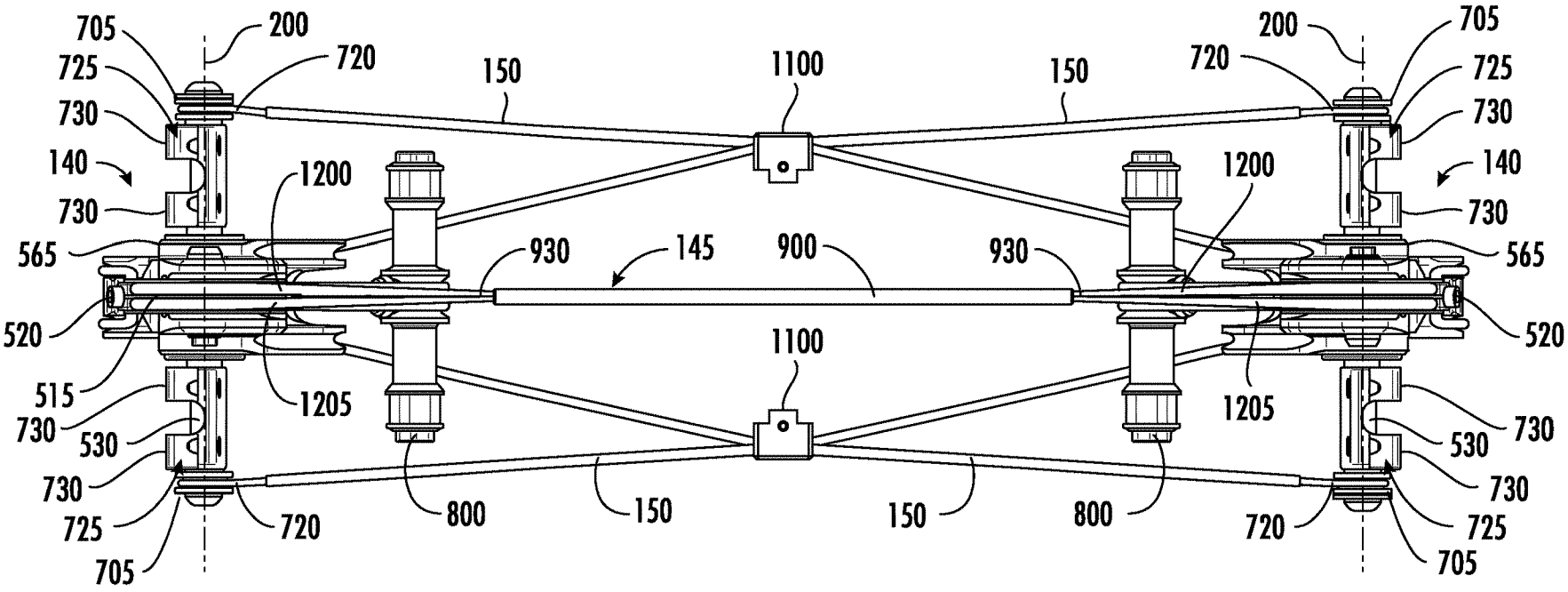
FIG. 14 is a front view of the pulley assemblies of FIG. 9.

The crossbow 100 includes two pulley assemblies 140 with a first pulley assembly 140 coupled with the second end portions 135 of two limbs 115 on a first side (e.g., a right side) of the crossbow 100 and a second pulley assembly 140 coupled with the second end portions 135 of the two limbs 115 on a second side (e.g., a left side) of the crossbow 100. As depicted in FIGS. 2-4A, among others, the pulley assembly 140 rotates about an axis 200 (e.g., a lever arm axis 200, a pulley assembly axis 200) during operation of the crossbow 100. During operation of the crossbow 100 as the draw string 145 moves from the released position to the drawn position, the pulley assembly 140 rotates about the axis 200. As the draw string 145 moves from the released position to the drawn position, the two pulley assemblies 140 respectively rotate inwards towards the projectile axis 535. More specifically, as the draw string 145 moves from the released position to the drawn position, the pulley assembly 140 positioned to a right side of the crossbow 100 rotates in the direction 915 (e.g., counterclockwise) and the pulley assembly 140 positioned to the left side of the crossbow 100 rotates in the direction 910 (e.g., clockwise), as is depicted in FIGS. 9 and 11. During operation of the crossbow 100 as the draw string 145 moves from the drawn position to the released position (e.g., as the projectile 147 is launched from the crossbow 100), each pulley assembly 140 rotates about the axis 200 in the opposite direction. As the draw string 145 moves from the drawn position to the released position, the pulley assemblies 140 respectively rotate outward away from the projectile axis 535. More specifically, as the draw string 145 moves from the drawn position to the released position, the pulley assembly 140 positioned to a right side of the crossbow 100 rotates clockwise and the pulley assembly 140 positioned to the left side of the crossbow 100 rotates counterclockwise.

Although the pulley assembly 140 is depicted as being coupled with the second end portion 135 of the limb 115, it is understood that the pulley assembly 140 can be coupled elsewhere on the crossbow 100 in other embodiments. For example, the pulley assembly 140 can be coupled to a central portion of the limb 115 (e.g., some location on the limb 115 laterally between the first end portion 130 and the second end portion 135). In other embodiments, the pulley assembly 140 can be coupled in a stationary location on the crossbow 100 such that the pulley assembly 140 only rotates about the lever arm axis 200 (e.g., rotation about a Z-axis), rather than also moving (e.g., in an X-direction and/or a Y-direction), as occurs as the limb 115 flexes when the pulley assembly 140 were coupled to the limb 115. In such embodiments, the pulley assembly 140 can be coupled to one or more of the top plate 120, the bottom plate 125, the rail 300, or some other location. For example, the pulley assembly 140 can be mounted to the crossbow 100 to have a fixed (e.g., stationary) axis on some location other than a limb 115, as is discussed in U.S. Pat. No. 10,209,026, which is incorporated by reference herein in its entirety.

Figure 15:
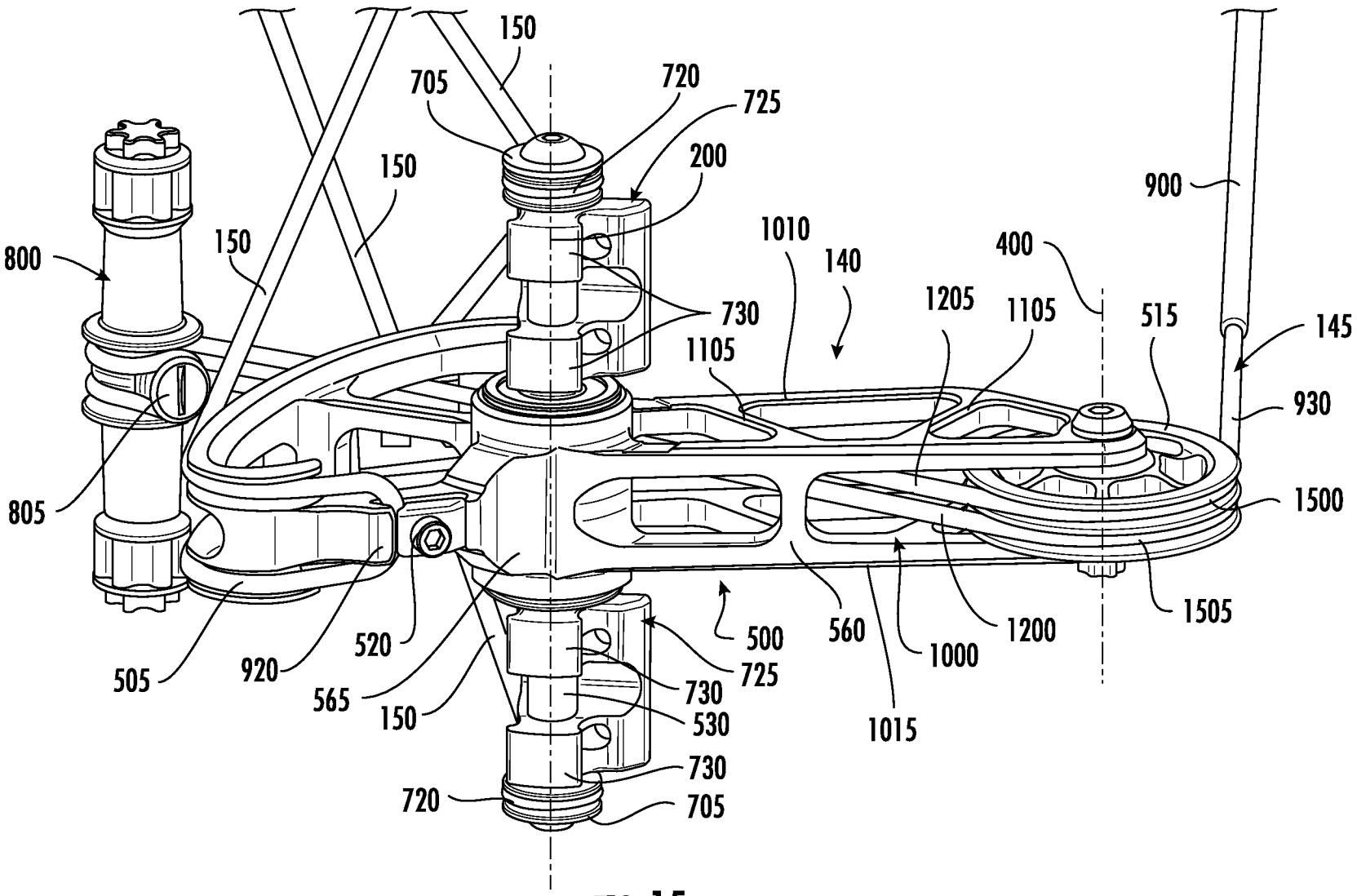
FIG. 15 is a top, front, right perspective view of one pulley assembly of the pulley assemblies of FIG. 9.

As depicted in FIGS. 5A-6B and 9-21, the pulley assembly 140 includes a lever assembly 500 and a pulley 515. The pulley 515 is rotatably coupled to the lever assembly 500. In particular, the pulley 515 rotates about a pulley axis 400. The pulley 515 is configured to engage with at least a portion of the draw string 145, whether the draw string 145 is in the released position or the drawn position. For example, the pulley 515 (e.g., a draw string guide, grooved disc, or other device) includes a draw string groove 1500 (e.g., a slot, journal, track, or other recessed region), as shown in FIG. 15. The draw string groove 1500 is a groove that is configured to receive a portion of the draw string 145. In some embodiments, the pulley 515 is a circular pulley. In other embodiments, the pulley 515 is lobe-shaped, ovular, elliptical, or have some other non-circular shape. The pulley 515 is coupled to the lever assembly 500 via an axle and axle mount, a bearing assembly, or some other attachment means. For example, the pulley 515 rotates about an axle that is received in an aperture formed through the lever assembly 500.

Figure 17:
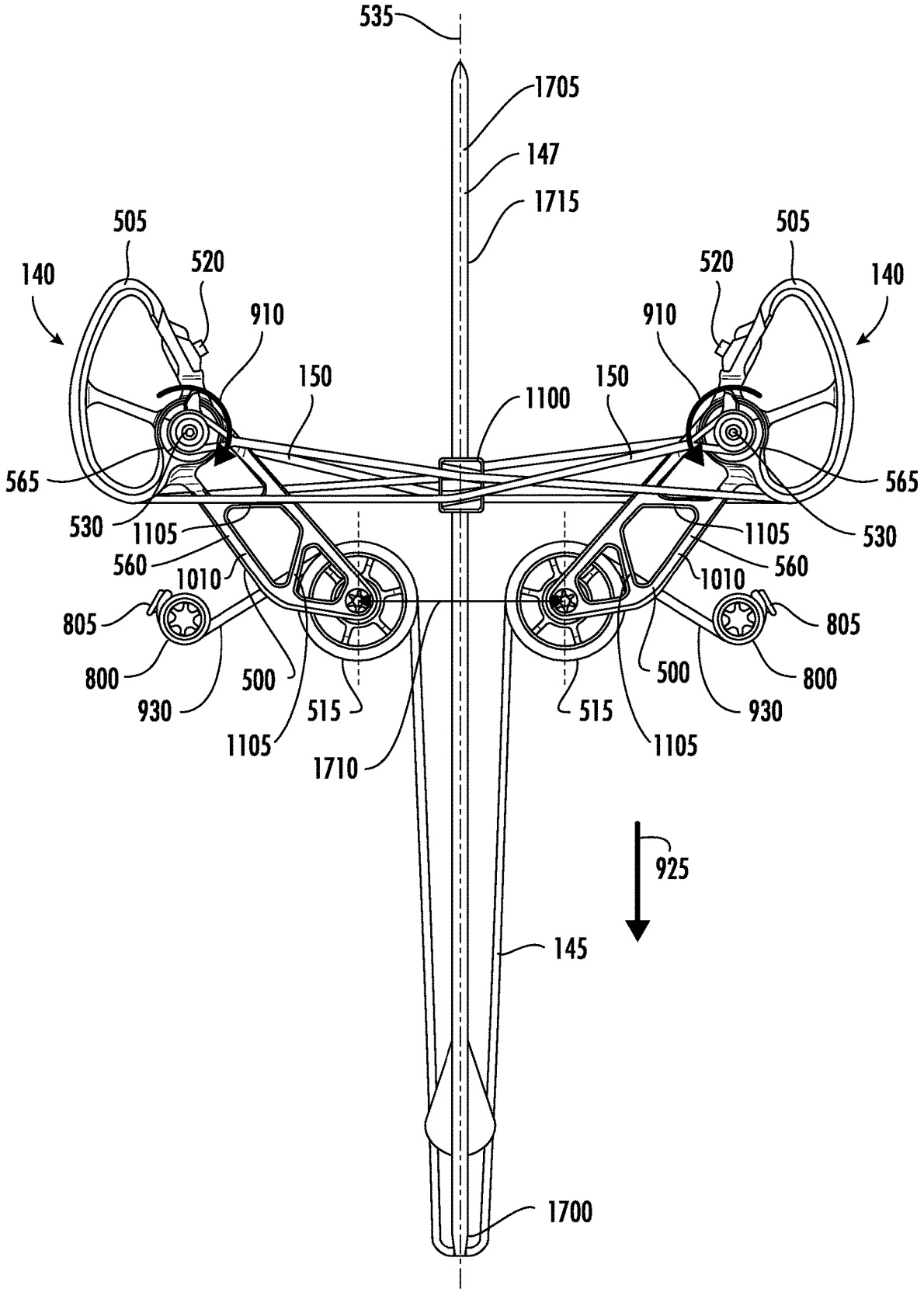
FIG. 17 is a top view of a projectile and the pulley assemblies of the projectile launcher of FIG. 1A shown in a drawn position.
Figure 18:
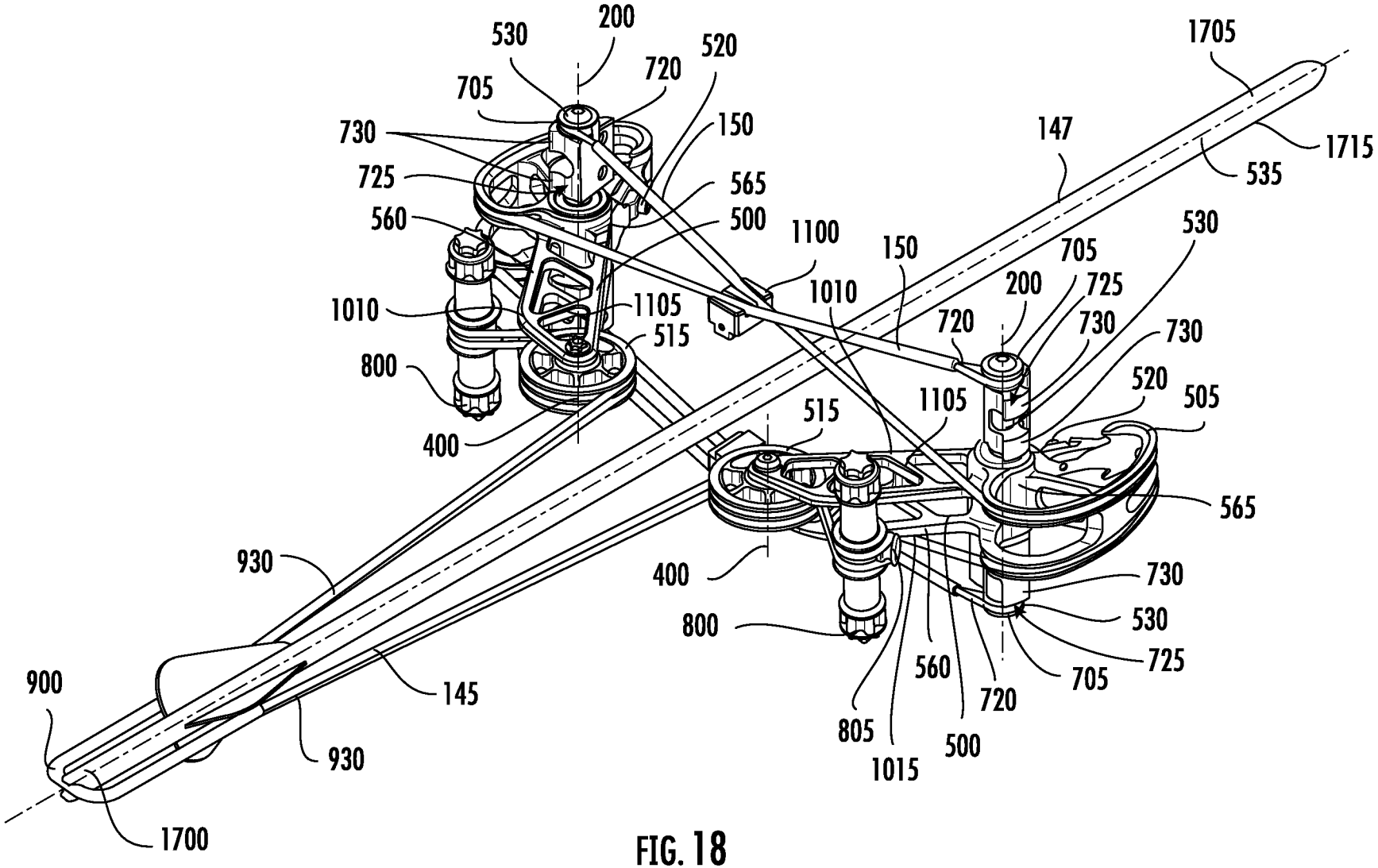
FIG. 18 is a top, right, rear perspective view of the projectile and pulley assemblies of FIG. 17.
Figure 19:
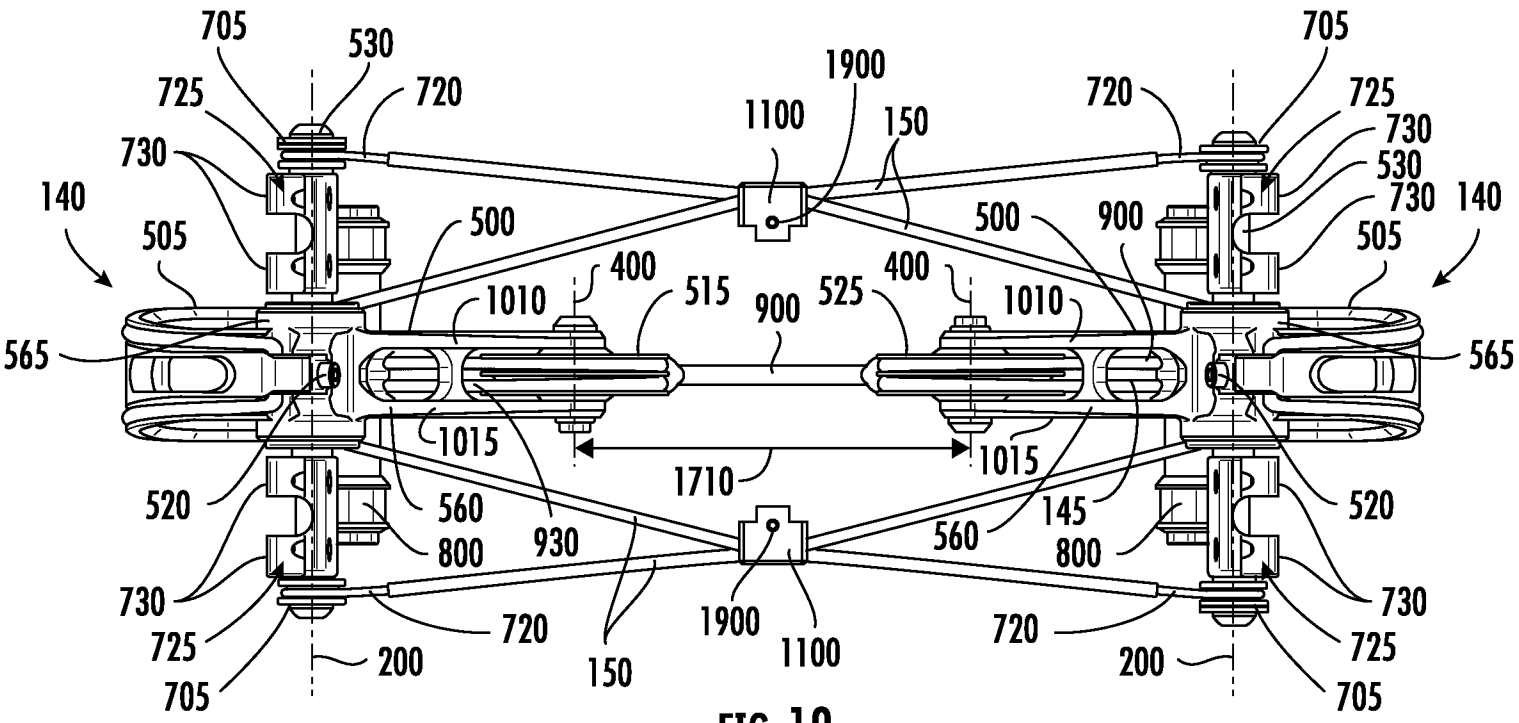
FIG. 19 is a front view of the pulley assemblies of FIG. 17.
Figure 20:
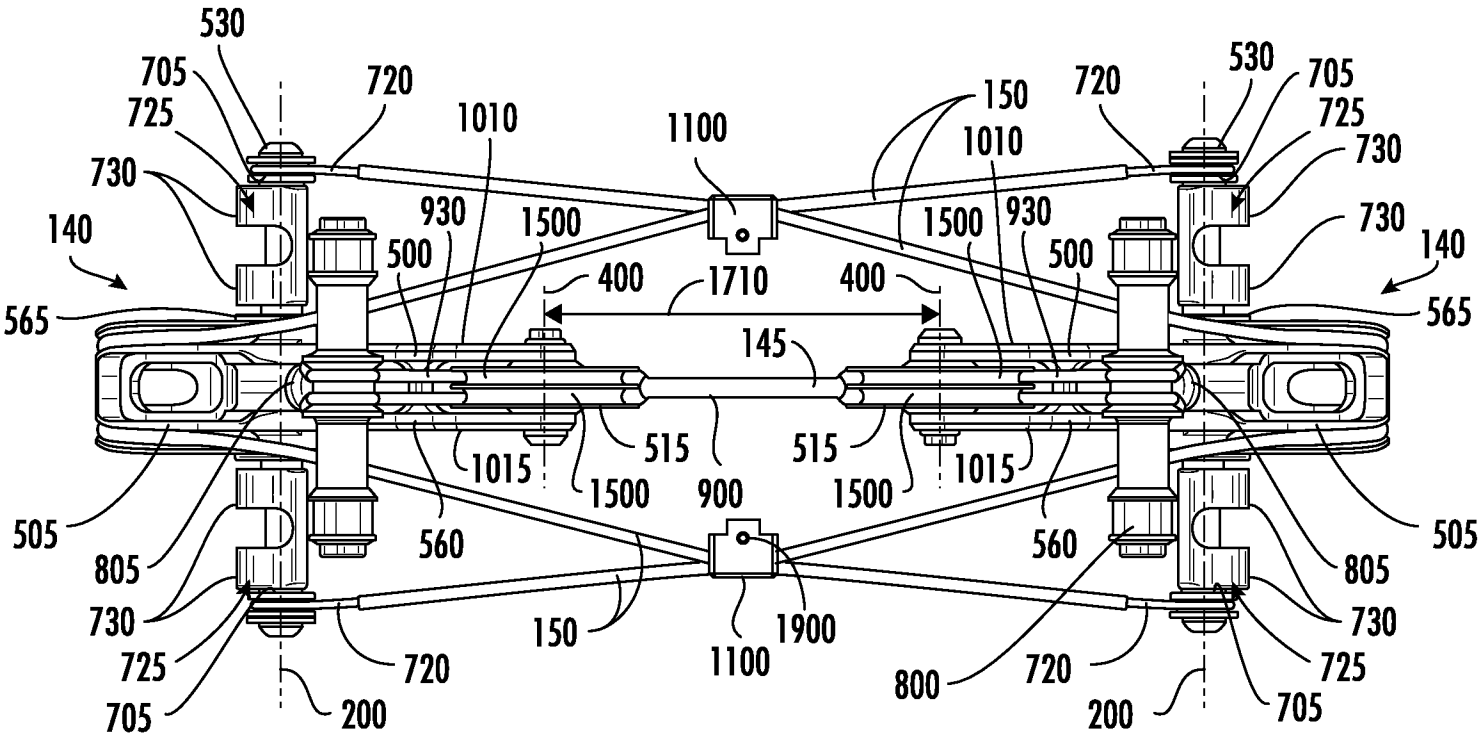
FIG. 20 is a rear view of the pulley assemblies of FIG. 17.
Figure 21:
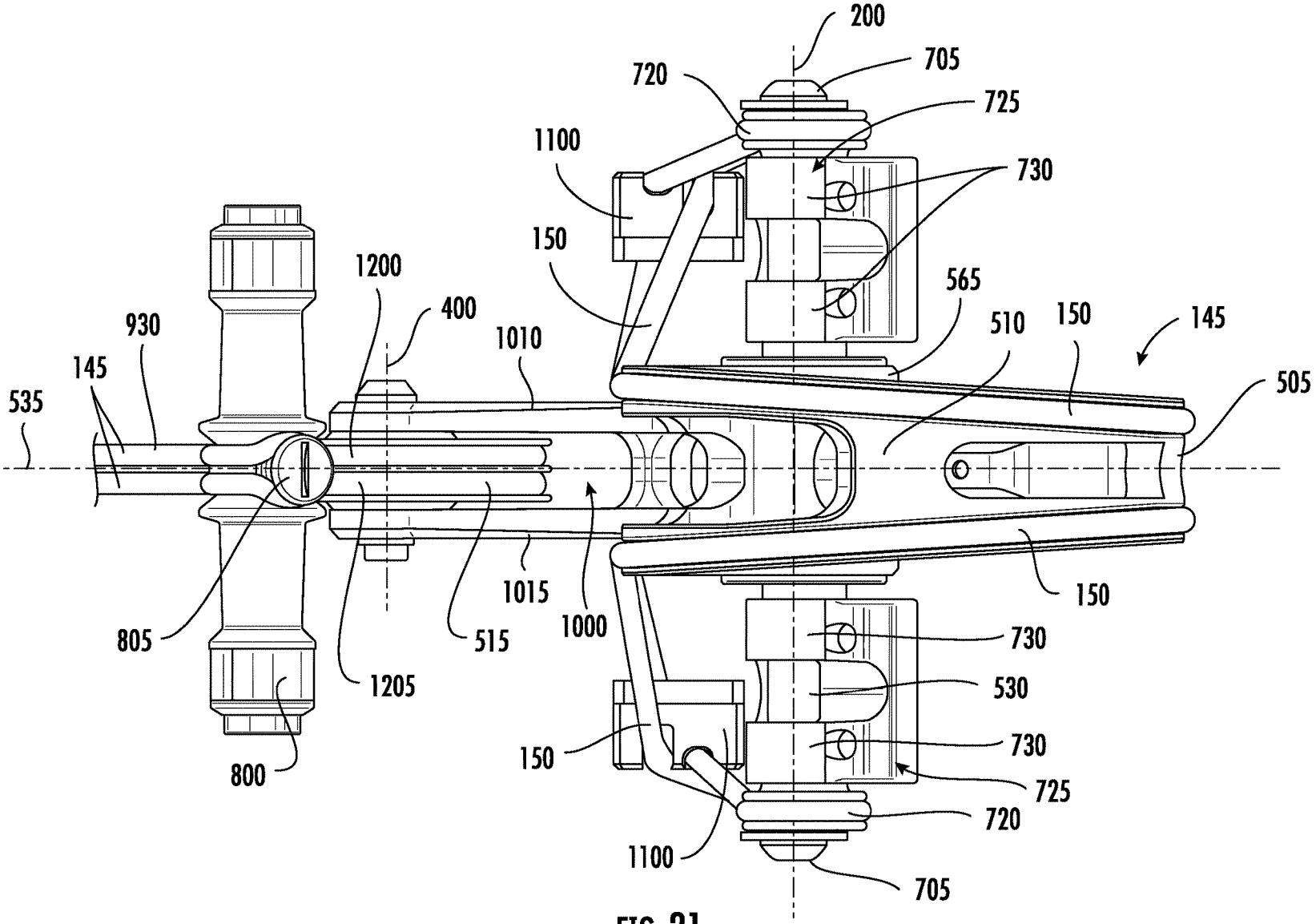
FIG. 21 is partial right side view of the pulley assemblies of FIG. 17.

The draw string 145 includes a serving portion 900. The serving portion 900 is a center portion of the draw string 145 that is wrapped with additional material (e.g., additional cable strands) to protect the draw string 145. The serving portion 900 is a portion of the draw string 145 that engages with the projectile 147. For example, as depicted in FIGS. 17-18, a nock end 1700 of the projectile 147 engages with the serving portion 900 of the draw string 145 when the draw string 145 is in the drawn position. The nock end 1700 of the projectile 147 is opposite a point end 1705 of the projectile 147 where an arrowhead, a point, a broadhead, or some other tip of the projectile 147 resides. The projectile 147 includes a shaft 1715 connecting the nock end 1700 and the point end 1705 of the projectile. The nock end 1700 of the projectile 147 includes a slot (e.g., a groove, or a notch). The serving portion 900 of the draw string 145 is received in the slot to engage the nock end 1700 of the projectile with the serving portion 900 of the draw string 145. During operation of the crossbow 100 when the projectile 147 is launched from the crossbow 100, the draw string 145 propels the projectile 147 forward along the projectile axis 535 and from the front end 105 of the crossbow 100 as the draw string 145 moves from the drawn position to the released position.

The draw string 145 includes two end portions 930. Each end portion 930 extends from the center serving portion 900. The end portions 930 are attached to the crossbow 100. Specifically, the end portions 930 are attached to a static (i.e., non-movable, rigid, fixed) attachment feature 805 (e.g., a static mount 805), such as a post 805. For example, the end portions 930 are respectively coupled to a first post 805 that radially extends from a first column 800 (e.g., a column 800 positioned to a right side of the projectile axis 535) and a second post 805 that extends radially from a second column 800 (e.g., a column positioned to a left side of the projectile axis 535). The end portions 930 of the draw string 145 are loops. The loops are each positioned around the post 805 such that the post 805 retains (e.g., hooks) the loops and prevents it from separating from the column 800 when the draw string 145 is under tension (e.g., during operation of the crossbow 100). According to some embodiments, substantially the entire (e.g., 75% or more) end portion 930 of the draw string 145 is looped. Put another way, substantially all (e.g., 75% or more) of the end portion 930 is a single, large loop. Accordingly, the end portions 930 are continuous looped stands extending from each side of the serving portion 900 of the draw string 145.

As depicted in FIGS. 12-15 and 19-21, the looped end portion 930 includes a first draw string portion 1200 and a second draw string portion 1205, where the first draw string portion 1200 is an upper portion of the looped end portion 930 of the draw string 145 and the second draw string portion 1205 is a lower portion of the looped end portion 930 of the draw string 145. Both end portions 930 of the draw string 145 include the first draw string portion 1200 and the second draw string portion 1205. The first draw string portion 1200 and the second draw string portion 1205 are engaged with the pulley 515. The pulley 515 includes two draw string grooves 1500, including a first draw string groove 1500 as depicted in FIG. 15, that is configured to receive the first draw string portion 1200 and a second draw string groove 1500 configured to receive the second draw string portion 1205. The first draw string groove 1500 is substantially (e.g., 95% or more) dimensionally and geometrically identical with the second draw string groove 1500. The first draw string groove 1500 is positioned above the second draw string groove 1500. During operation of the crossbow 100 as the draw string 145 moves from the released position to the drawn position, the pulley 515 rotates about the pulley axis 400 to pay out (e.g., dispense, provide, release, feed) the draw string 145 so that the draw string 145 can be pulled along the projectile axis 535. For example, the first draw string portion 1200 and the second draw string portion 1205 simultaneously unwind from the first and second draw string grooves 1500 of the pulley 515 to pay out a length of the draw string 145.

The end portion 930 of the draw string 145 extends from the serving portion 900, to the pulley 515, and to the column 800 where the end portion 930 is coupled to the column 800 via the post 805 or via some other retaining device associated with the column 800. Because the draw string 145 includes two opposing looped end portions 930, a first looped end portion 930 is coupled to a first column 800 to one side (e.g., a right side) of the projectile axis 535 and a second looped end portion 930 is coupled to a second side (e.g., a left side) of the projectile axis 535. Accordingly, the draw string 145 is routed from a first column 800, to a first pulley 515 where the first draw string portion 1200 and the second draw string portion 1205 each engage with a draw string groove 1500 of the first pulley 515, to the serving portion 900, to a second pulley 515 where the first draw string portion 1200 and the second draw string portion 1205 each engage with a draw string groove 1500 of the second pulley 515, and to the second column 800. In such a configuration, the draw string 145 extends from one side (e.g., a right side) of the projectile axis 535 to another side (e.g., a left side) of the projectile axis 535. More specifically, the serving portion 900 extends from one side (e.g., a right side) of the projectile axis 535 to another side (e.g., a left side) of the projectile axis 535 and at least partially perpendicularly intersects the projectile axis 535. For example, the serving portion 900 is substantially perpendicular (e.g., 2° from perpendicular) with the projectile axis 535 as the serving portion 900 crosses over the rail 300 of the crossbow 100. The draw string 145 is positioned within the opening 199 between the top plate 120 and the bottom plate 125. For example, the pulley 515 of each pulley assembly 140 and the posts 805 of each column 800 are positioned within the opening 199 such that the draw string 145 that is coupled to or engages with the pulleys 515 and the posts 805 is also positioned within the opening 199.

Figure 7:
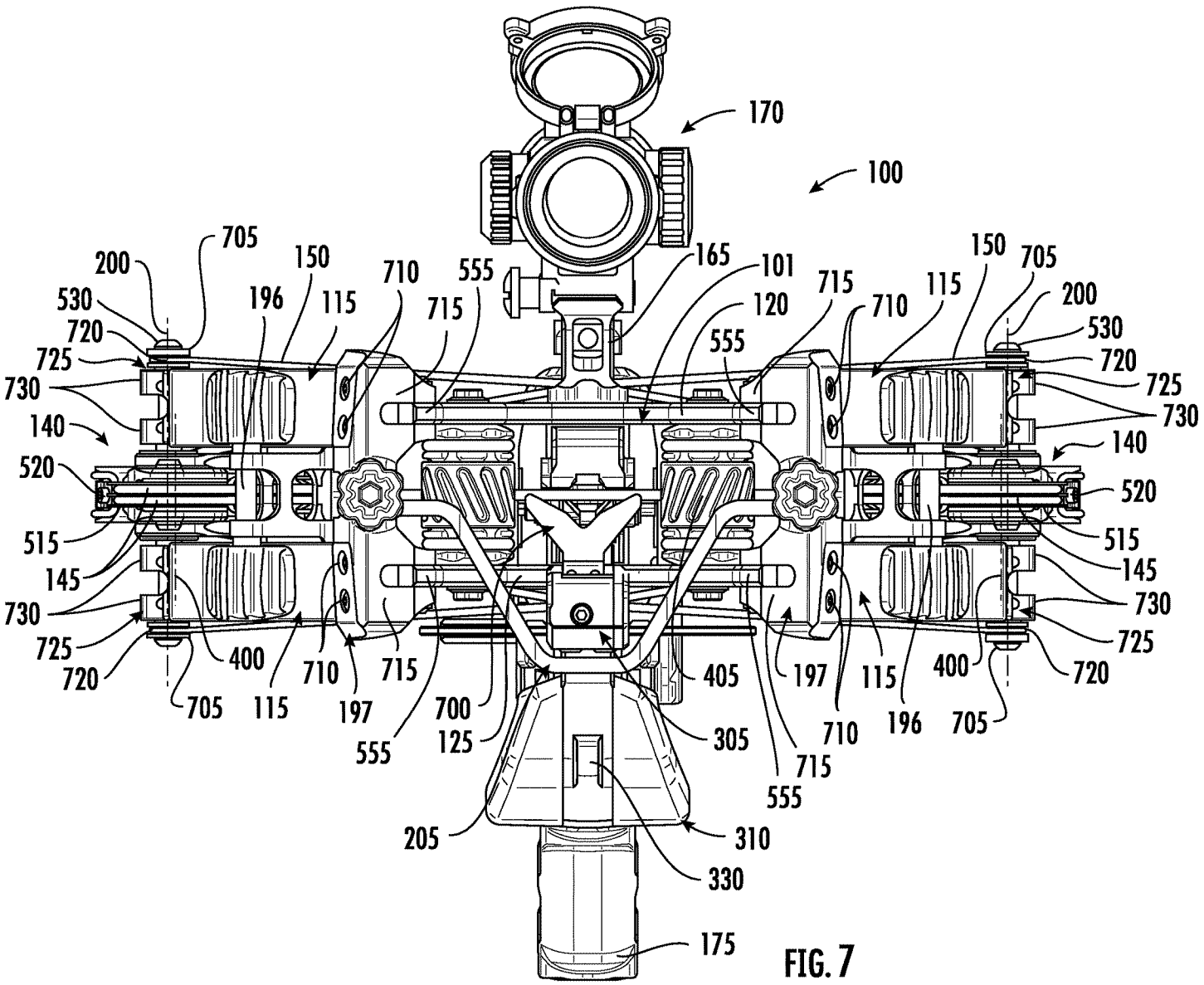
FIG. 7 is a front view of the projectile launcher of FIG. 1A.
Figure 8:
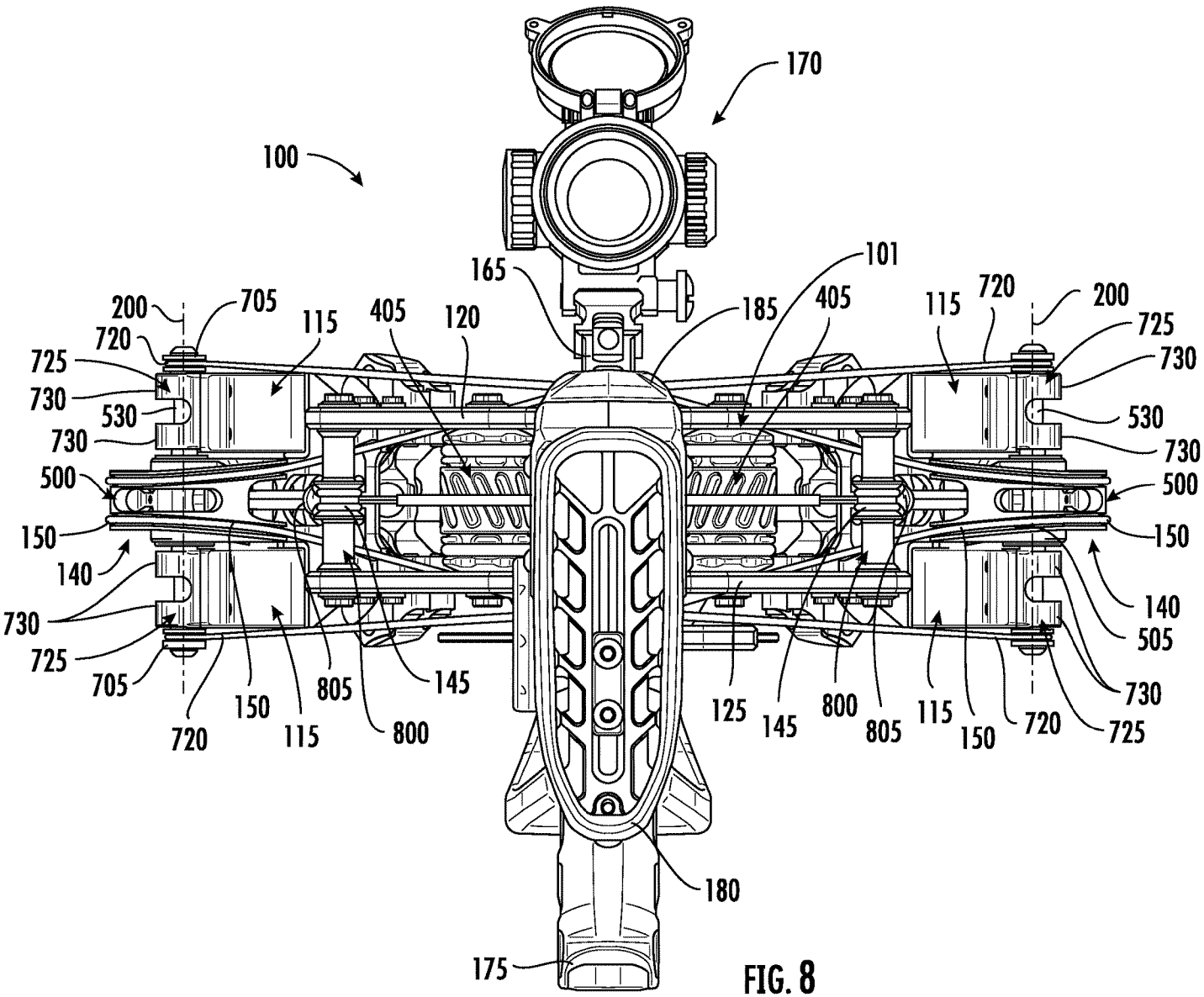
FIG. 8 is a rear view of the projectile launcher of FIG. 1A.

The lever assembly 500 includes a lever arm 560, a central portion 565, an axle 530, and a power cable journal 505. The lever assembly 500 is coupled with the second end portion 135 of at least one limb 115 and is configured to rotate via the axle 530 about the lever arm axis 200 relative to the second end portion 135 of the limb 115 during operation of the crossbow 100. According to an exemplary embodiment, the lever assembly 500 includes the axle 530 that is received by an opening of the central portion 565 and coupled to the second end portions 135 of two limbs 115 on each side of the crossbow 100, as is depicted in FIGS. 7 and 8, among others. The axle 530 can be coupled with the second end portions 135 of the limbs 115 via an axle mount 725. The axle mount 725 can be a pillow block mount or some other mounting device that can rotatably couple the axle 530 to the second end portions 135 of the limbs 115. Specifically, the axle mount 725 couples the axle 530 to the limbs 115 such that the axis 200 along which the axle 530 resides is substantially fixed relative to the limbs 115. Put another way, a distance between the axle 530 and the limb 115 does not vary during operation of the crossbow 100.

In some embodiments the axle 530 is received in a first axle mount 725 coupled to an upper limb 115 and a second axle mount 725 coupled to the lower limb 115 where the first axle mount 725 and the second axle mount 725 are coupled to the second end portions 135 of the upper and lower limbs 115 via a fastener (e.g., a screw) or some other joining means. In other embodiments, the second end portions 135 of the limbs 115 include a through hole that is concentric with the lever arm axis 200. In such embodiments, the axle 530 is received within the through hole in each second end portion 135 and retained within the through hole via a retaining clip or other retaining means.

The axle mount 725 includes a radial projection 730. The radial projection 730 is a portion of the axle mount 725 that projects radially relative to the axle 530. The radial projection 730 provides a contact surface that can be contacted by a limb press or other device used to flex the limbs 115 during assembly or service of the crossbow 100. For example, a limb press can contact the radial projection 730 of the axle mount 725 to apply a force to the limbs 115 and bend the limbs 115 inward toward the axis 535, which can release the tension in the power cable 150, draw string 145, or some other component of the bow to allow said power cable 150 or draw string 145 to be serviced or replaced. The radial projection 730 can extend radially to or beyond a portion of the lever arm 560 of the lever assembly 500 that is proximate the axle 530, according to some embodiments. Because the radial projection 730 extends radially to or beyond a portion of the lever arm 560 that is proximate the axle 530 (e.g., a portion of the lever arm 560 that surrounds the axle 530), a limb press can engage the axle mount 725 without contacting the lever arm 560, the axle 530, or any other component. In this way, the radial projections 730 enable assembly or service of the crossbow 100 without risking damage to various components of the crossbow 100.

The lever arm 560, the central portion 565, and the pulley 515, among other components of the pulley assembly 140, are positioned between the two limbs 115 on either side of the crossbow 100 such that the lever arm 560 and the pulley 515 are configured to move within a space between the two limbs 115. For example, the lever arm 560 can rotate about the lever arm axis 200 such that the lever arm 560 moves in a plane that is vertically positioned between the bottom of an upper limb 115 and the top of a lower limb 115 of the crossbow 100.

As depicted in FIGS. 9-12, 15, and 17-20, the lever arm 560 extends from the central portion 565 to the pulley axis 400. The pulley 515 is rotatably coupled to the lever arm 560 of the lever assembly 500 about the pulley axis 400. The pulley axis 400 is parallel with the lever arm axis 200. The pulley axis 400 is spaced apart (e.g., positioned away from) the lever arm axis 200 by a lever distance 905. For example, the lever distance 905 can be a length of the lever arm 560 extending from the pulley assembly axis 200 to the pulley axis 400. Accordingly, the lever arm 560 spaces the pulley axis 400 apart from the lever arm axis 200 so that the pulley 515 rotates about the pulley axis 400 that is not positioned at the second end portions 135 of the associated limbs 115. Rather, the pulley 515 of each pulley assembly 140 rotates about the pulley axis 400 that is positioned away from the second end portion 135 of the limbs 115 by the distance. Further, because the pulley assembly 140, namely the lever arm 560 of the lever assembly 500, rotates about the lever arm axis 200, the radial position of the pulley axis 400 relative to the second end portions 135 of the associated limbs 115 changes as the pulley assembly 140 rotates about the lever arm axis 200. For example, as depicted in FIGS. 9-12, the pulley axis 400 is positioned generally forward of the lever arm axis 200 (e.g., between the front end 105 of the crossbow 100 and the pulley assembly axis 200) when the draw string 145 is in the released position. As depicted in FIGS. 17-21, among others, the pulley axis 400 is positioned horizontally between the projectile axis 535 and the lever arm axis 200 when the draw string 145 is in the drawn position. Further, the pulley axis 400 is positioned at least partially behind the lever arm axis 200 (e.g., between the rear end 110 and the lever arm axis 200).

The lever arm 560 of the lever assembly 500 is a generally elongate structure that extends from the central portion 1020 and that includes the opening 1000. The opening 1000 can be a through hole, a space (e.g., gap, window) between an upper portion 1010 of the lever arm 560 and a lower portion 1015 of the lever arm 560), a notch (e.g., groove, slot, recess) in the lever arm 560, or some other passageway. The upper portion and the lower portion 1015 of the lever arm 560 are coupled together to form the lever arm 560 and define the opening 1000. Each of the upper portion 1010 and the lower portion 1015 include openings defined by trusses 1105, as depicted in FIG. 11. The draw string 145 is routed through the opening 1000 of the lever arm 560. Specifically, the first draw string portion 1200 and the second draw string portion 1205 are routed through opening 1000 between the pulley 515 and the column 800. According to an exemplary embodiment, the first draw string portion 1200 and the second draw string portion 1205 pass through the opening 1000 of the lever arm 560 between the column 800 to which the end portion 930 of the draw string 145 is coupled and the pulley 515 with which the first draw string portion 1200 and the second draw string portion 1205 engage. Accordingly, the draw string 145 is routed from a first column 800, through a first opening 1000 of a first lever arm 560, to a first pulley 515 where the first draw string portion 1200 and the second draw string portion 1205 each engage with a draw string groove 1500 of the first pulley 515, to the serving portion 900, to a second pulley 515 where the first draw string portion 1200 and the second draw string portion 1205 each engage with a draw string groove 1500 of the second pulley 515, through a second opening 1000 of a second lever arm 560, and to the second column 800. As depicted in FIGS. 9-12, the draw string 145 is routed in this manner when the draw string 145 is in the released position. As depicted in FIGS. 17-21, among others, the draw string 145 is routed in this manner when the draw string 145 is in the drawn position. In other embodiments, rather than being routed through an opening 1000 in the lever arm 560, the draw string 145 can be routed around (e.g., above and below) the lever arm 560. For example, a vertical distance between a first draw string groove 1500 with which the first draw string portion 1200 engages and a second draw string groove 1500 with which the second draw string portion 1205 engages can be greater than a width of the lever arm 560 such that the first draw string portion 1200 is routed vertically above the lever arm 560 and the second draw string portion 1205 is routed vertically below the lever arm 560 from the column 800 to the pulley 515.

As depicted in FIGS. 5A-6B and 8-21, among others, the lever assembly 500 includes the power cable journal 505 coupled with the lever arm 560 via the central portion 1020. The lever arm 560 and the power cable journal 505 are integrally coupled such that the power cable journal 505 rotates about the lever arm axis 200 with the lever arm 560. According to an exemplary embodiment, the lever arm 560 extends in a first direction from the lever arm axis 200 (e.g., a forward direction when the draw string 145 is in the released position) and the power cable journal 505 extends (e.g., is positioned, is located) a second direction from the lever arm axis 200 (e.g., a rearward direction when the draw string 145 is in the released position). For example, the second direction can be opposite (e.g., diametrically opposed to) the first direction or some other direction (e.g., perpendicular, 135°, 45°, etc.) relative to the first direction. The power cable journal 505 can include a counterweight that can extend (e.g., protrude) from the power cable journal 505 and a power cable journal gap 1210. For example, the counterweight can move with the power cable journal 505 during operation of the crossbow 100 as the power cable journal 505 (and the pulley assembly 140 more broadly) rotate about the lever arm axis 200. The counterweight can dampen vibration or imbalances associated with a rotation of the pulley assembly 140 about the lever arm axis 200 to provide for a smooth, even, balanced rotation. In some examples, the counterweight can include a removable weight element. For example, the weight element installed on the counterweight can have a particular and customizable weight or mass to optimize the effect of the counterweight (e.g., vibration dampening and rotation balancing). The power cable journal gap 1210 can be a slot, opening, recess, or space formed in the power cable journal 505 through which the draw string 145 is routed with the draw string 145 in the drawn position. Specifically, the draw string 145 extends from the column 800 and through the power cable journal gap 1210 before extending through the opening 1000 of the lever arm 560.

Figure 16:
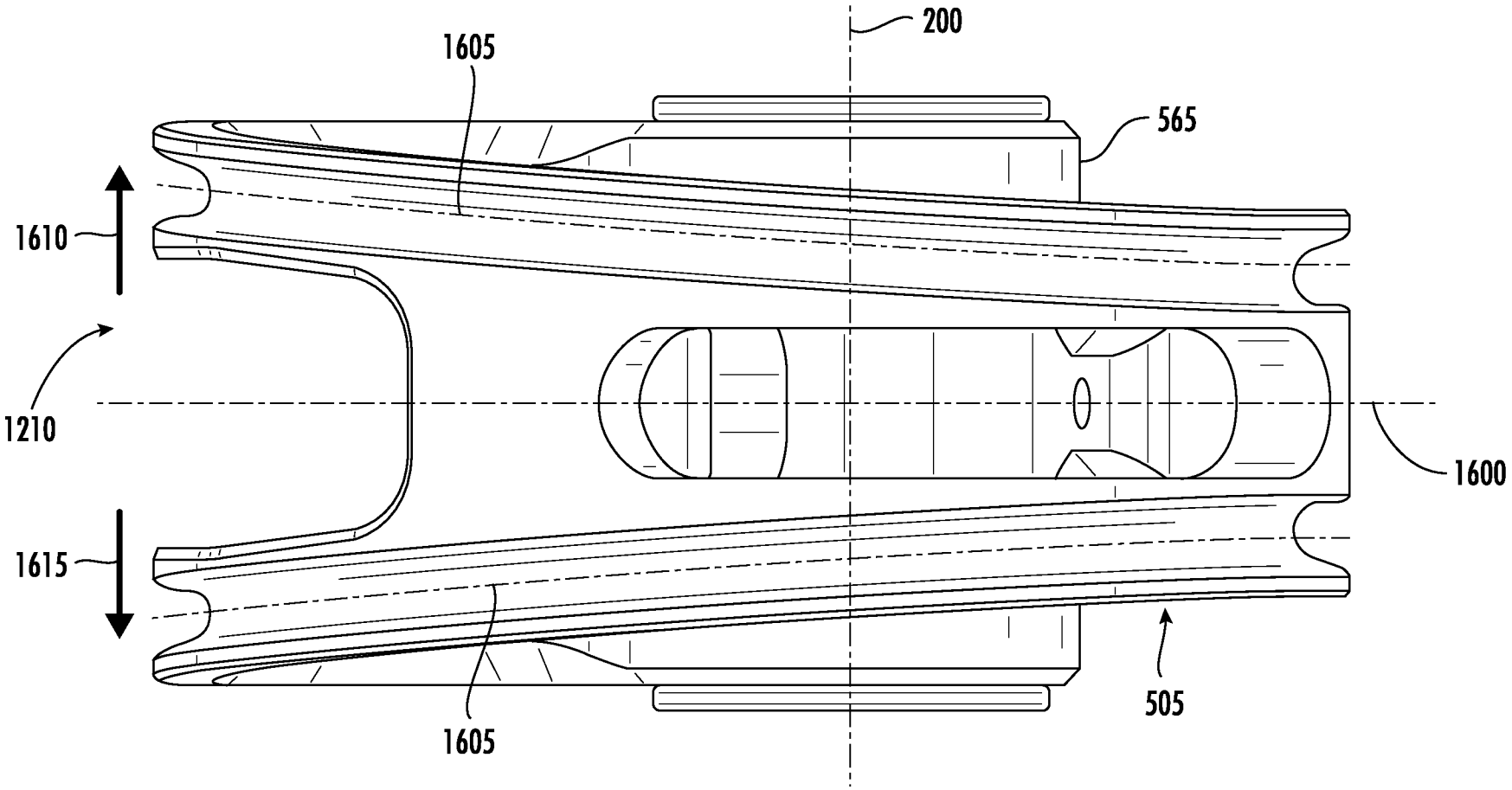
FIG. 16 is a right side view of a power cable journal of the pulley assembly of FIG. 15.

The power cable journal 505 is configured to engage with a power cable 150. The power cable journal 505 includes a power cable groove 1605, as depicted in FIG. 16, among others. According to an exemplary embodiment, the power cable journal 505 includes a first power cable groove 1605 (e.g., an upper power cable groove 1605) and a second power cable groove 1605 (e.g., a lower power cable groove 1605). In embodiments where the power cable journal 505 includes first and second power cable grooves 1605, the first power cable groove 1605 can engage with a first portion of a power cable 150 and the second power cable groove 1605 can engage with a second portion of a power cable 150. The first portion of the power cable 150 and the second portion of the power cable 150 can be portions of the same power cable 150, according to an exemplary embodiment. In other examples, the first portion of the power cable 150 and the second portion of the power cable 150 can be portions of separate (e.g., distinct, unique, different) power cables 150. In some embodiments, the power cable journal 505 includes a single power cable groove 1605 or more than two power cable grooves 1605. The power cable groove 1605 of the power cable journal 505 is a groove, recess, slot, notch, or other region of the power cable journal 505 that is configured to receive a portion (e.g., a length) of the power cable 150 during operation of the crossbow 100.

The power cable groove 1605 wraps at least partially around the power cable journal 505 in a radial direction. In some embodiments, the power cable groove 1605 is located in a plane, meaning that the power cable groove 1605 is planar. The plane in which the power cable groove 1605 resides can be angled relative to the central plane 1600. For example, the plane within which the power cable groove 1605 resides can be oriented at a 5-30° angle relative to the central plane 1600. In other embodiments, the power cable groove 1605 is located in a plane that is substantially parallel to the central plane 1600 such that the power cable groove 1605 is essentially planar and oriented substantially horizontally. In such embodiments, the power cable groove 1605 can be elevated (e.g., spaced apart from) the central plane 1600 in the direction 1610 or 1615. In some examples, the power cable groove 1605 is located in a plane that is oriented at an angle relative to the central plane 1600 such that the power cable 150 extends substantially linearly (e.g., straight or without any substantial bend or kink) from the power cable groove 1605 to the power cable guide 1100 and to the post 705.

In yet other examples, the power cable groove 1605 includes a three-dimensional profile or shape where the power cable groove 1605 follows a path that varies in three dimensions (e.g., an X-direction, a Y-direction, and a Z-direction). For example, the power cable groove 1605 can follow a partially helical path, where a vertical position of the power cable groove 1605 relative to a central plane 1600 of the power cable journal 505 varies along a length the power cable groove 1605. The plane 1600 is perpendicular to the lever arm axis 200. As depicted in FIG. 16, the power cable journal 505 includes a first power cable groove 1605 that includes a path displaced from the plane 1600 in the direction 1610 by a variable distance as the power cable journal 505 rotates. Further, the power cable journal 505 includes a second power cable groove 1605 that includes a path displaced from the plane 1600 in the direction 1615 by a variable distance. In such an arrangement, a power cable 150 or a portion of a power cable 150 engaged with the first power cable groove 1605 or the second power cable groove 1605 will be displaced away from the central plane 1600 of the power cable journal 505 as the power cable or portion of the power cable 150 wraps onto the power cable journal 505 via engagement with the power cable groove 1605.

The power cable journal 505 includes a power cable hook 920, as depicted in FIG. 9, among others. The power cable hook 920 extends from the power cable journal 505 and is configured to hook around the power cable 150 that engages with the power cable journal 505. The power cable journal 505 further includes a power cable clamp 520. The power cable clamp 520 is secured at least partially over the power cable 150 with the power cable 150 looped around (e.g., hooked on, retained by) the power cable hook 920. The power cable clamp 520 prevents the power cable 150 from separating from the power cable hook 920 or otherwise separating from the power cable journal 505. For example, the power cable 150 is at least partially enclosed by the power cable journal 505, the power cable hook 920, and the power cable clamp 520 so that the power cable 150 is coupled to the power cable journal 505. According to an exemplary embodiment, each power cable journal 505 is coupled with a single power cable 150, where a first portion of the single power cable 150 is configured to engage with (e.g., be received by) a first power cable groove 1605 (e.g., an upper power cable groove 1605) and a second portion of the power cable 150 is configured to engage with (e.g., be received by) a second power cable groove 1605 (e.g., a lower power cable groove 1605). Accordingly, an intermediate portion of the power cable 150 is engaged with the power cable hook 920 and the power cable clamp 520, where to one side of the intermediate portion of the power cable 150 is the first portion of the power cable 150 that is configured to engage with the first power cable groove 1605 and to the other side of the intermediate portion of the power cable 150 is the second portion of the power cable 150 that is configured to engage with the second power cable groove 1605.

The power cable clamp 520 is removable. For example, the power cable clamp 520 is coupled with the power cable journal 505 via a fastener, such as a screw, bolt, rivet, or some other fastener. To couple the power cable 150 with the power cable journal 505, the power cable 150 is first looped around the power cable hook 920 while the power cable clamp 520 is either entirely removed from the power cable journal 505 or loosened to be temporarily moved out of the way. With the power cable 150 looped around the power cable hook 920, the power cable clamp 520 can be coupled to the power cable journal 505 or tightened against the power cable journal 505 with the power cable 150 looped around the power cable hook 920. In such an arrangement, the power cable hook 920 can bound one radial side of the power cable 150 and the power cable clamp 520 can bound another radial side of the power cable 150 to prevent the power cable 150 from separating from the power cable journal 505. By removing the clamp 520, the power cable 150 is removable from the power cable journal 505 so that the power cable 150, the power cable journal 505, or some other component can be serviced or replaced.

The power cable 150 includes two end portions 720. The end portions 720 of the power cable 150 include the terminal end (e.g., the point at which the power cable 150 ends) of the power cable and some length of the power cable 150 extending therefrom. For example, the end portion 720 of the power cable 150 includes a looped end of the power cable 150 and some length (e.g., 2 inches, 4 inches) of the power cable 150 extending therefrom. The crossbow 100 includes the end portions 720 of the power cable 150 coupled to the crossbow 100 with the power cable 150 also engaged with the power cable journal 505, as discussed above. For example, as depicted in FIGS. 7-15 and 18-21, among others, the end portions 720 of the power cable 150 can be coupled to the opposite pulley assembly 140. Specifically, the end portions 720 of a first power cable 150 engaged with a first power cable journal 505 of a first pulley assembly 140 (e.g., a right pulley assembly 140 are coupled to the axle 530 of a second pulley assembly 140 (e.g., a left pulley assembly 140). Likewise, the end portions 720 of a second power cable 150 engaged with a second power cable journal 505 of the second pulley assembly 140 (e.g., the left pulley assembly 140) are coupled to the axle 530 of the first pulley assembly 140 (e.g., the right pulley assembly 140).

Each end portion 720 of the power cable 150 is coupled to the crossbow 100 via a post 705. Specifically, each end portion 720 of the power cable 150 is attached to a static (i.e., non-movable, rigid, fixed) post 705. The post 705 extends from or is integrally formed with the axle 530 of the pulley assembly 140. For example, each power cable 150 includes two end portions 720, where a first end portion 720 (e.g., an upper end portion 720) is coupled to a first post 705 positioned atop the axle 530 and a second end portion 720 (e.g., a lower end portion 720) is coupled to a second post 705 positioned at a bottom of the axle 530. As depicted in FIGS. 7-15 and 18-21, the posts 705 can be coaxial with the lever arm axis 200 and positioned on a top and bottom end of the axle 530. In embodiments where the end portion 720 of the power cable 150 is looped, the loop of the end portion 720 is positioned around the post 705 such that the post 705 retains (e.g., hooks) the looped end portion 720 and prevents it from separating from the axle 530. In other examples, the post 705 can be a hook, a finger, a groove, a slot, or some other retaining feature that can secure the end portion 720 of the power cable 150 to the crossbow 100. In other embodiments, the post 705 can be movable (e.g., positionally adjustable) on the crossbow 100. For example, the post 705 can extend or retract in a vertical direction (e.g., via some threaded post or sliding shaft mechanism) or translate in a horizontal direction (e.g., via some sliding mechanism).

The power cable 150 is routed from a first post 705 to the power cable journal 505, and from the power cable journal 505 to the second post 705. Specifically, a first end portion (e.g., an upper end portion 720) of the power cable 150 is coupled to a first post 705 (e.g., an upper post 705). The power cable 150 extends from the first end portion 720 to a first power cable groove 1605 (e.g., an upper power cable groove 1605) of the power cable journal 505. The power cable 150 is then coupled to the power cable journal 505 via the power cable clamp 520 and the power cable hook 920. The power cable 150 is further routed from the power cable hook 920 to the second power cable groove 1605 (e.g., a lower power cable groove 1605). From the second power cable groove 1605, the power cable 150 extends to the second post 705 (e.g., a lower post 705). The second end portion 720 (e.g., a lower end portion 720) is coupled to the second post 705. In such an arrangement, the power cable 150 substantially spans a width of the crossbow 100 and horizontally crosses the projectile axis 535. For example, the power cable 150 extends from a left side of the crossbow 100 (e.g., from the axle 530 of a left pulley assembly 140) to a right side of the crossbow 100 (e.g., to the power cable journal 505 of a right pulley assembly 140), and then back to the left side of the crossbow 100 (e.g., to the axle 530 of the left pulley assembly 140). In between the left side and the right side of the crossbow 100, the power cable 150 engages with a power cable guide 1100. The power cable guide 1100 can include a groove or track 1110 within which the power cable 150 can be routed. The power cable guide 1100 can be slidably coupled with the top plate 120 or the bottom plate 125 of the crossbow 100 with the power cable 150 routed through the power cable guide 1100. The power cable 150 is retained by the power cable guide 1100 with the power cable guide 1100 coupled to the top plate 120 or the bottom plate 125 such that the power cable 150 is routed vertically away from the projectile axis 535, the trigger box 155, or a projectile 147. For example, the power cable 150 is positioned between the power cable guide 1100 and the top plate 120 or between the power cable guide 1100 and the bottom plate 125 such that the power cable 150 is pulled against the top plate 120 or the bottom plate 125, respectively. The power cable 150 is routed away from the projectile axis 535 by the power cable guide 1100 to avoid any contact between the power cable 150 and the projectile 147 or the trigger box 155.

In other embodiments, rather than being coupled to an opposite pulley assembly 140, the end portions 720 of the power cable 150 can be coupled to an opposite limb 115. For example, the power cable 150 extends from the power cable journal 505 of the first pulley assembly 140 (e.g., a right pulley assembly 140) to an upper second limb 115 (e.g., an upper left side limb 115), where the end portion 720 of the power cable 150 is coupled with the second upper limb 115 (e.g., to a post, hook, or fastener on the second upper limb 115). The same power cable 150 extends from the power cable journal 505 of the first pulley assembly 140 (e.g., a right pulley assembly 140) to a lower second limb 115 (e.g., a lower left side limb 115), where the end portion 720 of the power cable 150 is coupled with the second lower limb 115 (e.g., to a post, hook, or fastener on the second lower limb 115). In yet other embodiments, rather than being coupled to an opposite pulley assembly 140, the end portions 720 of the power cable 150 can be coupled to the top plate 120, the bottom plate 125, the scope rail mount 165, the rail 300, or some other component of the crossbow 100. For example, the end portions 720 of the power cable 150 can be coupled to some component or a portion of a component that is positioned on an opposite side of the projectile axis 535 such that the power cable 150 extends across the projectile axis 535. In other examples, the end portions 720 of the power cable 150 can be coupled to some component or a portion of a component that is positioned on a same side of the projectile axis 535 such that the power cable 150 does not across the projectile axis 535.

In some examples, the end portion 720 of the power cable 150 is a single unlooped strand. For example, the single unlooped strand can be inserted through a hole or opening in the axle 530, the limb 115, or some other component of the crossbow 100 and secured to the respective component of the crossbow 100 via a clamp, screw, or some other compressive element. In other examples, the end portion 720 is coupled to the axle 530, the limb 115, or some other component of the crossbow 100 via a tensioning device, such as a screw tensioner device or a rachet device. The tensioning device can be actuated to increase or decrease a tensile force applied to the power cable 150 with the power cable 150 coupled to the crossbow 100. Increasing or decreasing the tensile force applied to the power cable 150 can allow a user to fine-tune the operation of the crossbow (e.g., increase or decrease a speed of the projectile 147 launched from the crossbow 100).

As depicted in FIGS. 7-15 and 18-21, the crossbow 100 includes two power cables 150. A first power cable 150 is engaged with the power cable journal 505 of a first pulley assembly 140 (e.g., a right pulley assembly 140) and a second power cable 150 is engaged with the power cable journal 505 of a second pulley assembly 140 (e.g., a left pulley assembly 140). The first power cable 150 extends from the power cable journal 505 of the first pulley assembly 140 to two posts 705 coupled to the second pulley assembly 140. Specifically, the end portions 720 of the first power cable 150 extend from the first and second power cable grooves 1605 of the power cable journal 505 of the first pulley assembly 140 and to posts 705 positioned on or proximate to the axle 530 of the second pulley assembly 140. The first power cable 150 therefore extends across the projectile axis 535 from one side of the crossbow 100 to the other side. The second power cable 150 extends from the power cable journal 505 of the second pulley assembly 140 to two posts 705 coupled to the first pulley assembly 140. The end portions 720 of the second power cable 150 extend from the first and second power cable grooves 1605 of the power cable journal 505 of the second pulley assembly 140 and to posts 705 positioned on or proximate to the axle 530 of the first pulley assembly 140. The second power cable 150 therefore extends across the projectile axis 535 from one side of the crossbow 100 to the other side.

Both the first power cable 150 and the second power cable 150 engage with the power cable guide 1100. Specifically, both the first power cable 150 and the second power cable 150 engage with a groove 1110 of an upper power cable guide 1100 slidably coupled with the top plate 120 and a groove 1110 of a lower power cable guide 1100 slidably coupled with the bottom plate 125. For example, the upper power cable guide 1100 is slidably received in a groove 1005 of the top plate 120 and the lower power cable guide 1100 is slidably received a groove 1005 of the bottom plate 125, as depicted in FIG. 10, among others. As the draw string 145 moves from the released position to the drawn position, the upper power cable guide 1100 and the lower power cable guide 1100 slide within the respective groove 1005 of the top plate 120 or the bottom plate 125. For example, the upper power cable guide 1100 and the lower power cable guide 1100 slide within the groove 1005 toward the front end 105 of the crossbow 100 as the draw string 145 moves from the released position to the drawn position. Likewise, as the draw string 145 moves from the drawn position to the released position (e.g., as the crossbow 100 is fired), the upper power cable guide 1100 and the lower power cable guide 1100 slide within the respective groove 1005 of the top plate 120 or the bottom plate 125. For example, the upper power cable guide 1100 and the lower power cable guide 1100 slide within the groove 1005 toward the rear end 110 of the crossbow 100 as the draw string 145 moves from the drawn position to the released position. Accordingly, the first power cable 150 and the second power cable 150 are both routed through grooves 1110 of the upper and lower power cable guides 1100 to move the power cables 150 vertically away from the projectile axis 535.

As depicted in FIGS. 11-21, during operation of the crossbow 100 as the draw string 145 moves from the released position to the drawn position, the pulley assembly 140 rotates such that the pulley 515 and the lever arm 560 rotate towards the projectile axis 535. Because the power cable journal 505 is, in some embodiments, positioned at least partially on an opposite side of the lever arm axis 200 from the lever arm 560, the power cable journal 505 moves away from the projectile axis 535 as the draw string 145 moves from the released position to the drawn position. As the power cable journal 505 moves away from the projectile axis 535 during rotation of the pulley assembly 140 about the lever arm axis 200, the power cable 150 wraps at least partially around the power cable journal 505 within the power cable groove 1605. According to an exemplary embodiment where the power cable journal 505 includes a first power cable groove 1605 (e.g., an upper power cable groove 1605), a second power cable groove 1605 (e.g., a lower power cable groove 1605), a first portion of the power cable 150 engaged with the first power cable groove 1605, and a second portion of the power cable 150 engaged with the second power cable groove 1605, the first and second portions of the power cable 150 wrap around the power cable journal 505 with the first portion of the power cable 150 at least partially engaged with (e.g., riding within) the first power cable groove 1605 and the second portion of the power cable 150 at least partially engaged with (e.g., riding within) the second power cable groove 1605. Further, as the first and second portions of the power cable 150 wrap onto the power cable journal 505 via the first and second power cable grooves, the first and second portions of the power cable, are displaced away from the plane 1600 (e.g., by following the at least partially helical path of the first and second power cable grooves 1605).

During operation of the crossbow 100 as the draw string 145 moves from the released position to the drawn position, the power cable 150 wraps onto the power cable journal 505 via the power cable grooves 1605. According to the exemplary embodiment depicted in FIGS. 7-15 and 18-21, among others, the first power cable 150 wraps onto the power cable journal 505 of the first pulley assembly 140 via the power cable grooves 1605 as the draw string 145 moves from the released position to the drawn position and as the first pulley assembly 140 rotates. The second power cable 150 wraps onto the power cable journal 505 of the second pulley assembly 140 via the power cable grooves 1605 as the draw string 145 moves from the released position to the drawn position and as the second pulley assembly 140 rotates. As the first and second power cables 150 wrap onto the respective power cable journals 505 via the power cable grooves 1605, a tension in the first and second power cables 150 is increased. Further, as the first power cable 150 wraps onto the power cable journal 505 of the first pulley assembly 140 via the power cable grooves 1605 as the first pulley assembly 140 rotates, a tensile force is applied to the posts 705 to which the end portions 720 of the first power cable 150 are coupled. This tensile force causes the limbs 115 to which the second pulley assembly 140 (namely the axle 530 of the second pulley assembly 140) is coupled to flex (e.g., move, bend) inward toward the projectile axis 535. Similarly, as the second power cable 150 wraps onto the power cable journal 505 of the second pulley assembly 140 via the power cable grooves 1605 as the second pulley assembly 140 rotates, a tensile force is applied to the posts 705 to which the end portions 720 of the second power cable 150 are coupled. This tensile force causes the limbs 115 to which the first pulley assembly 140 (namely the axle 530 of the first pulley assembly 140) is coupled to flex (e.g., move, bend) inward toward the projectile axis 535. As discussed above, the flexion of the limbs 115 creates potential energy to be stored in the limbs 115 that is subsequently released to launch the projectile 147 from the crossbow 100. Put another way, the power cables 150 wrap onto the power cable journals 505 as the draw string 145 moves from the released position to the drawn position to facilitate flexion of the limbs 115 toward the projectile axis 535.

During operation of the crossbow 100 as the draw string 145 moves from the released position to the drawn position, each pulley assembly 140 rotates about its respective lever arm axis 200 while each pulley 515 of each pulley assembly 140 also rotates about its respective pulley axis 400. Each pulley assembly 140 includes the pulley 515 that rotates about the pulley axis 400 in a first direction (e.g., the direction 910 for the pulley 515 of a right pulley assembly 140 or the direction 915 for the pulley 515 of a left pulley assembly 140) at the same time as the pulley assembly 140 itself rotates in the same first direction. Two rotations occur in each pulley assembly 140 substantially simultaneously: a first rotation of the pulley 515 relative to the lever arm 560 of the pulley assembly140 and a second rotation of the lever arm 560 and therefore of the pulley assembly 140 as a whole relative to the second end portions 135 of the limbs 115 to which it is coupled. For example, because each pulley assembly 140 allows this dual rotation, the amount of draw string 145 that is paid out (e.g., provided) as the pulley 515 rotates is greater than the amount of draw string that is paid out by projectile launchers having only one rotation (e.g., only rotation of a single cam per side, for example). For this reason, a length of the draw string 145 sufficient to launch the projectile 147 is paid out from the pulley 515 with a lesser rotation of the pulley 515. Accordingly, a degree of rotation of the pulley 515 during operation of the crossbow 100 as the draw string 145 moves from the released position to the drawn position is less than 200°. Specifically, the pulley 515 need only rotate by approximately 145° for the draw string 145 to be fully moved from the released position to the drawn position. Put another way, a particular power stroke length can be readily achieved with a reduced degree of rotation of the pulleys 515 as compared to crossbows using a single cam per side, for example.

As compared to conventional crossbows with a single cam per side, the reduced rotation of the pulley 515 during operation of the crossbow 100 as the draw string 145 moves from the released position to the drawn position beneficially reduces a dynamic load imposed on the components of the crossbow 100 during operation. For example, in embodiments where the pulley 515 rotates approximately (e.g., ±25%) one third as much as other crossbows (e.g., those having cams that rotate greater than 270-3600 rotation), the rotational energy of the pulley 515 is approximately (e.g., ±25%) one third that of other crossbows. This reduced rotational energy of the pulley 515 further results in a reduced flywheel energy of the pulley 515. Specifically, because flywheel energy is proportional to the square of radial velocity, the flywheel energy of the pulley 515 is approximately (e.g., ±25%) one ninth that of other crossbows. With the pulley 515 experiencing a reduced flywheel energy during operation, the pulley 515 beneficially reduces the deceleration force required to stop the pulley 515 after the crossbow 100 is fired, for example. Because the deceleration force to stop the pulley 515 is reduced, so too are the loads experienced by the draw string 145 and other components of the crossbow 100 as the crossbow 100 is fired. For example, during operation of the crossbow 100 when the projectile 147 is launched from the crossbow 100 and the draw string 145 rapidly moves from the drawn position to the released position, the pulleys 515 rapidly rotate in an opposite direction. This rapid movement imposes dynamic forces on the pulleys 515 of the pulley assemblies 140, among other components of the crossbow 100. By rotating the pulleys 515 a lesser amount (e.g., 1450 compared to 300° or more), the dynamic load imposed on the crossbow 100, the draw string 145, and other components can be substantially reduced (e.g., reduced by a factor of nine or more), which can extend the operational life of such components and decrease the frequency at which components must be replaced or serviced, for example.

The crossbow 100 includes a distance 1710 between the pulleys 515 of the first pulley assembly 140 (e.g., a right pulley assembly 140) and the second pulley assembly 140 (e.g., a left pulley assembly 140). The distance 1710 is the distance between pulley axes 400 about which the pulleys 515 of the first pulley assembly 140 (e.g., a right pulley assembly 140) and the second pulley assembly 140 (e.g., a left pulley assembly 140) rotate. With the draw string 145 in the drawn position, the distance 1710 can be less than four inches, or preferably less than three inches. In other examples, the distance 1710 with the draw string 145 in the drawn position can be greater than four inches. Comparatively, the distance 1710 can be greater than eight inches with the draw string 145 in the released position. In other examples, the distance 1710 can be between six and ten inches with the draw string 145 in the drawn position, greater than ten inches, or less than six inches. Depending on a diameter of the pulleys 515, the crossbow 100 includes an even smaller distance between radial edges of the pulleys 515. For example, and according to an exemplary embodiment, a distance between inner radial edges of the pulleys 515 is less than two inches or less than one inch. Further, portions of the draw string 145 extending rearward from the pulleys 515 are oriented at least partially parallel with the projectile axis 535. Accordingly, the draw string 145 can extend rearward from the pulleys 515 in a very narrow envelope (e.g., less than two inches side-to-side, which further enables the crossbow to be smaller or narrower than conventional crossbows.

As depicted in FIGS. 2-7, 23, 24, 27, and 30, among others, the crossbow 100 includes at least stirrup assembly 205. The stirrup assembly 205 is positioned at the front end 105 of the crossbow 100 and extends at least partially forward (e.g., in a downrange direction) of the limb bezels 197, the top plate 120, and the bottom plate 125. At least a portion of the stirrup assembly 205 can be the forward-most component of the crossbow 100 such that if the front end 105 of the crossbow 100 were to contact a surface (e.g., a ground surface), the stirrup assembly 205 would contact the surface. Referring specifically to FIGS. 23, 24, 27, and 30, the stirrup assembly 205 includes a stirrup 2325, a pad 2315, and a shaft 2320. The stirrup 2325 can be coupled to two shafts 2320, with a first end 2330 (e.g., a left end 2330) of the stirrup 2325 coupled with a first shaft 2320 and a second end 2330 (e.g., a right end 2330) of the stirrup 2325 coupled with a second shaft 2320 such that the stirrup 2325 spans the distance between the first shaft 2320 and the second shaft 2320. The pad 2315 is coupled to the shaft 2320.

The shaft 2320 is coupled with the limb bezel 197. Specifically, the limb bezel 197 includes an opening 2405 extending at least partially through the limb bezel 197. According to an exemplary embodiment, the opening 2405 extends through the limb bezel 197 in a direction that is substantially parallel (e.g., ±15° from parallel) with the projectile axis 535. The shaft 2320 is inserted through the opening 2405 such that the pad 2315 is positioned forward of the limb bezel 197. The pad 2315 can be the forward-most portion of the stirrup assembly 205 such that the pad 2315 is the first component to contact any surface or object in front of the crossbow 100. In other embodiments, the stirrup 2325 can be the forward-most portion of the stirrup assembly 205 such that the stirrup 2325 is the first component to contact any surface or object in front of the crossbow 100. The shaft 2320 is coupled to the limb bezel 197 within the opening 2405 via a fastener 3005. The fastener 3005 is a set screw or some other fastener that can be adjusted to from an outer surface of the limb bezel 197 until it at least partially protrudes into the opening 2405 of the limb bezel 197. The fastener 3005 can contact (e.g., press against) the shaft 2320 of the stirrup assembly 205 with the fastener 3005 at least partially extending into the opening 2405 of the limb bezel 197.

The stirrup 2325 of the stirrup assembly 205 is or includes an elongate bar that forms a U-like shape or some other shape such that a central portion 2335 between the first end 2330 and the second end 2330 protrudes in a forward (e.g., downrange) direction with the stirrup 2325 coupled with the shaft 2320 (e.g., coupled with the first shaft 2320 and the second shaft 2320). For example, the first end 2330 of the stirrup 2325 can be detachably coupled with the first shaft 2320 at an axial position along the first shaft 2320 that is positioned rearward (e.g., up-range) from the limb bezel 197 with which the first shaft 2320 is coupled. The second end 2330 of the stirrup 2325 can be detachably coupled with the second shaft 2320 in a similar manner. When the stirrup 2325 is coupled with the first shaft 2320 and the second shaft 2320, a movement of the first shaft 2320 and the second shaft 2320 relative to the limb bezels 197 (e.g., a first limb bezel 197 and a second limb bezel 197) can cause an equal and corresponding movement of the stirrup 2325 relative to the limb bezels 197. In this way, the stirrup 2325 can be selectively moved in a forward or rearward direction. During operation of the crossbow 100, a user can place their foot against the stirrup 2325 (e.g., step on the stirrup 2325) to brace the crossbow 100 against a ground surface to provide additional support or leverage while exerting a force to move the draw string 145 to the drawn position (e.g., to actuate the cocking mechanism 190). The stirrup 2325 can, with or without the cooperative use of the pads 2315, allow the crossbow 100 to stand upright on the front end 105, according to an exemplary embodiment.

The pad 2315 of the stirrup assembly 205 extends forward of the limb bezel 197 by a variable (e.g., adjustable) distance. For example, the fastener 3005 of the limb bezel 197 can be untightened to disengage the shaft 2320, whereupon shaft 2320 can slide (e.g., translate) within the shaft 2320 to move the pad 2315 of the stirrup assembly 205 further forward of the limb bezel 197 or toward the limb bezel 197 according to a user's preference. In this way, the stirrup assembly 205 can extend from the front end 105 of the crossbow 100 by a sufficient distance to protect the crossbow 100 or a loaded projectile 147 (e.g., a projectile coupled to the draw string 145 with the draw string in the drawn position) from damage. More specifically, the stirrup assembly 205 can prevent projectiles 147 from inadvertently contacting another object (e.g., a ground surface, a tree, a bystander), even when the projectile 147 includes a large arrowhead (e.g., a broadhead) or some other feature.

As depicted in FIGS. 3-7, 23, and 25-29, the crossbow 100 includes a projectile rest assembly 305. The projectile rest assembly 305 is coupled to a front end 2505 of the rail 300 proximate the front end 105 of the crossbow 100. More specifically, the projectile rest assembly 305 is coupled to the front end 2505 of the rail 300 via a dovetail groove or some other groove defined in the front end 2505 of the rail 300 that is configured to receive a tail (e.g., a projection, a protrusion, or some other portion) of a housing 2610 of the projectile rest assembly 305. The projectile rest assembly 305 is configured to support the projectile 147 before the projectile 147 is launched from the crossbow 100. Specifically, the projectile rest assembly 305 is configured to support the point end 1705 of the projectile 147 or a portion of a shaft of the projectile 147 that is proximate the point end 1705 of the projectile 147. The projectile rest assembly 305 supports the projectile 147 along the projectile axis 535 before the projectile 147 is launched from the crossbow 100 to improve accuracy of the crossbow 100, among other reasons.

The projectile rest assembly 305 includes a projectile rest 700 that extends vertically from the projectile rest assembly 305 and defines a notch 2340 (e.g., a "v" notch or some other notch) to support the shaft of the projectile 147. Put another way, projectile rest 700 defines the notch within which at least a portion of a shaft 1715 of the projectile 147 rests. The bottom or point of the notch 2340 can be substantially horizontally aligned (e.g., aligned left to right) with the projectile axis 535. The notch 2340 is positioned such that a projectile 147 with its shaft resting in the notch 2340 is substantially aligned vertically and horizontally with the projectile axis 535.

The projectile rest assembly 305 includes the housing 2610 that defines a cavity 2605. The cavity 2605 is accessible via an opening 2640 defined in a top surface of the housing 2610. The projectile rest assembly 305 further includes a pivot 2600 that is positioned at least partially within the cavity 2605. The pivot 2600 includes an upper region 2620 to which the projectile rest 700 is coupled via one or more fasteners, adhesive, or some other joining means. The upper region 2620 is positioned proximate the opening 2640 such that the projectile rest 700 extends vertically upward from the housing 2610. For example, in some embodiments, the upper region 2620 of the pivot 2600 extends through the opening 2640 and protrudes from the cavity 2605. In other embodiments, the upper region 2620 of the pivot 2600 is entirely within the cavity 2605 and the projectile rest 700 extends through the opening 2640 once coupled to the upper region 2620 of the pivot 2600.

Figure 27:
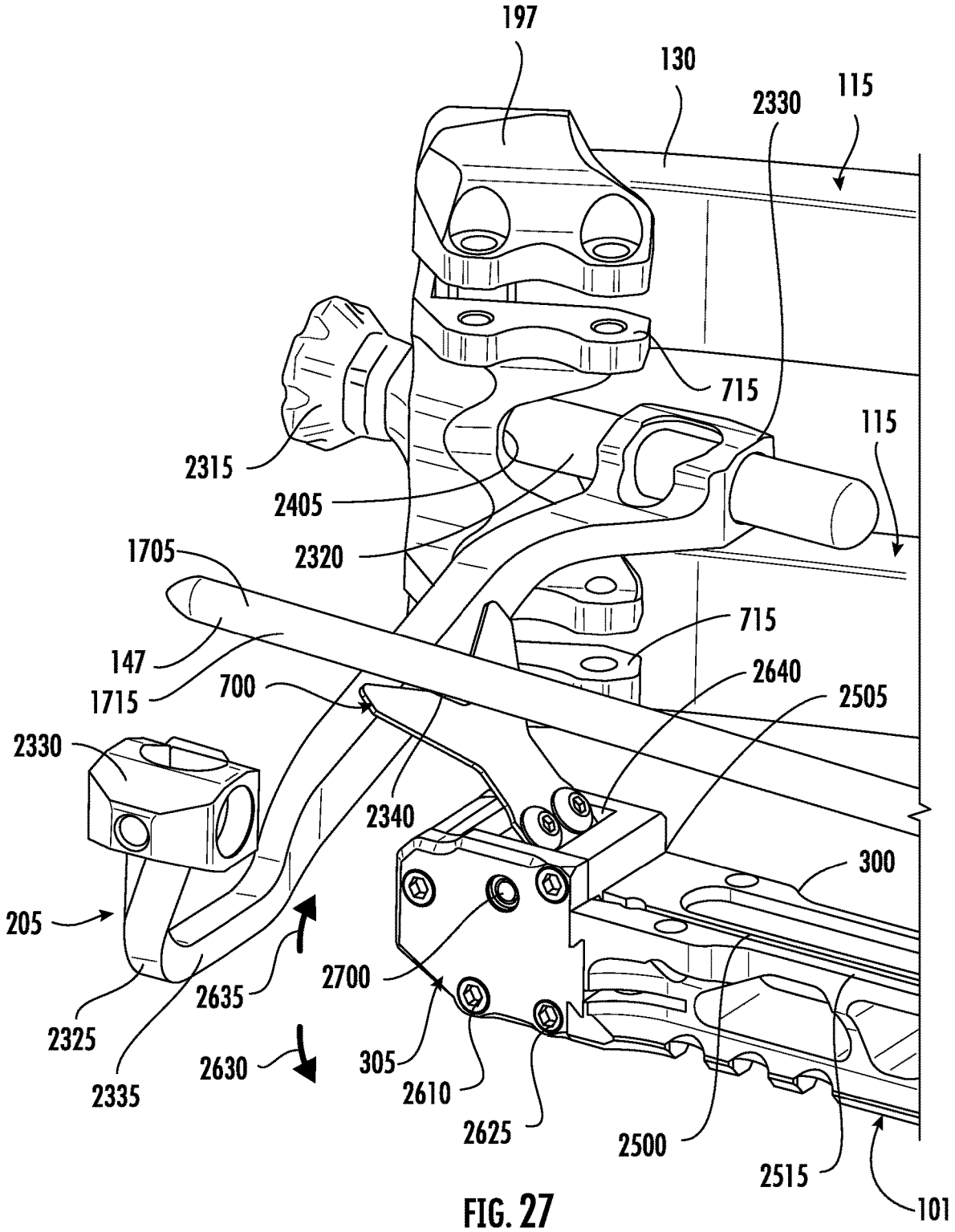
FIG. 27 is atop, left, rear perspective view of the rail and projectile rest assembly of FIG. 25 with the projectile rest supporting a projectile.
Figure 28:
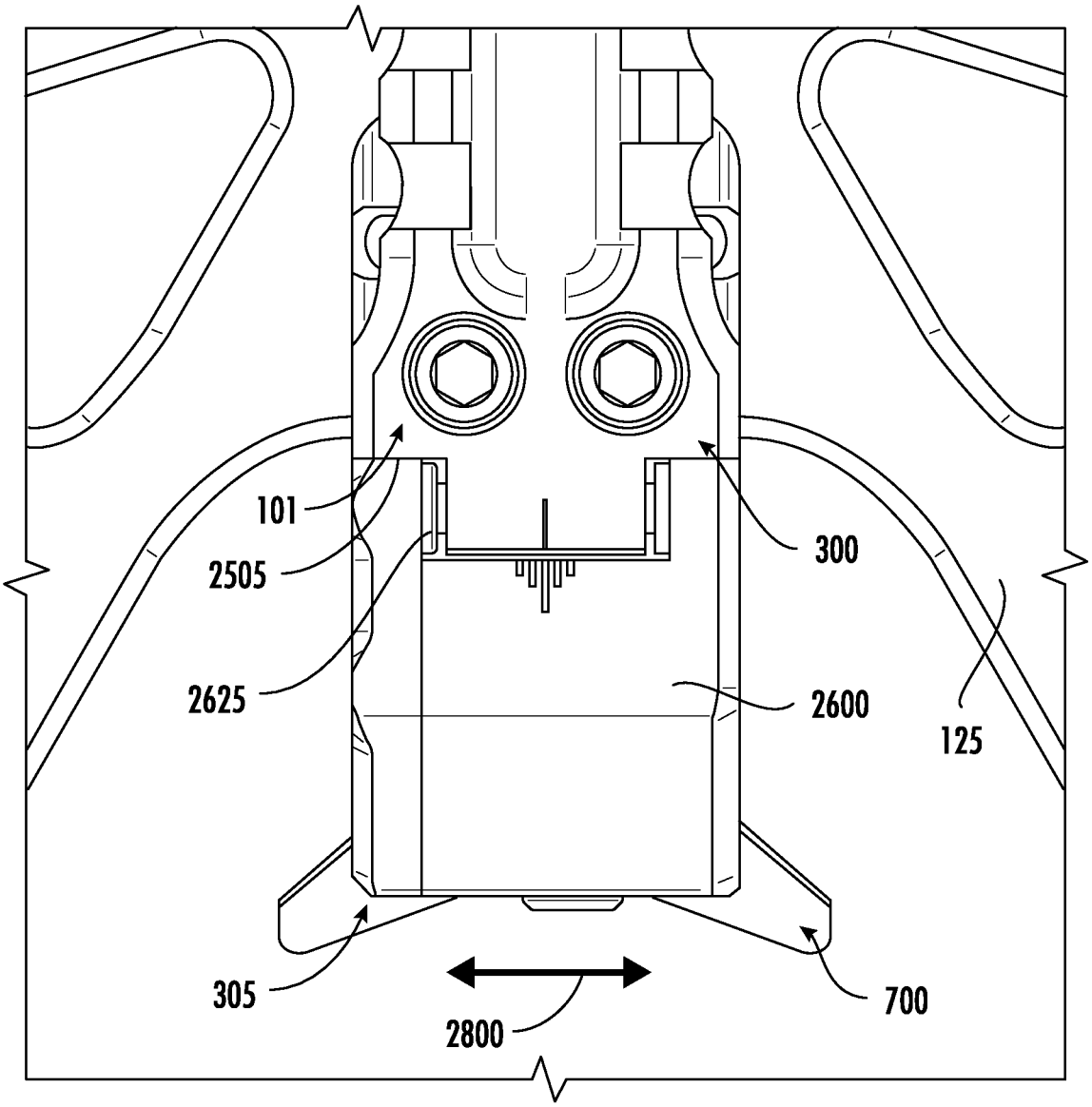
FIG. 28 is a bottom view of the rail and projectile rest assembly of FIG. 25.
Figure 29:
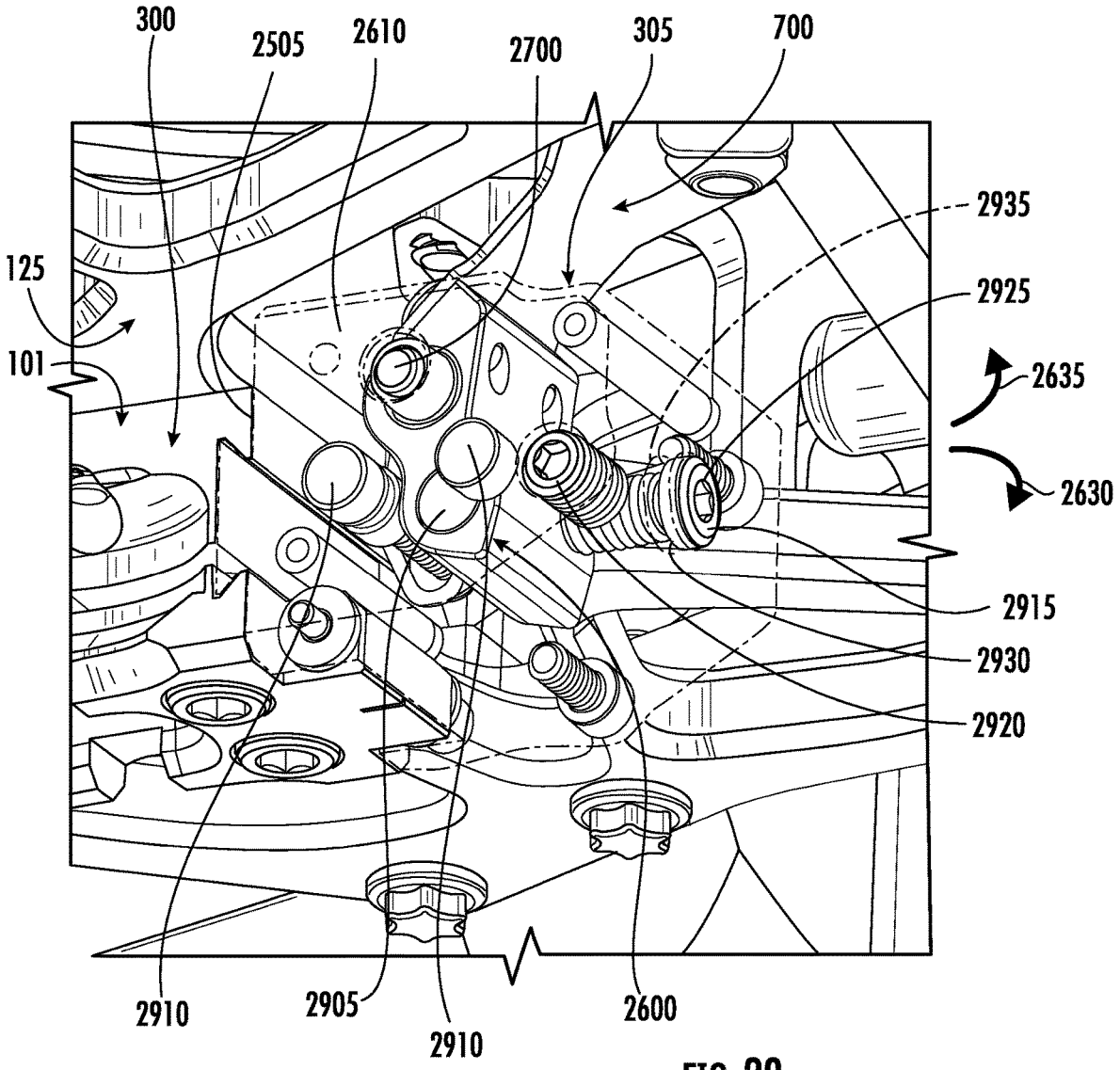
FIG. 29 is a partially transparent bottom, right, front perspective view of the projectile rest assembly of FIG. 25 with the flexible limb shown as transparent.

The pivot 2600 is rotatably coupled to the housing 2610. As depicted in FIGS. 27 and 29, among others, the pivot 2600 rotates within the cavity 2605 of the housing 2610 via a pin 2700. In some embodiments, the pin 2700 can be a pin extending from the pivot 2600 into an opening or recess of the housing 2610 within the cavity 2605. In other examples, the pin 2700 is a pin that extends from an inner surface of the housing 2610 within the cavity 2605 into an opening or recess defined in the pivot 2600. In other embodiments, the pin 2700 is a single shaft extending partially or entirely through the pivot 2600. In other embodiments, the pivot 2600 is rotatably coupled to the housing 2610 via two pins 2700, with one positioned on either horizontal size of the pivot 2600 to define a common pivot axis. The pivot 2600 rotates about the pin 2700 to vertically raise or lower the projectile rest 700, which has the effect of raising or lowering (e.g., tilting) the projectile axis 535 to vertically aim a projectile 147 launched from the crossbow 100. Specifically, the pivot 2600 rotates in the direction 2630 to lower the projectile rest 700. The pivot 2600 rotates in the direction 2635 to raise the projectile rest 700.

The pivot 2600 is weighted such that when balancing on the pin 2700 within the cavity 2605, the pivot 2600 is in a rest position with the projectile rest 700 extending upwards (e.g., to support the projectile 147). According to some examples, the pivot 2600 contacts an inner surface of the housing 2610 (e.g., a surface within the cavity 2605) with the pivot 2600 in a rest (e.g., natural) position. The projectile rest assembly 305 includes a height adjustment fastener 2915. The height adjustment fastener 2915 is accessible from outside the housing 2610 and can be rotated (e.g., threaded in or backed out) to adjust the resting position of the pivot 2600 and the projectile rest 700 coupled thereto. Specifically, height adjustment fastener 2915 is a fastener that protrudes at least partially into the cavity 2605 of the housing. The pivot 2600 contacts the height adjustment fastener 2915 with the pivot 2600 in a resting position. Accordingly, as the height adjustment fastener 2915 protrudes further into the cavity 2605 of the housing 2610 (e.g., when the height adjustment fastener 2915 is threaded into the housing 2610), the height adjustment fastener 2915 contacts the pivot 2600 to alter the resting position of the pivot 2600 and the vertical position of the projectile rest 700 coupled thereto. The height adjustment fastener 2915 includes a head 2925 defining a shoulder 2930. The shoulder 2930 can selectively contact a counterbore 2935 (e.g., ledge) defined within the housing 2610 to limit the extent to which the height adjustment fastener 2915 can be threaded into the housing 2610. For example, the shoulder 2930 of the height adjustment fastener 2915 can contact a counterbore 2935 of the housing 2610 to prevent the height adjustment fastener 2915 from being threaded too far into the housing 2610 and inadvertently falling into the cavity 2605 of the housing 2610.

The projectile rest assembly 305 includes a locking fastener 2920 to lock the position of the height adjustment fastener 2915. For example, the locking fastener 2920 can be a set screw or some other fastener that, when threaded inward, is configured to engage the height adjustment fastener 2915 to prevent inadvertent rotation of the height adjustment fastener 2915 during operation of the crossbow 100. The projectile rest assembly 305 further includes a horizontal adjustment fastener 2625. The horizontal adjustment fastener 2625 can be actuated (e.g., threaded inward or outward) to move the projectile rest assembly 305 in a horizontal direction 2800.

The projectile rest assembly 305 includes a cable attachment device 2615. In some embodiments, the cable attachment device 2615 can be an opening defined in the pivot 2600 and a corresponding fastener that can secure a cable 2520 to the pivot 2600 with the cable 2520 inserted into the opening. In other embodiments, the cable attachment device 2615 is a hook, clip, ratchet, or other device that is configured to secure a cable to the pivot 2600. The cable attachment device 2615 is positioned on the pivot 2600 such that a cable 2520 coupled to the pivot 2600 is positioned away from the pin 2700 to create a moment arm. For example, a cable 2520 attached to the pivot 2600 via the cable attachment device 2615 causes the pivot 2600 to rotate about the pin 2700 when pulled (e.g., put under tension) with a certain amount of force. According to an exemplary embodiment, the cable attachment device 2615 is coupled to a bottom of the pivot 2600 such that a tension in the cable 2520 will pull the bottom of the pivot 2600 in a rearward direction to cause the pivot 2600 to rotate in the direction 2630. In other embodiments, the cable attachment device 2615 positioned in or on some other region, area, or location of the pivot 2600.

The pivot 2600 of the projectile rest assembly 305 is operatively coupled with the power cable guide 1100 of the crossbow 100 such that actuation of the trigger 160 (e.g., pulling the trigger 160 to fire the crossbow 100) causes the pivot 2600 to rotate. The pivot 2600 is operatively coupled to the power cable guide 1100 via the cable 2520 that is connected to an aperture 1900 of the power cable guide 1100. The cable 2520 is coupled at one end to the pivot 2600 via the cable attachment device 2615. The other end of the cable 2520 is coupled, whether directly or indirectly, to the power cable guide 1100 via the aperture 1900. As the crossbow 100 is fired (e.g., as the draw string 145 moves from the drawn position to the released position), the power cable guide 1100 slides within a groove of the bottom plate 125 in either a forward or a rearward direction. For example, the power cable guide 1100 slides rapidly within the groove 1005 towards the rear end 110 of the crossbow 100 as the crossbow 100 is fired and the limbs 115 rapidly return (e.g., spring, rebound, or otherwise move) to a released position (e.g., outward). The rapid movement of the power cable guide 1100 within the groove 1005 of the bottom plate 125 causes the cable 2520 of the projectile rest assembly 305 to experience a tensile force. The tensile force in the cable 2520 of the projectile rest assembly 305 causes the pivot 2600 of the projectile rest assembly 305 to rotate and fall away from the projectile 147. For example, as the trigger 160 is actuated, the cable 2520 of the projectile rest assembly 305 experiences a tensile force. The tensile force experienced by the cable 2520 and created by movement of the power cable guide 1100 within the groove 1005 as the limbs 115 spring outward after the trigger 160 is actuated is sufficient to cause the pivot 2600 to rotate about the pin 2700 in the direction 2630. The rotation of the pivot 2600 in the direction 2630 causes a corresponding rotation of the projectile rest 700 in the direction 2630. Rotation of the projectile rest 700 in the direction 2630 causes the projectile rest 700 to drop away (e.g., separate from, move away from, retract from) the projectile 147 that is supported by the projectile rest 700. Accordingly, during operation of the crossbow 100 when the trigger 160 is actuated by a user to launch the projectile 147 from the crossbow 100, the projectile rest 700 drops away from the projectile 147 so that the projectile 147 is launched from the crossbow 100 without contacting the projectile rest 700. Because the projectile 147 is uncontacted by the projectile rest 700 when the crossbow 100 is fired, the projectile 147 can be launched from the crossbow 100 in a substantially (e.g., 95%) frictionless manner. Frictionless flight of the projectile 147 from the crossbow 100 can bolster the speed and/or force of the projectile 147 launched therefrom.

The projectile rest assembly 305 includes a magnet 2905 coupled with the pivot 2600 and a magnet 2910 coupled with the housing 2610, where the magnet 2905 and the magnet 2910 are attracted to each other. The attraction between the magnet 2905 and the magnet 2910 causes the pivot 2600 to return to an upright (e.g., a resting) position after the pivot 2600 is rotated during firing of the crossbow 100. For example, and as discussed above, the pivot 2600 and the projectile rest 700 are rotated about the pin 2700 in the direction 2630 during actuation of the trigger 160. The rotation of the pivot 2600 during firing of the crossbow 100 is at least in part based on a tension applied to the cable 2520 connecting the trigger 160 and the pivot 2600. When this tension is removed (e.g., the trigger 160 returns to a resting, unactuated position), the attraction between the magnet 2905 and the magnet 2910 causes the pivot 2600 and the projectile rest 700 to rotate about the pin 2700 in the direction 2635. Specifically, after the projectile 147 is launched from the crossbow 100, the magnetic attraction between the magnet 2905 and the magnet 2910 cause the pivot 2600 to rotate in the direction 2635 to return the pivot 2600 and the projectile rest 700 to an upright and resting position where the projectile rest 700 is ready to support another projectile 147.

The crossbow 100 includes the rail 300 having a channel 2500 and an accessory groove 2510. The accessory groove 2510 is a groove machined or formed in the rail to facilitate coupling of an accessory (e.g., a foregrip) to the crossbow 100. For example, the crossbow 100 includes multiple accessory grooves 2510 formed substantially along a length of the rail 300 or along a portion of the rail 300 forward of the trigger 160. The channel 2500 is a groove, slot, or passageway formed along a top surface 2515 of the rail 300. According to an exemplary embodiment, the channel 2500 extends along the top surface 2515 of the rail 300 from the front end 2505 of the rail 300 to the trigger 160 of the crossbow 100. In other examples, the channel 2500 extends along the top surface 2515 of the rail 300 from the front end 2505 to the cocking mechanism 190 positioned proximate the rear end 110 of the crossbow 100. The channel 2500 is configured to receive a cable. Specifically, the channel 2500 is configured to receive a cable that is routed from the pivot 2600 of the projectile rest assembly 305 to the trigger 160 or cocking mechanism 190 to operatively couple the pivot 2600 with the trigger 160 or cocking mechanism 190, respectively. As noted above, a cable coupled to the pivot 2600 can, when under sufficient tension, cause the pivot 2600 to rotate in the direction 2630 to cause the projectile rest 700 to drop away from the projectile 147. Because the channel 2500 is positioned along the top surface 2515 of the rail 300, a cable can coupled to the pivot 2600 of the projectile rest assembly 305 and routed to the trigger 160 or cocking mechanism 190 before the bottom plate 125 is coupled to the rail 300. The cable can be captured between the rail 300 and the bottom plate 125 with the bottom plate 125 coupled to the rail 300.

Figure 31:
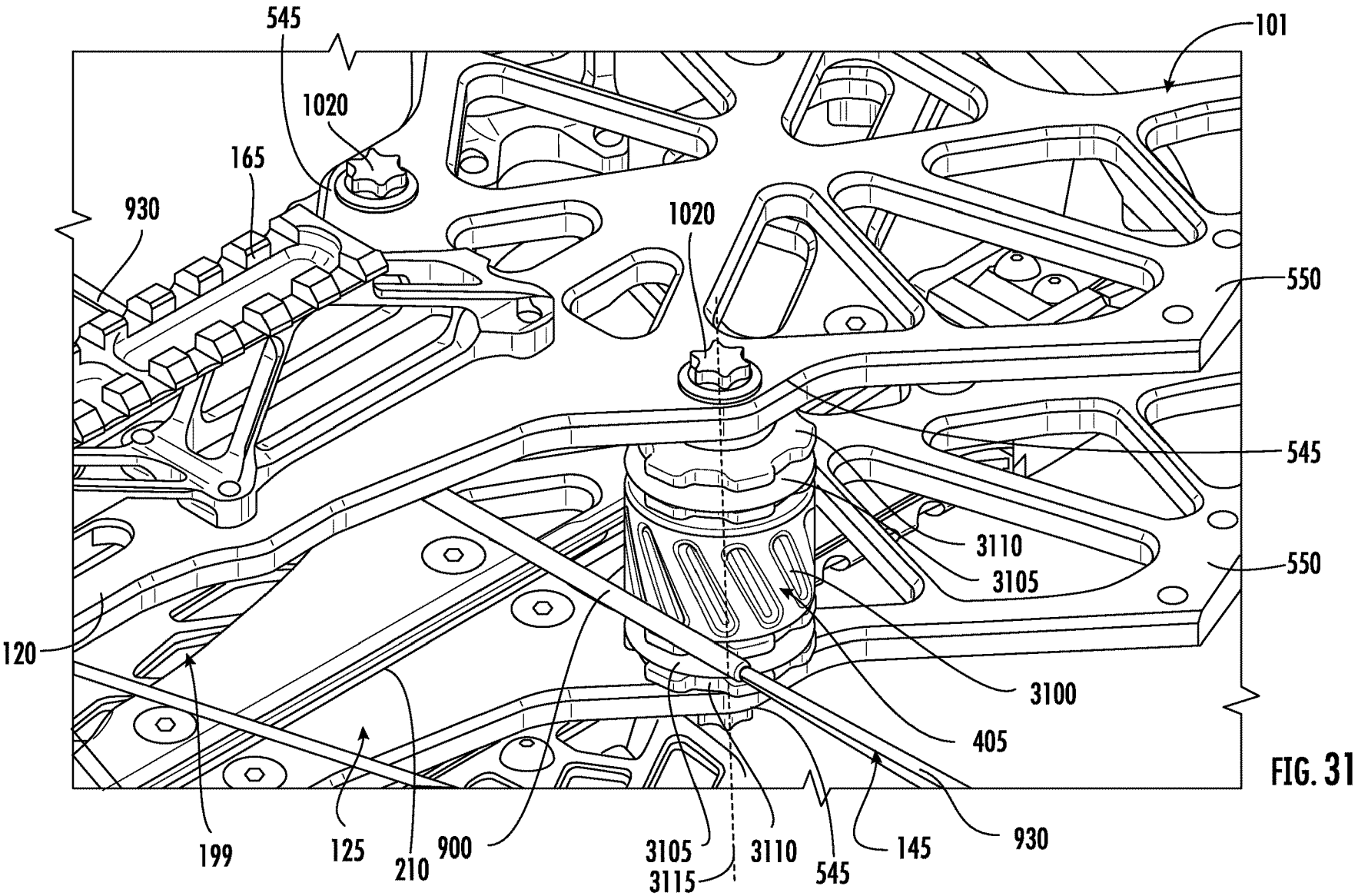
FIG. 31 is a top, right, rear perspective view of a string stop assembly of the projectile launcher of FIG. 1A.

As depicted in FIGS. 4A, 4B, 7, 8, 10, 11, 23, 24, and 31, among others, the crossbow 100 includes a string stop 405. The string stop 405 is positioned between the top plate 120 and the bottom plate 125. As noted above, the string stop 405 is positioned between the second mounting location 545 of the top plate 120 and the second mounting location 545 of the bottom plate 125. The string stop 405 can be positioned at least partially around the column 1020 that couples the second mounting location 545 of the top plate 120 with the second mounting location 545 of the bottom plate 125. The string stop 405 includes a sleeve 3100, a ring 3105, and a core 3110. The sleeve 3100, the ring 3105, and the core 3110 are be positioned along a string stop axis 3115. Specifically, the sleeve 3100, ring 3105, and core 3110 are stacked coaxially about the string stop axis 3115. The string stop axis 3115 is coaxial with an axis of column 1020 that couples the top plate 120 to the bottom plate 125 at the second mounting location 545. As depicted in FIG. 31, among others, the string stop 405 includes one core 3110 that is received in an opening of the sleeve 3100 and protrudes from a top end and a bottom end of the sleeve 3100. The core 3110 includes two radial grooves positioned to both the top and bottom end of the sleeve 3100. For example, the core 3110 includes an upper radial groove and a lower radial groove where the upper radial groove is positioned vertically above the sleeve 3100 and the lower radial groove positioned vertically below the sleeve 3100. The string stop 405 includes two rings 3105 received in the two radial grooves of the core 3110. Specifically, the string stop 405 includes a first ring 3105 received in the upper radial groove of the core 3110 and a second ring 3105 received in the lower radial groove of the core 3110. The sleeve 3100 includes a durable, wear resistant elastomer (e.g., urethane or a similar material). The core 3110 includes a soft, dampening elastomeric material (e.g., Sorbothane or a similar material). The rings 3105 include a rigid, heavy material (e.g., stainless steel or a similar material). Each of the sleeve 3100, the rings 3105, and the core 3110 are generally cylindrical in shape. In other examples, the sleeve 3100, the rings 3105, and the core 3110 include some other form factor (e.g., octagonal, hexagonal, rectangular, or some other shape).

The string stop 405 is positioned forward of the draw string 145. Specifically, the string stop axis 3115 is positioned forward of the draw string 145 with the draw string 145 in the released position. The string stop axis 3115 is positioned forward of the draw string 145 by a distance that is approximately (e.g., ±5%) equal to a radius of the sleeve 3100 of the string stop 405. For example, the sleeve 3100 is positioned forward of the draw string 145 such that the draw string 145 rests against or proximate to (e.g., within one inch) of an outer surface of the sleeve 3100 with the draw string 145 in the released position. During operation of the crossbow 100, the string stop 405 is configured to arrest the forward movement of the draw string 145. Specifically, when the draw string 145 moves from the drawn position to the released position, force acting upon the draw string 145 by the limbs 115 causes the draw string 145 to contact (e.g., strike) the sleeve 3100 of the string stop 405. The elastomeric sleeve 3100 of the string stop 405 receives an impact force imparted by the draw string 145 that is absorbed by the soft, dampening core 3110 positioned within the sleeve 3100. In this way, the core 3110 and the sleeve 3100 act to absorb a shock associated with impact of the draw string 145 on the string stop 405 to reduce a magnitude of a force experienced by other components of the crossbow 100, which can reduce wear or damage of components of the crossbow 100. Because the string stop 405 prevents the draw string 145 from moving forward (e.g., to a position beyond a forward position of the draw string 145 when the draw string 145 is in the released position), the string stop 405 prevents the draw string 145 from colliding other components of the crossbow 100, for example. Further, the rings 3105 dampen residual vibrations by acting as a weighted dampener. Because the string stop 405 includes a circular cross-sectional shape (in some embodiments), sleeve 3100, the rings 3105, and the core 3110 are each individually and collectively repositionable about the string stop axis 3115. Accordingly, the string stop 405 or components thereof can be radially repositioned about the string stop axis 3115 so that if any wear occurs where the string makes contact, an unworn or lesser worn portion of the string stop 405 can be positioned to contact the draw string 145 and correspondingly receive the impact force imparted by the draw string 145.

Figure 32:
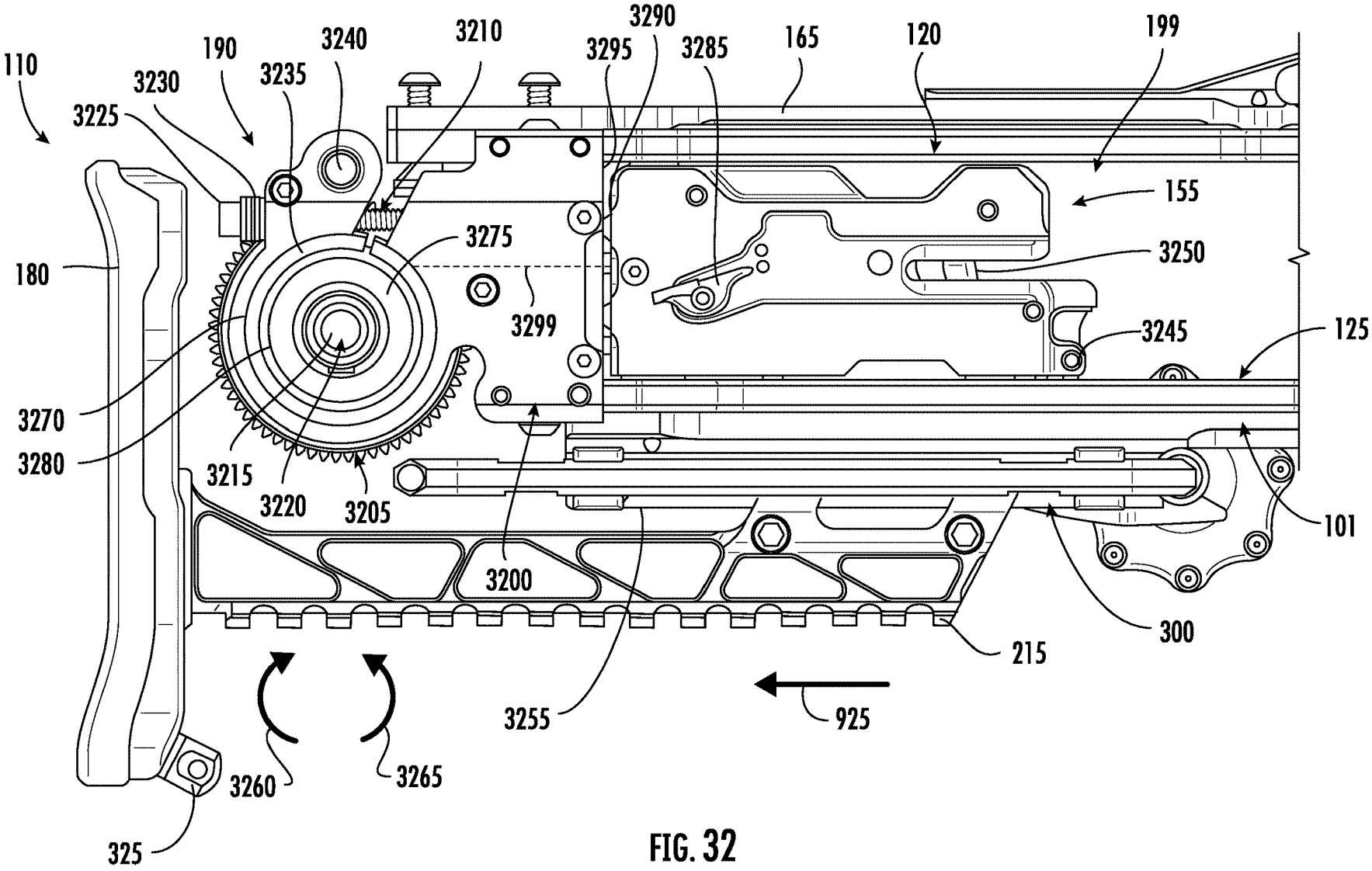
FIG. 32 is a right side view of a cocking mechanism and trigger box of the projectile launcher of FIG. 1A.
Figure 33:
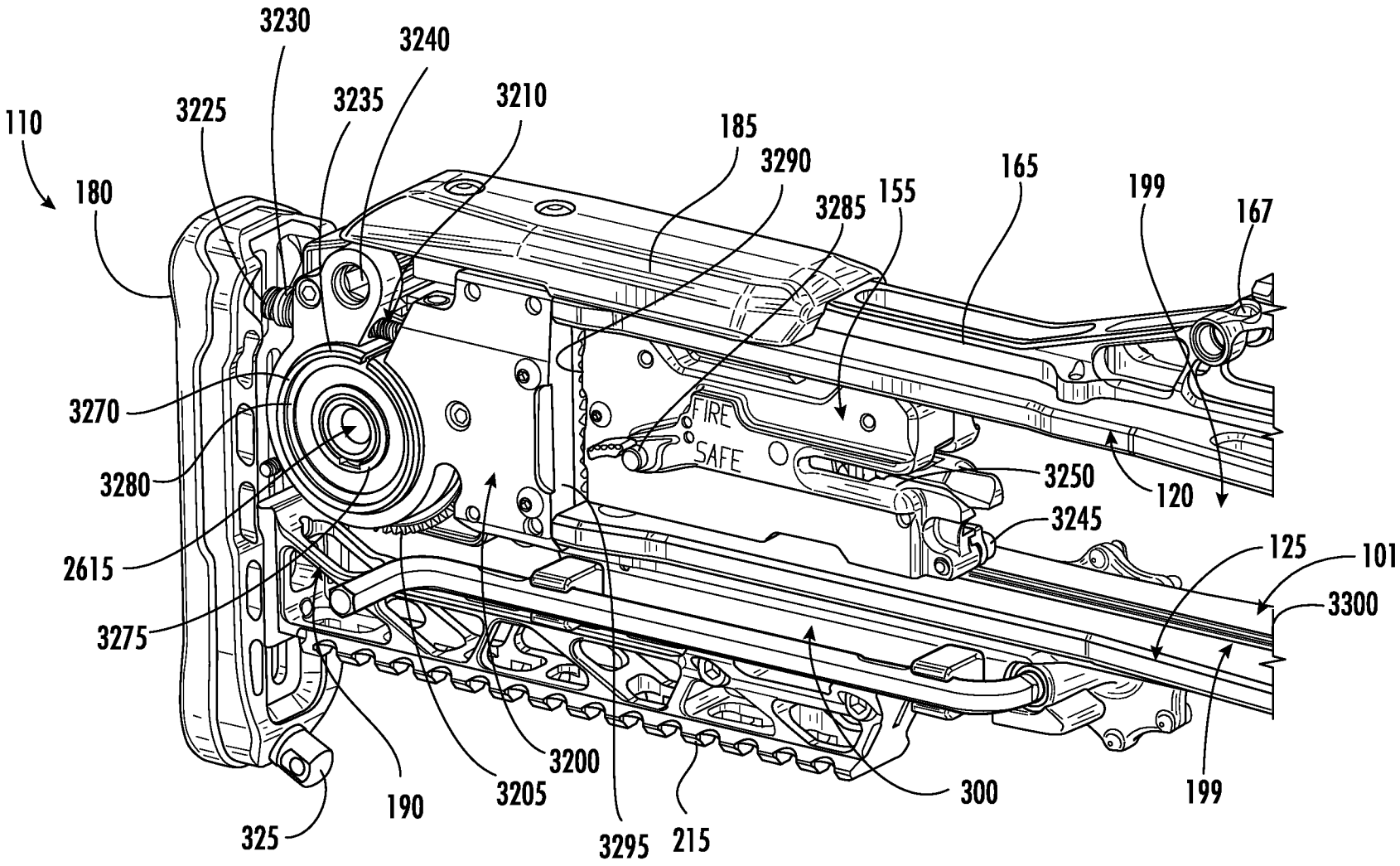
FIG. 33 is a right front perspective view of the cocking mechanism and trigger box of FIG. 32.
Figure 34:
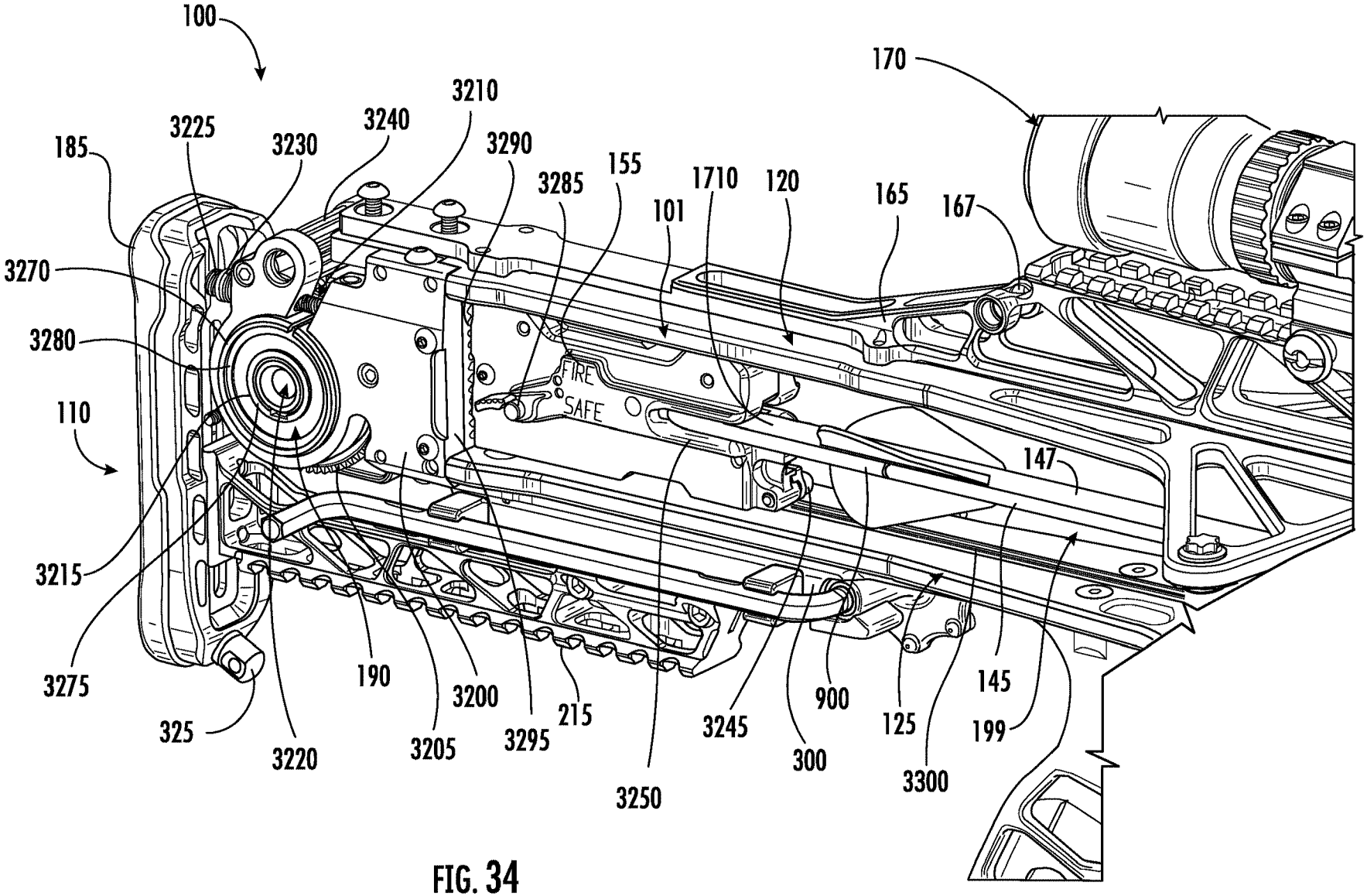
FIG. 34 is a right front perspective view of the cocking mechanism and trigger box of FIG. 32 with the trigger box engaged with a projectile.

As depicted in FIGS. 32-34, among others, the crossbow 100 includes the trigger box 155 to selectively couple to the draw string 145. For example, the trigger box 155 can be like the trigger box discussed in U.S. Pat. No. 9,494,379, which is incorporated herein by reference in its entirety. The trigger box 155 includes a string catch 3250, a safety switch 3285, and a rear end 3290. The string catch 3250 is configured to latch to (e.g., hook onto) the draw string 145 with the draw string 145 in the released position. After the string catch 3250 of the trigger box 155 is latched to the draw string 145, the trigger box 155 can move (e.g., slide) rearward towards the rear end 110 of the crossbow 100. As is discussed in detail below, the trigger box 155 can be moved toward the rear end 110 of the crossbow 100 via the cocking mechanism 190 (e.g., via a tether, cable, rope, cord, or other windable element). With the trigger box 155 in rearward position (e.g., a cocked position, a drawn position), the draw string 145 can be in the drawn position. As noted above, the limbs 115 are flexed and store potential energy when the draw string 145 is in the drawn position. The trigger box 155 selectively disengages with the draw string 145 to release the draw string 145 back to the released position from the drawn position. Specifically, the trigger 160 of the crossbow 100 can be actuated (e.g., depressed, rotated, pulled) by a user. The trigger 160 is coupled to the string catch 3250 such that actuation of the trigger 160 causes the string catch 3250 to release the draw string 145. The safety switch 3285 can be coupled with a safety (e.g., a safety 4325 shown in FIG. 43) to selectively prohibit movement of the string catch 3250, as is discussed in detail below with reference to FIG. 43. By releasing the draw string 145 with the draw string 145 in the drawn position, the potential energy stored in the flexed limbs 115 is released to propel the draw string 145 forward and back to the released position. The projectile 147 is launched from the crossbow 100 via the movement of the draw string 145 from the drawn position to the released position. Accordingly, the selective actuation of the trigger 160 causes the trigger box 155 to release the draw string 145 to propel the projectile 147 forward from the front end 105 of the crossbow 100.

Figure 39:
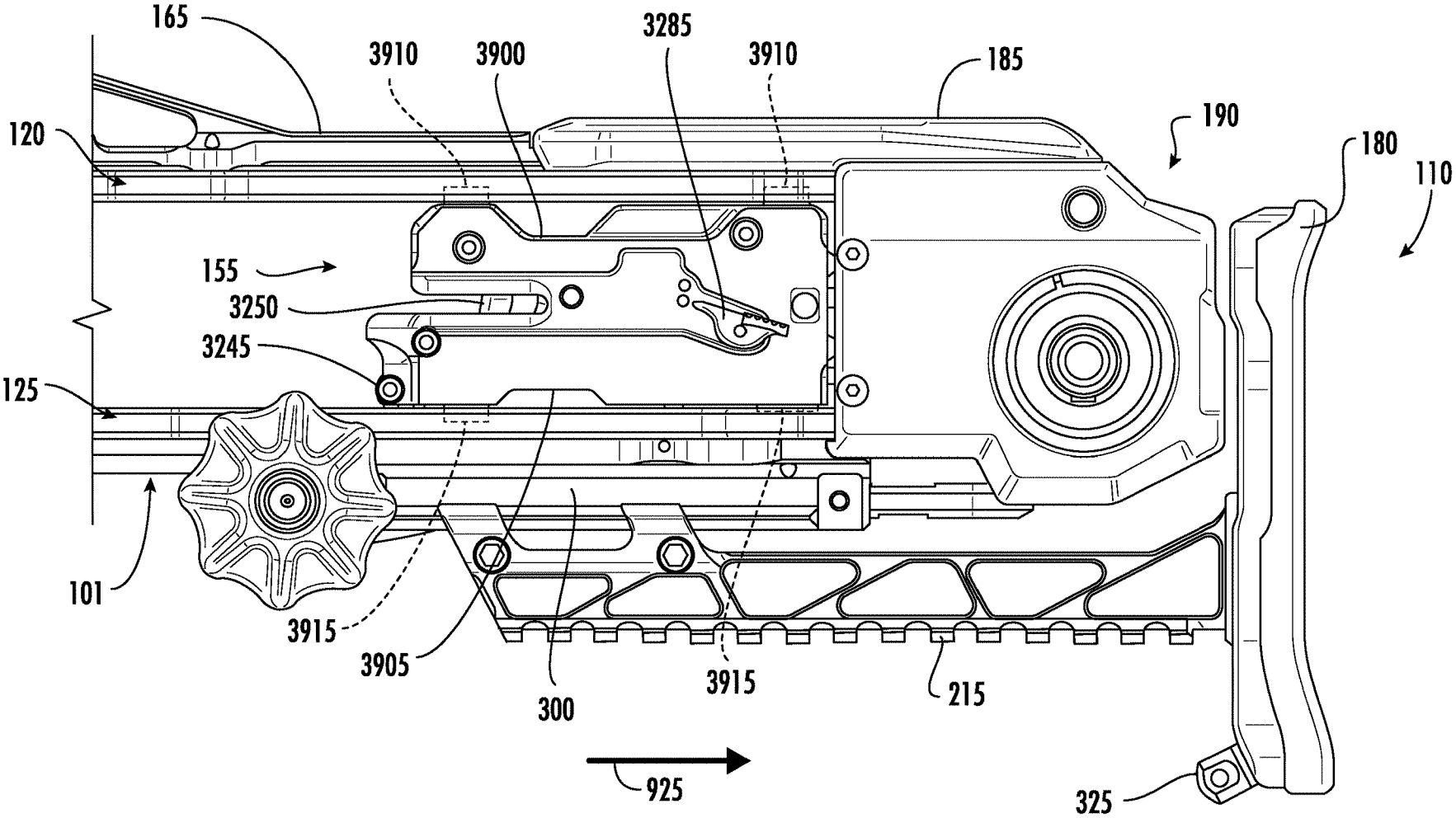
FIG. 39 is a left side view of the trigger box of FIG. 32.
Figure 40:
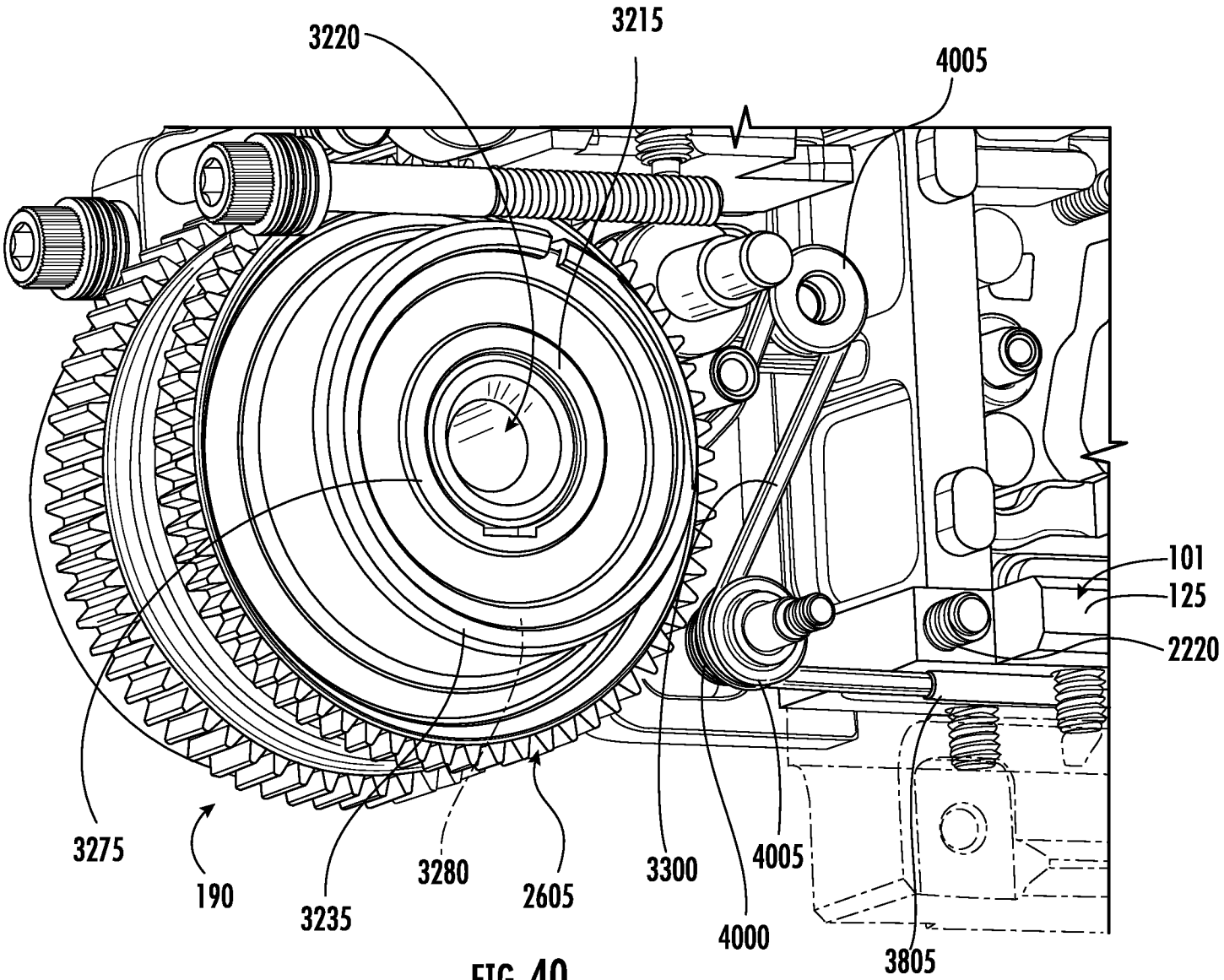
FIG. 40 is a bottom, right, rear perspective view of the cocking mechanism of FIG. 32.

The trigger box 155 is slidably engaged with the top plate 120 and the bottom plate 125. The trigger box 155 is located between the top plate 120 and the bottom plate 125 within the opening 199. As is shown in detail in FIG. 39, among others, the trigger box 155 includes an upper surface 3900 and an opposite lower surface 3905. The upper surface 3900 of the trigger box 155 is positioned proximate the top plate 120 and the lower surface 3095 of the trigger box 155 is positioned proximate the bottom plate 125 with the trigger box 155 positioned between the top plate 120 and the bottom plate 125. In some embodiments, the trigger box 155 includes an upper protrusion 3910 (e.g., projection, finger, prong, extension) extending from the upper surface 3900 and a lower protrusion 3915 (e.g., projection, finger, prong, extension) extending from the lower surface 3905. The upper protrusion 3910 is received within the slot 210 of the top plate 120 and the lower protrusion 3915 is received within the slot 210 of the bottom plate 125. During operation of the crossbow as the trigger box 155 moves from the forward position to the rearward position or from the rearward position to the forward position, the upper protrusion 3910 slides within the slot 210 of the top plate 120 and the lower protrusion 3915 slides within the slot 210 of the bottom plate 125. One or more of the upper protrusion 3910, the lower protrusion 3915, the upper surface 3900 and the lower surface 3905 of the trigger box 155 can include a friction-reducing element, such as Delrin plastic, grease, lubricant, or some other material to reduce friction as between the trigger box 155 and the top plate 120 or bottom plate 125. In some examples, the top plate 120 or the bottom plate 125 can include a protrusion (e.g., projection, finger, prong, extension) that engages (e.g., slides within) a slot or groove formed within the upper surface 3900 or the lower surface 3905 of the trigger box 155.

The trigger box 155 is operatively coupled with the cocking mechanism 190. The cocking mechanism 190 is positioned at or proximate to (e.g., within 10 inches of) the rear end 110 of the crossbow 100. The cocking mechanism 190 is coupled to the top plate 120. In various examples, the cocking mechanism 190 is coupled to the bottom plate 125, the rail 300, and/or the scope rail mount 165. Specifically, the cocking mechanism 190 is coupled to a rear mounting location 2200 of the top plate 120, a rear mounting location 2205 of the bottom plate 125, and a rear end 3255 of the rail 300, as shown in FIG. 32, among others. As depicted in detail in FIGS. 32-40 and 43, among others, the cocking mechanism 190 includes a housing 3200, a spool 3205, a gear 3240. The spool 3205 and the gear 3240 include gear teeth that mesh such that the gear 3240 and the spool 3205 are operatively coupled. For example, rotation of the gear 3240 is configured to cause rotation of the spool 3205. The spool 3205 includes a larger diameter than the gear 3420 such that a rotation of the gear 3240 causes less than a full rotation of the spool 3205. During operation of the crossbow 100, the gear 3240 is rotated by a user (e.g., via a handle or knob) in a first direction 3260, which causes a corresponding rotation of the spool in a second direction 3265 that is opposite the first direction 3260. Rotation of the gear 3240 in the first direction 3260 and the corresponding rotation of the spool 3205 in the second direction 3265 causes the draw string 145 to move from the released position to the drawn position. Rotation of the gear 3240 in the second direction 3265 and a corresponding rotation of the spool 3205 in the first direction 3260 causes the draw string 145 to move from the drawn position to the released position, as is discussed in detail below.

Figure 35:
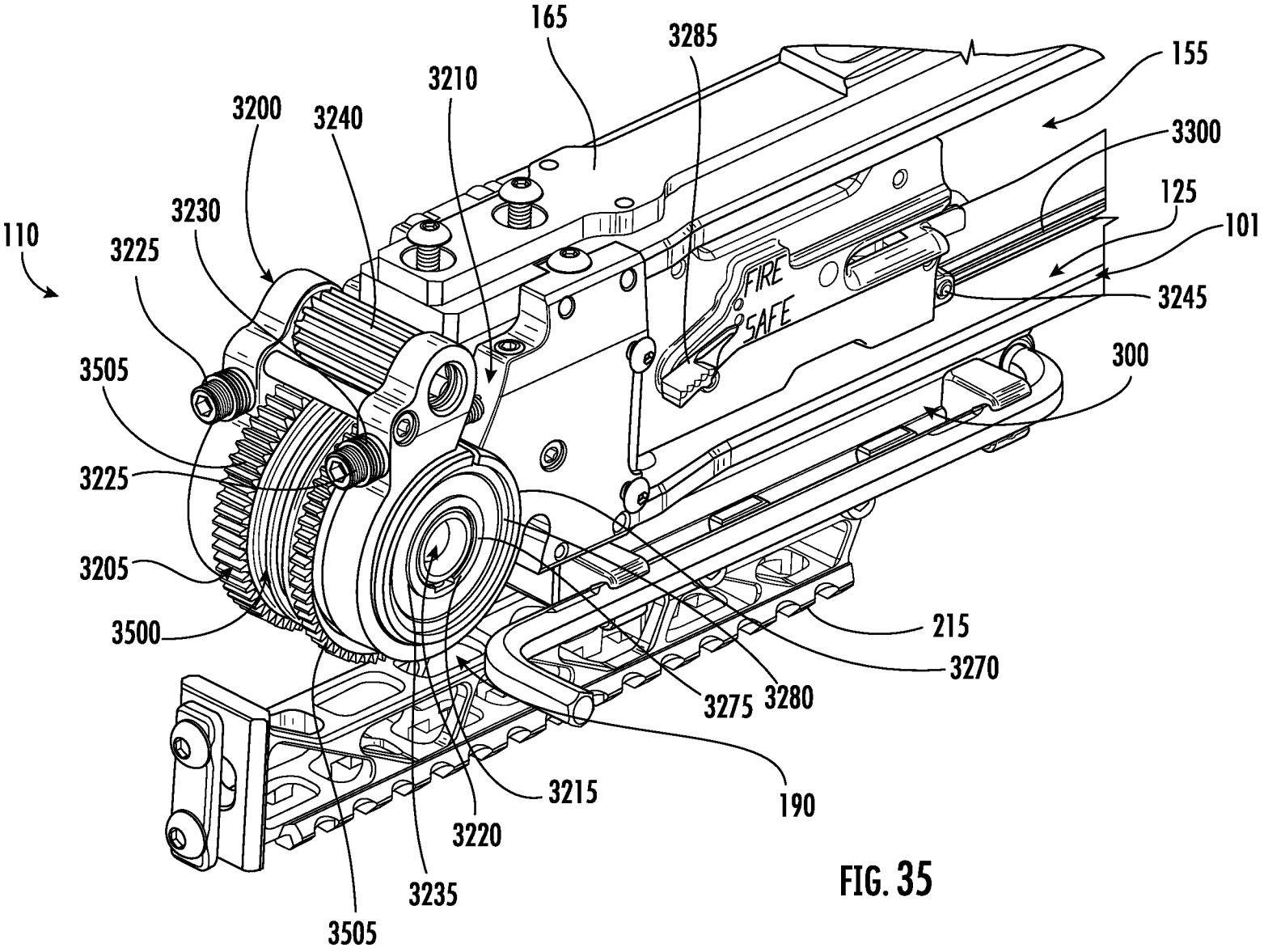
FIG. 35 is atop, right, rear perspective view of cocking mechanism of FIG. 32.
Figure 43:
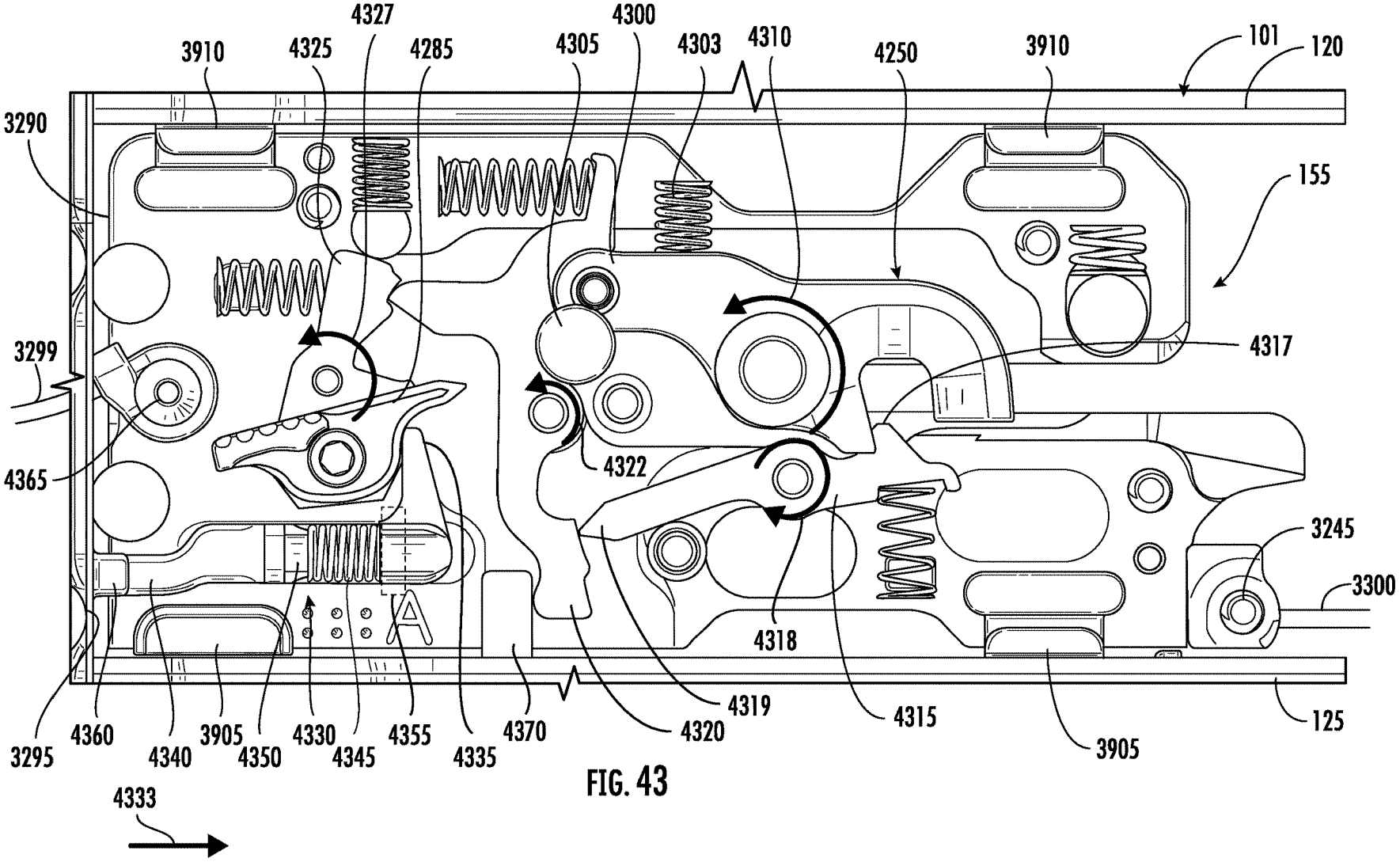
FIG. 43 is a partial view of the trigger box of the projectile launcher of FIG. 1A showing a portion of the contents of the trigger box.

The cocking mechanism 190 includes a tether 3299 (e.g., rope, web, band, strap, string, cord, cable, or other element) that is coupled to the spool 3205 and to the trigger box 155. The tether 3299, as shown in FIGS. 32 and 43, is coupled to the trigger box 155. The tether 3299 is removably coupled to a fastener 4365 of the trigger box 155. For example, the tether 3299 can be tied to, wound around, knotted to, or otherwise coupled to the fastener 4365, where removal or loosening of the fastener 4365 can permit a user to remove the tether 3299 from the trigger box 155 for replacement or other service. In other examples, the fastener 4365 is a pin or other element of the trigger box 155 that is not removable from the trigger box 155 such that decoupling of the tether 3299 from the trigger box 155 requires untying or unknotting the tether 3299 from the fastener 4365. The tether 3299 is configured to wind about the spool 3205 within a tether recess 3500, as depicted in FIG. 35, among others. For example, during operation of the crossbow 100 as the spool 3205 rotates in the second direction 3265 (e.g., as the user rotates the gear 3240 in the first direction 3260), the tether 3299 will wind within the tether recess 3500 of the spool 3205, which in turn will pull the trigger box 155 in the direction 925. According to an exemplary embodiment, the tether 3299 can include multiple strands or parallel segments, where each strand or segment is wound in a respective tether recess 3500 defined in the spool 3205. As depicted in FIG. 35, among others, the spool 3205 includes two tether recesses 3500, where each tether recess 3500 is configured to receive a strand or segment of the tether 3299. As discussed above, movement of the trigger box 155 in the direction 925 moves the draw string 145 from the released position to the drawn position when the trigger box 155 (e.g., string catch 3250 of the trigger box 155) is engaged with the draw string 145. Accordingly, rotation of the spool 3205 in the second direction 3265 causes the draw string 145 to move from the released position to the drawn position. As shown in FIG. 35, among others, the spool 3205 includes the tether recesses 3500 positioned between two gear portions 3505. The gear portions 3505 of the spool 3205 engage (e.g., mesh) with the gear 3240. When the draw string 145 is in the drawn position, a rear end 3290 of the trigger box 155 can be positioned against or proximate to a wall 3295 of the cocking mechanism 190. For example, as is discussed in detail below with reference to FIG. 43, among others, the rear end 3290 of the trigger box 155 can abut or be positioned within some threshold distance of the wall 3295 when the draw string 145 is in the drawn position.

The spool 3205 includes a center shaft 3220. The center shaft 3220 is concentric about an axis 3610 depicted in FIG. 36, among others. The cocking mechanism 190 includes a one-way bearing 3215 positioned at least partially around the center shaft 3220 and rotationally coupled with the spool 3205. For example, a rotation of the center shaft 3220 (e.g., a rotation of the spool 3205) causes an inner bearing element 3275 (e.g., a bearing race) to rotate with the center shaft 3220. The center shaft 3220 is keyed with the inner bearing element 3275 or otherwise engaged with the inner bearing element 3275. An outer bearing element 3280 of the one-way bearing 3215 is engaged with a drum brake 3235. Specifically, the drum brake 3235 is positioned around the one-way bearing 3215 such that the outer bearing element 3280 of the one-way bearing 3215 is engaged with the drum brake 3235. The drum brake 3235 is coupled with the housing 3200 such that the drum brake 3235 does not rotate but instead remains substantially stationary within the housing 3200. Specifically, the drum brake 3235 is positioned within a bore 3270 of the housing 3200. The drum brake 3235 includes a spring coefficient that causes the drum brake 3235 to press against the housing 3200. For example, the drum brake 3235 has a variable diameter that substantially matches a diameter of the bore 3270 of the housing 3200. As the bore 3270 of the housing 3200 changes in diameter, so too does the drum brake 3235.

The one-way bearing 3215 prevents rotation of the spool 3205 in the first direction 3260 while freely permitting rotation in the second direction 3265. For example, the inner bearing element 3275 of the one-way bearing 3215 allows the center shaft 3220 of the spool 3205 to rotate in the second direction 3265, but the inner bearing element 3275 of the one-way bearing 3215 interacts with the outer bearing element 3280 of the one-way bearing 3215 to prevent rotation of the center shaft 3220 of the spool 3205 in the first direction 3260. Because the spool 3205 and the gear 3240 are operatively coupled (e.g., meshed), the one-way bearing 3215 prevents rotation of the gear 3240 in the second direction while freely permitting rotation of the gear 3240 in the first direction 3260. During operation of the crossbow as a user actuates the gear 3240 (e.g., rotates the gear 3240 in the first direction 3260) to move the trigger box 155 (and draw string 145 engaged therewith) in the direction 925, the one-way bearing 3215 can prevent rotation of the spool 3205 in the first direction, which prevents the trigger box 155 from moving forward by a force exerted by the limbs 115 via the draw string 145. In other words, the one-way bearing 3215 acts to prevent any movement of the trigger box 155 in the forward direction until a user intentionally decocks the crossbow 100, as discussed below.

The cocking mechanism 190 includes a tensioner 3225 and a compressive element 3230. The tensioner 3225 is coupled to the housing 3200 and is configured to adjust the width of an opening 3210 of the housing 3200. The opening 3210 is a slot or gap in the housing that extends to the bore 3270 of the housing 3200. For example, the tensioner 3225 engaged with the housing 3200 such that the tensioner 3225 at least partially closes the opening 3210 of the housing 3200 when adjusted (e.g., actuated, turned) in a first direction and at least partially expands the opening 3210 of the housing 3200 when adjusted (e.g., actuated, turned) in a second direction. The tensioner 3225 is engaged with the housing 3200 with the compressive element 3230 disposed at least partially therebetween. For example, in one example the compressive element 3230 is a Belleville washer or a stack of multiple Belleville washers that are provided over a shank of the tensioner 3225 (e.g., when the tensioner 3225 is a screw or bolt). Expanding the opening 3210 causes a diameter of the bore 3270 to increase. Closing the opening 3210 causes the diameter of the bore 3270 to decrease.

As noted above, the drum brake 3235 is positioned within the bore 3270 of the housing 3200 and includes a diameter that, because of a spring coefficient (e.g., a spring bias) of the drum brake 3235, changes as a diameter of the bore 3270 changes. Accordingly, the tensioner 3225 can be used to at least partially close the opening 3210 of the housing 3200 to reduce a diameter of the drum brake 3235. Likewise, the tensioner 3225 can be used to at least partially expand the opening 3210 of the housing 3200 to increase a diameter of the drum brake 3235.

During operation of the crossbow 100, a force applied by a user to rotate the gear 3240 in the second direction 3265 causes the opening 3210 of the housing 3200 to expand (e.g., increase). When the opening 3210 of the housing 3200 expands, so too does the diameter of the bore 3270 of the housing 3200. As discussed above, a diameter of the drum brake 3235 increases substantially proportionally (e.g., ±15%) as the diameter of the bore 3270 increases. As the diameter of the drum brake 3235 increases, the drum brake 3235 disengages from the one-way bearing 3215 positioned within the drum brake 3235. Specifically, when a diameter of the drum brake 3235 increases beyond some threshold diameter as the drum brake 3235 expands within the bore 3270 of the housing 3200, an inner surface of the drum brake 3235 separates from the outer bearing element 3280 of the one-way bearing 3215. With the outer bearing element 3280 of the one-way bearing 3215 disengaged from the drum brake 3235, the one-way bearing 3215 (e.g., the inner bearing element 3275 and the outer bearing element 3280 are permitted to rotate freely with the spool 3205. Specifically, with the outer bearing element 3280 of the one-way bearing 3215 disengaged from the drum brake 3235, the one-way bearing 3215 (e.g., the inner bearing element 3275 and the outer bearing element 3280) is permitted to rotate freely with the spool 3205 in the first direction 3260. Rotation of the spool 3205 in the first direction 3260 causes the tether 3299 to unwind from the tether recess 3500 of the spool 3205, which can further permit the trigger box 155 to travel from in a forward direction (e.g., a direction opposite the direction 925).

Because the drum brake 3235 can be selectively disengaged from the one-way bearing 3215, the cocking mechanism 190 facilitates selective decocking of the crossbow 100. For example, if during operation of the crossbow 100 the draw string 145 is moved to the drawn position but a user decides not to fire the crossbow 100, the user can rotate the gear 3240 (e.g., via a cocking handle) in the second direction 3265, where a force exerted by the user to rotate the gear 3240 in the second direction 3265 causes the opening 3210 of the housing 3200 to expand slightly and momentarily disengage the drum brake 3235 from the one-way bearing 3215. More specifically, because the one-way bearing 3215 will initially prevent rotation of the gear 3240 in the second direction 3265 (and correspondingly prevent rotation of the spool 3205 in the first direction 3260), a force exerted by the user (or a horizontal component of the force exerted by the user) in effort to rotate the gear 3240 in the second direction 3265 will cause the opening 3210 of the housing 3200 to expand, thereby increasing the diameter of the bore 3270 and the diameter of the drum brake 3235. With the drum brake 3235 disengaged from the one-way bearing 3215, the force exerted by the user will eventually cause the gear 3240 to rotate in the second direction 3265, which will cause the spool 3205 to rotate in the first direction 3260. Rotation of the spool 3205 in the first direction 3260 will unwind (e.g., pay out) the tether 3299 and permit the trigger box 155 to move in a forward direction. When the user stops exerting a force to rotate the gear 3240 in the second direction 3265, the opening 3210 of the housing will close at least partially, which further decreases the diameter of the bore 3270 of the housing and the diameter of the drum brake 3235 and causes the drum brake 3235 to reengage the outer bearing element 3280 of the one-way bearing 3215. With the drum brake 3235 engaged with the outer bearing element 3280, the drum brake 3235 will prevent rotation of the outer bearing element 3280, at which point the one-way bearing 3215 will act to prevent further rotation of the spool 3205 in the first direction 3260 and correspondingly prevent rotation of the gear 3240 in the second direction 3265 as discussed above.

As depicted in FIGS. 33-35, 37, and 38, among others, the cocking mechanism 190 includes a cord 3300. The cord 3300 is coupled with the trigger box 155. The cord 3300 is coupled with a cord attachment device 3245 of the trigger box 155. The cord attachment device 3245 is configured to receive an end of the cord 3300 to secure the end of the cord 3300 to the trigger box 155. According to an exemplary embodiment, the cord attachment device 3245 includes an aperture to receive the cord 3300 and a fastener to secure the cord 3300 within the aperture. In other examples, the cord attachment device 3245 includes a clip, ratchet, or other retention mechanism configured to retain the cord 3300 against the trigger box 155. The cord attachment device 3245 is positioned to a front end of the trigger box 155 (e.g., an end opposite the end where the tether 3299 is attached).

Figure 36:
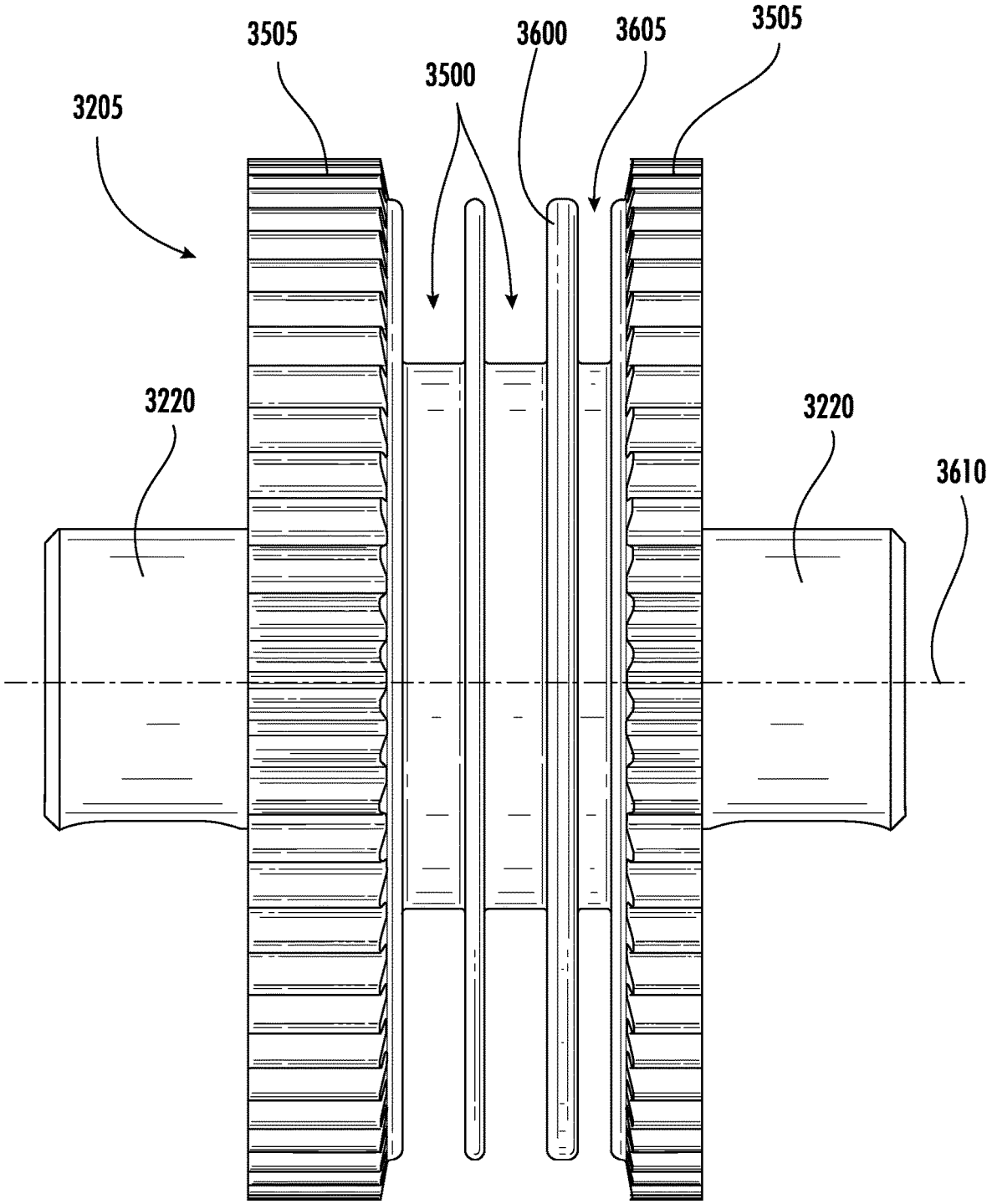
FIG. 36 is a rear view of a spool of the cocking mechanism of FIG. 32.
Figure 37:
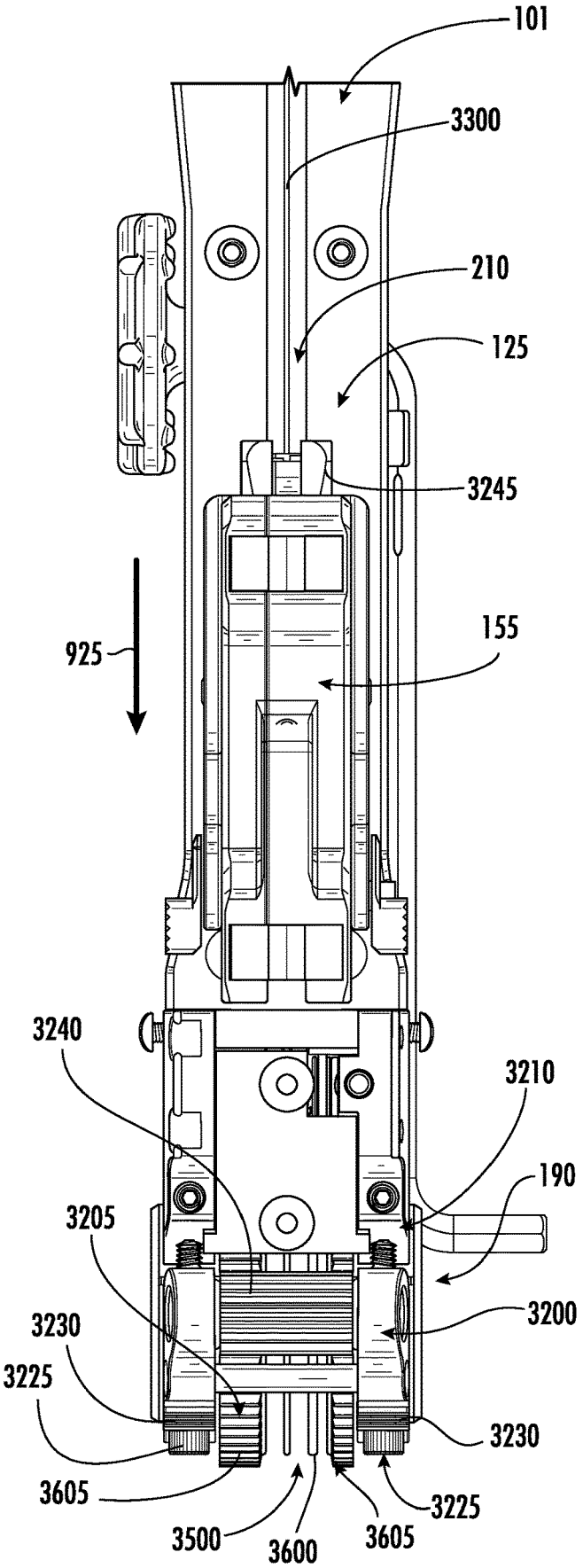
FIG. 37 is a top view of the cocking mechanism and trigger box of FIG. 32.
Figure 38:
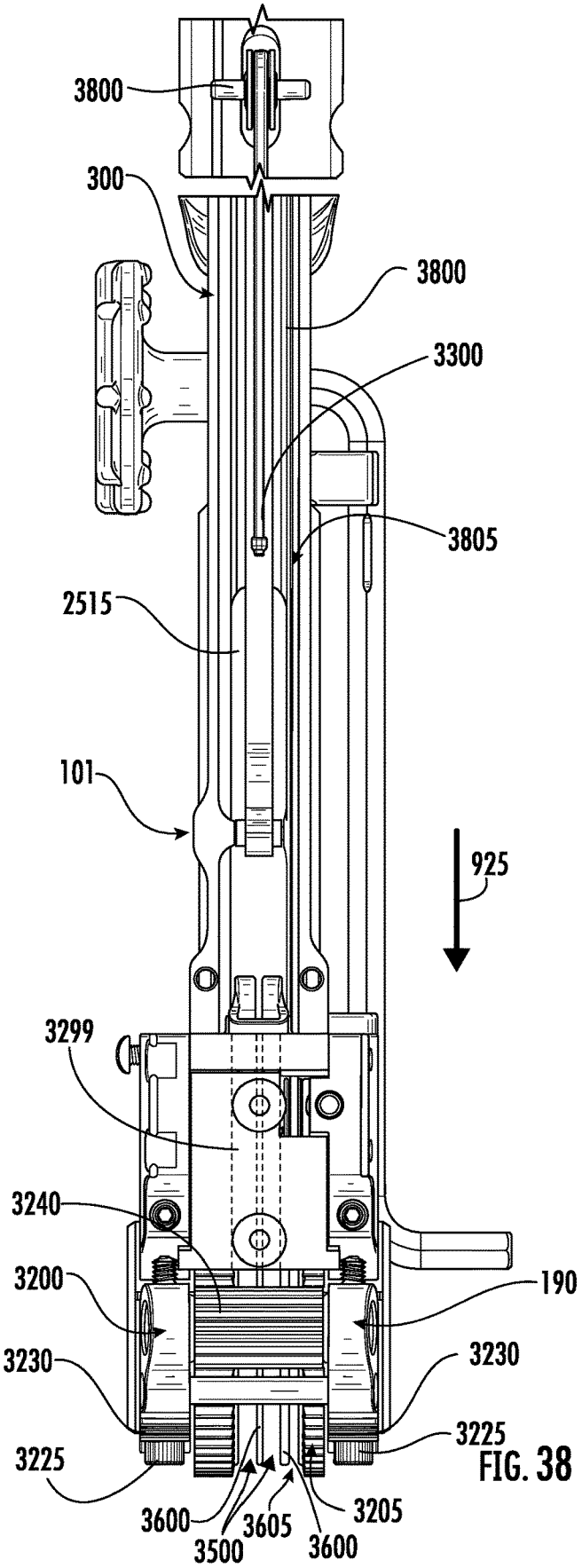
FIG. 38 is a top view of the cocking mechanism FIG. 32 and the rail of the projectile launcher of FIG. 1A.

The cord 3300 is coupled with the spool 3205 and the trigger box 155. Specifically, the cord 3300 is configured to wind onto and unwind from the spool 3205 during operation of the crossbow 100. As depicted in FIG. 36, among others, spool 3205 includes a cord recess 3605 that is separated from the tether recess 3500 via a partition 3600 (e.g., a dividing wall). The cord 3300 is coupled with the spool 3205 within the cord recess 3605 such that a rotation of the spool 3205 causes the cord 3300 to wrap around the spool 3205 within the cord recess 3605. Specifically, during operation of the crossbow 100 the cord 3300 wraps around the spool 3205 when the spool 3205 rotates in the first direction 3260 and unwraps from the spool 3205 when the spool 3205 rotates in the second direction 3265. Put another way, the cord 3300 unwraps from the spool 3205 as the tether 3299 wraps onto the spool 3205, and the cord 3300 wraps onto the spool 3205 as the tether 3299 unwraps from the spool 3205. The cord 3300 is routed from the cord recess 3605 of the spool 3205 to a pulley 4005 and from the pulley 4005 to a cord tensioner 4000 to a pulley 4005. The cord 3300 is wrapped around the cord tensioner 4000 one or more times to create tension in the cord 3300. The cord tensioner 4000 includes an adjustable position relative to the spool 3205 such that the tension in the cord 3300 can be adjusted or optimized. According to an exemplary embodiment, the cord tensioner 4000 is an accumulator device. In some embodiments, the cord 3300 is integrally coupled with the tether 3299 such that the cord and tether 3299 are portions of the same member. For example, the tether 3299 can be a first portion of a tether (e.g., rope, web, band, strap, string, cord, cable, or other element) that is routed from the trigger box 155 to the spool 3205, and the cord 3300 can be a second portion of the same tether that is routed from the spool 3205 to the cord attachment mechanism 3245 of the trigger box 155.

The cord 3300 is routed between the cocking mechanism 190 and the trigger box 155 at least partially within a channel 3805. The channel 3805 is a groove, slot, tube, or passageway formed along a top surface 2515 of the rail 300. According to an exemplary embodiment, the channel 2500 extends along the top surface 2515 of the rail 300 from the rear end 3255 of the rail 300 to some position along the rail 300 between the front end 2505 of the rail 300 and the rear end 3255 of the rail 300. Specifically, the cord 3300 exits the channel 3085 at some position forward of the trigger box 155 when the trigger box 155 is in its forward-most position (e.g., a position in which the string catch 3250 of the trigger box 155 engages with the draw string 145. The channel 3805 is configured to receive the cord 3300. Specifically, the channel 3805 is configured to receive the cord 3300 that is routed from the cord tensioner 4000 of the cocking mechanism 190 to the cable attachment device 2615 of the trigger box 155 to operatively couple the spool 3205 with the trigger box 155. The cord 3300 exits the channel 3805 and is routed around a pulley 3800. For example, the cord 3300 is routed from the cord recess 3605 of the spool 3205, through the channel 3805, at least partially around the pulley 3800, and to the cord attachment device 3245 of the trigger box 155.

In embodiments where the channel 3805 is positioned along the top surface 2515 of the rail 300, the cord 3300 can be coupled to the cord attachment device 3245 of the trigger box 155 and routed to the cord tensioner 4000 and the spool 3205 of the cocking mechanism 190 before the bottom plate 125 is coupled to the rail 300 during assembly of the crossbow 100. The cord 3300 can be captured between the rail 300 and the bottom plate 125 with the bottom plate 125 coupled to the rail 300. The portion of the cord 3300 positioned between the cord recess 3605 and the pulley 3800 is positioned within the channel 3805, where the channel 3805 can be positioned beneath the bottom plate 125 (e.g., between the bottom plate 125 and the rail 300). The portion of the cord 3300 positioned between the pulley 3800 can be positioned above the bottom plate 125 or above the channel 3805. For example, the cord 3300 can be routed from the pulley 3800 to the cord attachment device 3245 via the slot 210 of the bottom plate 125. In this way, the pulley 3800 can vertically alter a position of the cord 3300. The pulley 3800 can be rotatably coupled with the rail 300, the bottom plate 125, or some other component of the crossbow 100. According to an exemplary embodiment, the pulley 3800 can rotate about an axis that is perpendicular to the projectile axis 535 (e.g., substantially horizontal and perpendicular to the projectile axis 535).

Because the cord 3300 is coupled to the cord attachment device 3245 positioned at or toward the front end of the trigger box 155, the cord 3300 is configured to pull the trigger box 155 in a forward direction with the cord 3300 coupled to the cord attachment device 3245 of the trigger box. In particular, the cord 3300 coupled to the cord attachment device 3245 can, when under sufficient tension, pull the trigger box 155 in a forward direction to cause the trigger box 155 to slide (e.g., within the slots 210 of the top plate 120 and the bottom plate 125) toward the front end 105 of the crossbow 100. For example, during operation of the crossbow 100 a user can rotate the gear 3240 in the second direction 3265, which causes the spool 3205 to rotate in the first direction 3260 (with the drum brake 3235 disengaged from the outer bearing element 3280 of the one-way bearing 3215), which further causes the cord 3300 to wind onto the spool 3205 within the cord recess 3605, which further causes the cord 3300 to be in tension, which further causes the trigger box 155 to slide forward within the slots 210 of the top plate 120 and the bottom plate 125. Such an arrangement allows a user to conveniently move the trigger box 155 from a forward position to a rearward position and vice versa using the same cocking handle, for example.

Figure 41:
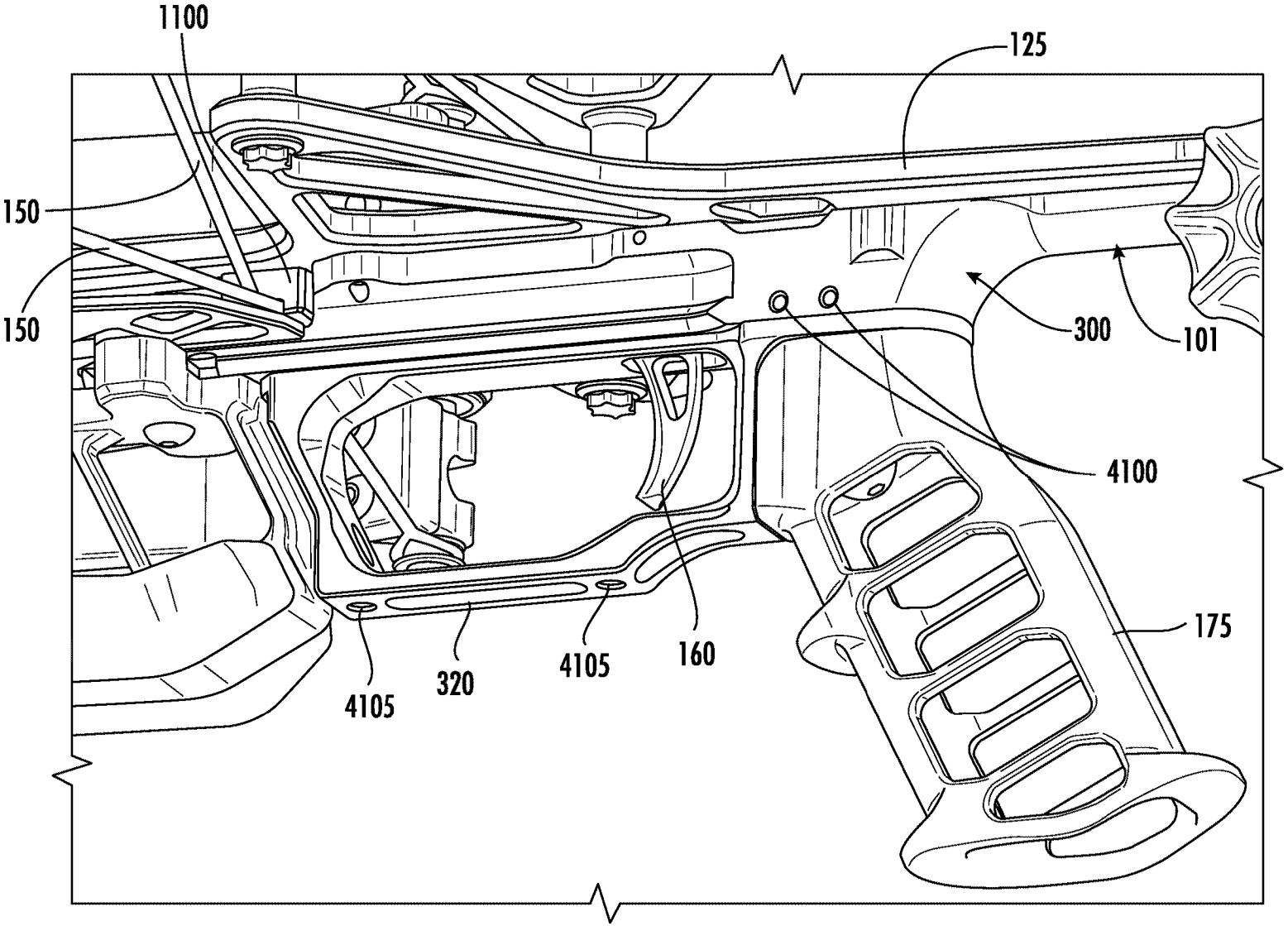
FIG. 41 is a bottom, left, rear perspective view of the trigger of the projectile launcher of FIG. 1A.

As depicted in FIG. 41, among others, the crossbow 100 includes the grip 175 formed as a pistol grip. The grip 175 is coupled to the rail 300 via a fastener. Specifically, the grip 175 is coupled to the rail 300 with the trigger guard 320 disposed at least partially therebetween. The grip 175 is hollow or includes an opening (e.g., thru hole) to reduce weight of the grip 175, according to some examples. The trigger guard 320 partially encloses the trigger 160 to prevent the trigger 160 from inadvertently contacting an object or surface during operation of the crossbow 100. The trigger guard 320 includes an aperture 4105 to which an accessory can be coupled. For example, a bi-pod attachment can be secured to the trigger guard 320 via the aperture 4105 using a fastener. The rail 300 includes an aperture 4100. The aperture 4100 can receive a fastener to couple an accessory to the rail 300 of the crossbow 100. For example, a bi-pod attachment or some other accessory can be coupled to the rail 300 via the aperture 4100. In other examples, a thumb rest can be coupled to the rail 300 via the aperture 4100. The aperture 4100 and/or the aperture 4105 can be positioned proximate to (e.g., within six inches of) a center of gravity of the crossbow 100. Accordingly, any bi-pod attachment coupled to the crossbow 100 via the aperture 4100 of the rail 300 or via the aperture 4105 of the trigger guard 320 can be positioned at or proximate to the center of gravity of the crossbow 100 to bolster balance of the crossbow 100 and resultant accuracy of the projectile 147 during operation.

As depicted in FIG. 42, among others, the top plate 120 includes a composite material having a fibrous material with fibers that are substantially parallel (e.g., ±30° from parallel) with the trusses 525. Although FIG. 42 depicts the top plate 120, it is understood that the bottom plate 125 can be similarly structured. Accordingly, the following discussion of the top plate 120 is equally applicable to the bottom plate 125. As discussed above with reference to FIGS. 5A-6B, among others, the top plate 120 includes multiple trusses 525. The trusses 525 can be oriented (e.g., extend) in a variety of directions. For example, the top plate 120 includes a first truss 525 extending in a first direction 4205, a second truss 525 extending in a second direction 4210, a third truss 525 extending in a third direction 4215, and a fourth truss 525 extending in a fourth direction 4220. The top plate 120 can include more or fewer trusses oriented in more or fewer directions in other embodiments. The top plate 120 can include a composite material, such as carbon fiber, fiber glass, or some other material that itself includes a plurality of layers (e.g., sheets, plies) of fibrous composite material that are bonded together. In the case of carbon fiber, for example, several plies of woven carbon fiber material can be bonded together via epoxy. The plies of woven carbon fiber material can include elongated strands of carbon material extending in multiple directions (e.g., two perpendicular directions). In embodiments where the top plate 120 is made at least partially from carbon fiber material, for example, these elongated carbon strands extend throughout and are embedded within the top plate 120, for example.

According to an exemplary embodiment and as depicted in FIG. 42, for example, the top plate 120 can include a fibrous composite material 4200. The material 4200 can include a first layer 4225, a second layer 4235, a third layer 4245, and a fourth layer 4255. One or more of the first layer 4225, the second layer 4235, the third layer 4245, and the fourth layer 4255 can be separate layers or can be combined (e.g., interwoven) layers. For example, the first layer 4225 and the third layer 4245 can be interwoven to form a single ply of carbon material. Likewise, the second layer 4235 and the fourth layer 4255 can be interwoven to form a single ply of carbon material. The first layer 4225 includes multiple first fibers 4230 (e.g., carbon fibers) that are oriented substantially (e.g., ±30°) in the first direction 4205. In this way, the first fibers 4230 of the first layer 4225 and the first truss 525 are both oriented in the first direction 4205 such that the first fibers 4230 and the first truss 525 are substantially parallel (e.g., ±30° from parallel). The second layer 4235 includes multiple second fibers 4240 (e.g., carbon fibers) that are oriented substantially (e.g., ±30°) in the second direction 4210. In this way, the second fibers 4240 of the second layer 4235 and the second truss 525 are both oriented in the second direction 4210 such that the second fibers 4240 and the second truss 525 are substantially parallel (e.g., ±30° from parallel). The third layer 4245 includes multiple third fibers 4250 (e.g., carbon fibers) that are oriented substantially (e.g., ±30°) in the third direction 4215. In this way, the third fibers 4250 of the third layer 4245 and the third truss 525 are both oriented in the third direction 4215 such that the third fibers 4250 and the third truss 525 are substantially parallel (e.g., ±30° from parallel). The fourth layer 4255 includes multiple fourth fibers 4260 (e.g., carbon fibers) that are oriented substantially (e.g., ±30°) in the fourth direction 4220. In this way, the fourth fibers 4260 of the fourth layer 4255 and the fourth truss 525 are both oriented in the fourth direction 4220 such that the fourth fibers 4260 and the second truss 525 are substantially parallel (e.g., ±30° from parallel). Because the top plate 120 includes trusses 525 that are oriented to be substantially parallel (e.g., ±30° from parallel) with fibers of at least one layer of the material 4200, the trusses 525 of the top plate 120 has an increased structural rigidity relative to some other plate without fibers aligned with trusses 525. This allows the top plate 120 (and/or the bottom plate 125) to use less material or have a more compact package, for example.

As depicted in FIG. 43, among others, the trigger box 155 includes the string catch 3250 operatively coupled with the safety switch 3285 and the trigger 160. Specifically, the string catch 3250 is operatively coupled with the safety switch 3285 and the trigger 160 via a sear 4320. The sear 4320 is a rotatable member that, upon rotating in a direction 4322, can cause the string catch 3250 to rotate in the direction 4310 to release the draw string 145 and launch the projectile 147 from the crossbow 100. In a first position as shown in FIG. 43, a rear portion 4300 of the string catch 3250 is engaged with the sear 4320 such that the sear 4320 prevents rotation of the string catch 3250 in the direction 4310 and accordingly prevents the string catch 3250 from releasing the draw string 145. When the sear 4320 rotates in the direction 4322 into a second position, string catch 3250 at least temporarily disengages from the sear 4320 to permit the rotation of the string catch 3250 in the direction 4310 to release the draw string 145. For example, a spring 4303 can act on the string catch 3250 to cause the string catch 3250 can rotate in the direction 4310.

The trigger 160 includes a trigger pawl 4370. Actuation of the trigger 160 causes movement of the trigger pawl 4370. The trigger pawl 4370 contacts (e.g., pushes, strikes, rotates) the sear 4320 to cause the sear 4320 to rotate in the direction 4322. As noted above, rotation of the sear 4320 in the direction 4322 causes the string catch 3250 to release the draw string 145 and launch the projectile 147. Accordingly, movement of the trigger pawl 4370 via the trigger 160 causes the string catch 3250 to rotate in the direction 4310 to release the draw string 145 and launch the projectile 147.

The trigger box 155 includes an anti-dry fire mechanism 4315. The anti-dry fire mechanism 4315 includes a projectile-engaging portion 4317 and a sear-engaging portion 4319. The anti-dry fire mechanism is configured to rotate in the direction 4318. Specifically, the anti-dry fire mechanism 4315 is configured to rotate in the direction 4318 from a first position in which the sear-engaging portion 4319 is engaged with the sear 4320 (as shown in FIG. 43) to a second position in which the sear-engaging portion 4319 is disengaged from the sear 4320. In the first position, the sear-engaging portion 4319 of the anti-dry fire mechanism 4315 is configured to prevent rotation of the sear in the direction 4322. For example, with the sear-engaging portion 4319 of the anti-dry fire mechanism 4315 engaged with the sear 4320, the sear 4320 cannot rotate in the direction 4322, which further prevents the string catch 3250 from rotating in the direction 4310 and releasing the draw string 145. The anti-dry fire mechanism 4315 is configured to rotate in the direction 4318 when the projectile 147 is engaged with (e.g., nocked to) the draw string 145. Specifically, the projectile 147 (e.g., a nock end 1700 or a shaft 1715) of the projectile 147 will contact the projectile-engaging portion 4317 of the anti-dry fire mechanism 4315 when the projectile 147 is engaged with the draw string 145. The projectile 147 can depress the projectile-engaging portion 4317 of the anti-dry fire mechanism 4315 to cause the anti-dry fire mechanism 4315 to rotate in the direction 4318 such that the sear-engaging portion 4319 moves out of engagement with the sear 4320. Accordingly, the anti-dry fire mechanism 4315 prevents rotation of the sear 4320 in the direction 4322 if no projectile 147 is engaged with the draw string 145 but permits the sear 4320 to rotate in the direction 4322 if a projectile 147 is properly engaged with the draw string 145.

The safety switch 3285 of the crossbow 100 is operatively coupled with a safety 4325. The safety 4325 is a rotatable member positioned within the trigger box 155 that is configured to selectively rotate in the direction 4327. The safety 4325 is selectively engaged with the sear 4320. For example, with the safety 4325 in a first position as shown in FIG. 43, the sear 4320 is engaged with the safety 4325 such that the sear 4320 cannot rotate in the direction 4322. Because the sear 4320 cannot rotate it the direction 4322 with the safety 4325 in the first position, the string catch 3250 cannot rotate in the direction 4310, and the draw string 145 cannot be released from the string catch 3250. Accordingly, the safety 4325 prevents the string catch 3250 from releasing the draw string 145 when the safety is in a first position as shown in FIG. 43. The safety 4325 is operatively coupled with the safety switch 3285 such that a user input via the safety switch 3285 (e.g., a user's application of a linear or rotational force on the safety switch 3285) can cause the safety 4325 to rotate in the direction 4327. The safety 4325 moves from the first position (e.g., a position in which the safety 4325 prevents the string catch 3250 from releasing the draw string 145 by inhibiting movement of the sear 4320) to a second position where the sear 4320 can move in the direction 4322 in response to a movement of the trigger pawl 4370 via actuation of the trigger 160. For example, the safety 4325 can rotate in the direction 4327 and out of engagement with the sear 4320, which can enable the sear 4320 to rotate in the direction 4322 in response to a movement of the trigger pawl 4370. As noted above, movement of the sear 4320 in the direction 4322 can cause the string catch 3250 to rotate in the direction 4310 and release the draw string 145 to fire the projectile 147. So, the safety 4325 does not inhibit rotation of the sear 4320 with the safety 4325 in a second position and disengaged with the sear 4320.

The crossbow 100 includes a safety lock mechanism 4330 that can prevent movement of the safety 4325 from the first position (e.g., a position in which the safety 4325 is engaged with the sear 4320 to prevent movement of the sear 4320 in the direction 4322) to the second position (e.g., a position in which the safety 4325 is disengaged from the sear 4320). The safety lock mechanism 4330 includes a first end 4335 that is selectively engaged with the safety 4325 and acts to prevent rotation of the safety 4325 in the direction 4327. Specifically, the first end 4335 of the safety lock mechanism 4330 contacts the safety 4325 to physically inhibit or prevent rotation of the safety 4325 in the direction 4327. The safety lock mechanism 4330 includes a spring 4345 that is captured between a wall 4350 of the safety lock mechanism 4330 and a wall 4355 of a housing of the trigger box 155. The spring 4345 biases the safety lock mechanism 4330 into the first position in which the first end 4335 is engaged with the safety 4325 to prevent movement of the safety 4325 in the direction 4327.

The safety lock mechanism 4330 selectively moves from a first position as shown in FIG. 43 in which the first end 4335 is engaged with the safety 4325 to a second position in which the first end 4335 is separated from or disengaged from the safety 4325. For example, with the safety lock mechanism 4330 in a second position, the safety 4325 can rotate in the direction 4327 and out of engagement with the sear 4320. The safety lock mechanism 4330 can move from the first position (e.g., the position shown in FIG. 43) in the direction 4333 to a second position. For example, the safety lock mechanism 4330 includes a second end 4340 that extends rearward and proximate to the rear end 3290 of the trigger box 155. The second end 4340 of the safety lock mechanism 4330 is accessible from the rear end 3290 of the trigger box 155. For example, the second end 4340 is selectively contacted by a projection 4360 extending from the wall 3295 of the cocking mechanism 190. The projection 4360 can be received in an opening of the trigger box 155 as the rear end 3290 of the trigger box 155 approaches the wall 3295 and can contact the second end 4340 of the safety lock mechanism 4330 to move the safety lock mechanism 4330 from the first position (e.g., the position shown in FIG. 43) to a second position in which the first end 4335 of the safety lock mechanism 4330 is disengaged from the safety 4325. The safety lock mechanism 4330 will move into the second position in which the first end 4335 of the safety lock mechanism 4330 is disengaged from the safety 4325 when the trigger box 155 is sufficiently close to the wall 3295. Put another way, if the trigger box 155 is not sufficiently close to the wall 3295, the safety lock mechanism 4330 will act to prevent the safety 4325 from rotating in the direction 4327, which in turn prevents the string catch 3250 from releasing the draw string 145. In this way, the safety lock mechanism 4330 will only permit the safety 4325 to disengage from the sear 4320 (which ultimately permits the string catch 3250 to release the draw string 145 and launch the projectile 147) if the trigger box 155 is sufficiently close to the wall 3295, which prevents a user from launching a projectile unless the draw string 145 is in the drawn position rather than some intermediate position).

The trigger box 155 includes a magnet 4305. The magnet 4305 can be positioned within the trigger box 155 and proximate to the rear portion 4300 of the string catch 3250. For example, the magnet 4305 can be positioned adjacent the rear portion 4300 of the string catch 3250 so that as the string catch 3250 rotates in the direction 4310 (or in an opposite direction), the rear portion 4300 of the string catch 3250 passes by the magnet 4305. The magnet 4305 can act as an eddy current brake to slow or decrease a rotational velocity of the string catch 3250 as the string catch 3250 moves in the direction 4310. Specifically, the rear portion 4300 of the string catch 3250 can include an electrically conductive material. As the string catch 3250 rotates in the direction 4310 (e.g., as the draw string 145 is released from the string catch 3250, the electrically conductive rear portion 4300 can pass by the magnet 4305. As the electrically conductive rear portion 4300 of the string catch 3250 moves past the magnet 4305, eddy currents (e.g., circular electrical currents) are generated that create a magnetic field that opposes a magnetic field of the magnet 4305. The opposing magnetic fields can cause a velocity the rear portion 4300 of the string catch 3250 to decrease. Accordingly, as the string catch 3250 moves in the direction 4310 (e.g., as the crossbow 100 is fired), the electromagnetic interaction between the magnet 4305 and the rear portion 4300 of the string catch 3250 can slow the motion of the string catch 3250. The slowed motion of the string catch 3250 can substantially prevent the string catch 3250 from rebounding or upon completion of its rotation in the direction 4310 or forcibly contacting another component of the trigger box 155. By substantially preventing the string catch 3250 from rebounding or forcibly striking other components, wear experienced by the string catch 3250 or other components of the trigger box 155 can be reduced.

As utilized herein with respect to numerical ranges, the terms "approximately," "about," "substantially," and similar terms generally mean+/−10% of the disclosed values. When the terms "approximately," "about," "substantially," and similar terms are applied to a structural feature (e.g., to describe its shape, size, orientation, direction, etc.), these terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using one or more separate intervening members, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic. The term rotatably coupled means that the components can only rotate relative to each other with a single degree of freedom (e.g., about a single axis) during normal operation conditions.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps or operations, the order of such steps may differ from what is depicted and described, unless specified differently above. Also, two or more steps may be performed concurrently or with partial concurrence, unless specified differently above.

It is important to note that the construction and arrangement of the projectile launcher as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A crossbow, comprising:

first plate including a slot;

a second plate including a slot, the second plate coupled to the first plate and extending substantially parallel to the first plate, the second plate spaced apart from the first plate;

an upper flexible limb coupled with the first plate;

a lower flexible limb coupled with the second plate;

a draw string operatively engaged with the upper flexible limb and the lower flexible limb, the draw string configured to move from a released position to a drawn position; and a trigger box slidably coupled with the first plate the second plate and engaged with the slot of the first plate and the slot of the second plate, the trigger box configured to selectively engage with the draw string to move the draw string between the released position and the drawn position.

2. The crossbow of claim 1, wherein the trigger box is positioned between the first plate and the second plate.

3. The crossbow of claim 1, wherein the trigger box includes a first protrusion configured to be received within the slot of the first plate and a second protrusion configured to be received within the slot of the second plate.

4. The crossbow of claim 3, wherein the trigger box is configured to slide along a length of the slot of the first plate and a length of the slot of the second plate as the trigger box moves the draw string between the released position to the drawn position.

5. The crossbow of claim 1, further comprising a cord coupled with the trigger box and configured to move the trigger box in a direction toward a front end of the crossbow.

6. The crossbow of claim 5, wherein a first end of the cord is detachably coupled with the trigger box by a fastener.

7. The crossbow of claim 5, wherein the cord extends at least partially within the slot of the second plate.

8. The crossbow of claim 5, further comprising:

a cocking mechanism including a spool; and a tether coupled with a second end of the trigger box and the cocking mechanism, wherein the cocking mechanism is configured to wind the tether about the spool to move the trigger box toward a rear end of the crossbow;

wherein the cocking mechanism is configured to wind the cord about the spool to move the trigger box in the direction toward the front end of the crossbow.

9. The crossbow of claim 8, wherein the spool includes a first recess and a second recess, wherein the cocking mechanism is configured to wind the tether within the first recess, and wherein the cocking mechanism is configured to wind the cord within the first recess.

10. The crossbow of claim 8, wherein the cocking mechanism further includes a first pulley, tensioner, and a second pulley, wherein the cord is routed from the spool to the first pulley, from the first pulley to the tensioner, from the tensioner to the second pulley, and from the second pulley to the trigger box.

11. The crossbow of claim 10, wherein, in operation, the second pulley vertically alters a position of the cord.

12. The crossbow of claim 10, wherein the tensioner is configured to adjust a tension of the cord.

13. The crossbow of claim 8, further comprising:

a frame coupled to the second plate, the frame defining a channel;

wherein a first portion of the cord extends within the channel; and wherein a second portion of the cord extends within the slot of the second plate.

14. The crossbow of claim 1, wherein the trigger box includes a string catch configured to selectively engage with the draw string to selectively retain the draw string in the drawn position, and wherein the trigger box includes a magnet configured to magnetically interact with the string catch to inhibit rotation of the string catch.

15. A crossbow, comprising:

a first plate including a slot;

a second plate including a slot, the second plate coupled to the first plate and extending substantially parallel to the first plate, the second plate spaced apart from the first plate to define an opening;

an upper flexible limb coupled with the first plate;

a lower flexible limb coupled with the second plate;

a draw string operatively engaged with the upper flexible limb and the lower flexible limb, the draw string located within the opening and configured to move from a released position to a drawn position; and a trigger box slidably coupled with the first plate and the second plate and including a first protrusion configured to be received within the slot of the first plate and a second protrusion configured to be received within the slot of the second plate, the trigger box configured to selectively engage with the draw string to move the draw string between the released position and the drawn position.

16. The crossbow of claim 15, wherein the trigger box is positioned between the first plate and the second plate and is configured to slide along a length of the slot of the first plate and a length of the slot of the second plate.

17. The crossbow of claim 15, wherein the first protrusion and the second protrusion include friction-reducing elements.

18. A crossbow, comprising:

a frame;

a first plate including a slot;

a second plate including a slot, the second plate coupled to the frame and the first plate and extending substantially parallel to the first plate, the second plate spaced apart from the first plate to define an opening;

an upper flexible limb coupled with the first plate;

a lower flexible limb coupled with the second plate;

a draw string operatively engaged with the upper flexible limb and the lower flexible limb, the draw string located within the opening and configured to move from a released position to a drawn position;

a trigger box slidably coupled with the first plate the second plate within the slot of the first plate and the slot of the second plate, the trigger box configured to selectively engage with the draw string to move the draw string between the released position and the drawn position; and a cocking mechanism coupled with the trigger box and configured to cause the trigger box to move the draw string between the released position and the drawn position, the cocking mechanism coupled with the first plate.

19. The crossbow of claim 18, further comprising:

a cocking mechanism including a spool; and a tether coupled with a second end of the trigger box and the cocking mechanism, wherein the cocking mechanism is configured to wind the tether about the spool to move the trigger box toward a rear end of the crossbow; and a cord extending between a front end of the trigger box and the cocking mechanism, the cocking mechanism configured to wind the cord on a spool to pull the trigger box in a direction towards a front end of the crossbow;

wherein the cocking mechanism is configured to wind the cord about the spool to move the trigger box in the direction toward the front end of the crossbow.

20. The crossbow of claim 19, wherein the frame includes a channel, and wherein the cord extends at least partially within the channel of the frame and at least partially within the slot of the second plate.

* * * * *